US005659992A

United States Patent [19]

Mistretta

[11] Patent Number: 5,659,992

[45] Date of Patent: Aug. 26, 1997

[54] SINGLE-SHOT FALLING BREECH BLOCK ACTION

[76] Inventor: Bernard J. Mistretta, 160-19 24th Ave., Whitestone, N.Y. 11357-3940

[21] Appl. No.: 676,764

[22] Filed: Jul. 8, 1996

[51] Int. Cl.[6] ..... F41A 3/00; F41C 7/00

[52] U.S. Cl. ..... 42/23; 42/14; 42/25; 42/8; 42/68

[58] Field of Search ..... 42/23, 14, 25, 42/8, 68; 89/145

[56] References Cited

U.S. PATENT DOCUMENTS

| | | | |
|---|---|---|---|
| 3,355,833 | 12/1967 | Ruger et al. | 42/23 |
| 3,382,597 | 5/1968 | Ruger et al. | 42/23 |
| 3,710,493 | 1/1973 | Gramiger et al. | 42/23 |
| 3,735,517 | 5/1973 | De Haas et al. | 42/23 |
| 3,739,515 | 6/1973 | Koon, Jr. | 42/75 C |
| 3,785,243 | 1/1974 | Christakos | 89/149 |
| 3,845,689 | 11/1974 | Zanoni | 89/181 |
| 4,095,363 | 6/1978 | Riedl | 42/23 |
| 4,161,836 | 7/1979 | Hayashi | 42/16 |
| 4,358,986 | 11/1982 | Giorgio | 89/142 |
| 4,502,367 | 3/1985 | Sullivan | 89/181 |
| 4,522,105 | 6/1985 | Atchisson | 89/139 |
| 4,570,369 | 2/1986 | Gerfen | 42/23 |
| 4,648,190 | 3/1987 | Allen | 42/23 |
| 4,685,236 | 8/1987 | May | 42/76.02 |
| 4,791,851 | 12/1988 | Stoner | 89/156 |
| 5,148,619 | 9/1992 | Badali | 42/16 |
| 5,279,200 | 1/1994 | Rose | 89/14.3 |

*Primary Examiner*—Charles T. Jordan
*Assistant Examiner*—Meena Chelliah
*Attorney, Agent, or Firm*—Richard L. Miller, P.E.

[57] ABSTRACT

A single shot falling breech block action that includes an upper receiver assembly, a lower receiver assembly, breech block assembly, a trigger assembly, a stationary rack, a movable rack, a pinion, an action plate, and pinion rotating apparatus. The pinion rotating apparatus rotates the pinion, so that when the pinion rotating apparatus is rotated clockwise the pinion is rotated clockwise and walks rearwardly along the horizontal stationary rack while the action plate slides rearwardly and begins to cock the single shot falling breech block action and the movable rack slides rearwardly and causes the breech block assembly to slide downwardly to load a cartridge and when the pinion rotating means is rotated counterclockwise the pinion is rotated counterclockwise and walks forwardly along the horizontal stationary rack while the action plate slides forwardly and the movable rack slides forwardly and causes the breech block assembly to slide upwardly and fully cocking the single shot falling breech block action.

73 Claims, 4 Drawing Sheets

SINGLE-SHOT FALLING BREECH BLOCK ACTION

BACKGROUND OF THE INVENTION

The present invention relates to a single shot falling breech block action. More particularly, the present invention relates to a single shot falling breech block action that includes an upper receiver assembly, a lower receiver assembly replaceably attached to the upper receiver, a breech block assembly slidably positioned in said lower receiver assembly, a trigger assembly pivotally mounted to the breech block assembly, a stationary rack fixedly attached to the lower receiver assembly, a movable rack slidably mounted to said lower receiver assembly, a pinion rotatively mounted to the lower receiver assembly, an action plate slidably mounted to the lower receiver, and pinion rotating apparatus for rotating the pinion.

Over the years, a variety of breech block rifle actions have been developed and which have generally been classified into a variety of different types of actions. The specific type of action is typically determined by the type of movement imparted to the breech block as the breech block moves into engagement with and disengagement from the cartridge chamber.

Some of the commonly known types of actions are the swinging block action, the rolling block action, and the falling block action. Within these types of actions, then numerous designs have been developed by gunsmiths around the world.

One particular falling block design that has been popularized in the United States in recent times is the Ruger 1 Falling Block Action and which includes a lever actuated single shot mechanism having a breech block containing spring biased firing pin mechanism. Necessary spring pressure for performing the cocking and ejection functions is obtained via attendant springs mounted forward of the receiver, beneath the barrel. While over the years this action has generally proven to be reliable, it requires a significant number of piece parts and close tolerance manufacturing to ensure the smooth operation of one to the other.

A variety of other falling block actions include the Kettner action, the Guedes action, a variety of German actions, the Lechner action, and the Hagn action, to name but a few of the many falling block actions that have been developed over the years. A description of these actions can be found in "Single Shot Rifles and Actions" by F. deHass (1969).

Further, it is known that, when a firearm is loaded and cocked, the loaded firearm constitutes a hazard to the user and his surroundings. It is customary, therefore, to provide a safety device which, in its operative position, blocks the trigger in its cocked position. In practice, however, it is often found that such a safety device usually is not absolutely effective. It happens frequently that when the firearm hits hard objects or becomes housed in branches, the safety device snaps open and a shot may be fired inadvertently.

All of the falling block actions presently in production have a toggle-link system that locks the breech block in the firing position and lowers the breech block after firing. Such a toggle-link system is difficult to manufacture and assemble. Also, as a result of these pins, links, and joints, the breeching system will always have mechanical "play" which is not conductive to tight breeching.

The device which safes the trigger on previously manufactured single shot actions has always been located on the hammer half-cock, thumb slide on top of the receiver, or on the transverse button on the rear of the trigger guard. Each location is not optimum in regard to removing the safety fast and protecting the safety from being accidentally pushed on. Also, previous single shot actions were designed for right-handed safety operation not providing comfortable operation for a left-handed shooter.

Previous single shot actions contain many pinned and screwed in parts which caused dis-assembly and assembly of the action to be difficult and in many cases expert knowledge was required to dis-assemble the action for cleaning or parts removal or inspection.

Numerous innovations for falling breech block actions have been provided in the prior art that will be described. Even though these innovations may be suitable for the specific individual purposes to which they address, however, they differ from the present invention in that they do not teach a single shot falling breech block action that includes an upper receiver assembly, a lower receiver assembly replaceably attached to the upper receiver, a breech block assembly slidably positioned in said lower receiver assembly, a trigger assembly pivotally mounted to the breech block assembly, a stationary rack fixedly attached to the lower receiver assembly, a movable rack slidably mounted to said lower receiver assembly, a pinion rotatively mounted to the lower receiver assembly, an action plate slidably mounted to the lower receiver, and pinion rotating apparatus for rotating the pinion.

FOR EXAMPLE, U.S. Pat. No. 3,710,493 to Gramiger et al. teaches a dropping breech block action that has a cocking mechanism and a movable breech block. A firing pin, a firing pin spring, and a trigger are mounted in the breech block. An actuating element is engaged in the breech block and is actuable independently of the cocking mechanism. This acting element acts on one of the two abutments between which the firing pin spring is engaged, and is operable to actuate the one abutment, while the breech is closed and the firing pin spring is tensioned, to relax, at least approximately completely, the tension of the firing pin spring without firing of the gun. The actuating element id further operable, through the one abutment, to retension the firing pin spring.

ANOTHER EXAMPLE, U.S. Pat. No. 4,095,363 to Riedl teaches a falling block single shot action for a firearm that includes a receiver, a rack toothed breech block in the receiver vertically movable by a pinion toothed lever pivotable on a pin. The breech block contains a firing pin and self-cocking hammer parts removable from the receiver as an assembly. The finger lever is held closed by a ball plunger positioned to provide maximum closed holding power. A trigger housing assembly includes a trigger, a safety, and sear contained in a trigger housing. The safety and trigger are fully adjustable and the complete trigger housing assembly is removably mounted in the receiver by a screw threaded into a threaded hole. The threaded hole is longitudinally split with half of the hole in the receiver and half of the hole in the trigger housing.

STILL ANOTHER EXAMPLE, U.S. Pat. No. 4,570,369 to Gerfen teaches a falling breech block rifle action that includes a receiver adapted to receive a chambered barrel, an essentially cylindrical breech block movable angularly upwardly and downwardly in the receiver. The breech block includes upper and lower portions and a hand lever is pivotally mounted in the receiver to raise and lower the breech block. A recess is in the receiver adapted to receive the upper portion of the breech block in the raised condition of the breech block. A trigger housing is connected to the receiver which includes a sear, trigger, and safety block. A cocking bar is connected to the hand lever and adapted to bear remotely against the striker to effect cocking of the striker. The sear is adapted to engage the striker in the cocked condition and the safety block is adapted to lock the trigger, sear, and striker in the cocked condition.

FINALLY, YET ANOTHER EXAMPLE, U.S. Pat. No. 4,648,190 to Allen teaches a falling block rifle action which is cocked by the downward movement of the breech block and which includes a safety mechanism for blocking not only a trigger movement but also the movement of the striker and other interconnecting linkages. An adjustable extractor mechanism coupled to the cocking lever in central relation to the chamber accommodates a wide variety of types and sizes of cartridges.

It is apparent that numerous innovations for falling breech block actions have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a single shot falling breech block action that avoids the disadvantages of the prior art.

ANOTHER OBJECT of the present invention is to provide a single shot falling breech block action that is simple and inexpensive to manufacture.

STILL ANOTHER OBJECT of the present invention is to provide a single shot falling breech block action that is simple to use.

YET ANOTHER OBJECT of the present invention is to provide a single shot falling breech block action that has quick tear-down via a screw passing through an action plate.

STILL YET ANOTHER OBJECT of the present invention is to provide a single shot falling breech block action wherein cocking of the rifle takes place via a special arrangement of a pinion acting with a movable action plate mounted in a lower receiver.

YET STILL ANOTHER OBJECT of the present invention is to provide a single shot falling breech block action wherein extraction of a spent shell takes place via a special arrangement of a pinion acting with a movable action plate mounted in the lower receiver.

STILL YET ANOTHER OBJECT of the present invention is to provide a single shot falling breech block action wherein the breech block is raised and lowered via a special arrangement of a pinion acting upon a stationary rack and a movable rack sliding in a slot in the side of the breech block.

YET STILL ANOTHER OBJECT of the present invention is to provide a single shot falling breech block action wherein the firing pin is guided by two lips machined onto the trigger housing.

STILL YET ANOTHER OBJECT of the present invention is to provide a single shot falling breech block action wherein the safety is operated by sliding the entire trigger guard forward and backward which blocks both the trigger and sear, so that there is no need to fumble around looking for a small safety switch.

YET STILL ANOTHER OBJECT of the present invention is to provide a single shot falling breech block action that utilizes a two piece receiver rather than a one piece receiver and two spacers which act as a pillar-bedding system.

STILL YET ANOTHER OBJECT of the present invention is to provide a single shot falling breech block action wherein the entire upper receiver can be omitted and the back end of the barrel can have a breech block hole broached into it as well as recoil shoulders and holes for the action screws.

YET STILL ANOTHER OBJECT of the present invention is to provide a single shot falling breech block action wherein the upper receiver and a barrel are one piece.

STILL YET ANOTHER OBJECT of the present invention is to provide a single shot falling breech block action wherein the lower receiver keeps the pinion, racks, extractor, and action plate in proper relation to each other.

YET STILL ANOTHER OBJECT of the present invention is to provide a single shot falling breech block action that uses a one-piece stock and the pillar-bedding system in place of a two piece stock, which is a major cause of inaccuracy with single-shot falling block rifles.

STILL YET ANOTHER OBJECT of the present invention is to provide a single shot falling breech block action that eliminates the link which is a common part in falling block rifles, so that the present invention can be disassembled quickly for cleaning or storage.

YET STILL ANOTHER OBJECT of the present invention is to provide a single shot falling breech block action wherein the breech block is joined to a finger or operating lever via the pinion operating on the movable and stationary racks as opposed to the link on other action which joins the operating lever with the breech block.

STILL YET ANOTHER OBJECT of the present invention is to provide a single shot falling breech block action whose recoil shoulders allow the action to be glass-bedded to the rifle stock.

YET STILL ANOTHER OBJECT of the present invention is to provide a single shot falling breech block action wherein the recoil shoulders line up with two ⅜ or ½ inch holes bored into the sides of the stock into which glass bedding compound is poured and allowed to cure with the action and the stock screwed together, so as to form a simple and inexpensive vehicle for maintaining close tolerances.

BRIEFLY STATED, STILL YET ANOTHER OBJECT of the present invention is to provide a single shot falling breech block action that includes an upper receiver assembly, a breech block assembly, a trigger assembly, a stationary rack, a movable rack, a pinion, an action plate, and pinion rotating apparatus.

YET STILL ANOTHER OBJECT of the present invention is to provide a single shot falling breech block action wherein the lower receiver assembly is replaceably attached to the upper receiver assembly.

STILL YET ANOTHER OBJECT of the present invention is to provide a single shot falling breech block action wherein the breech block assembly is replaceably and vertically slidably mounted in the lower receiver assembly and the upper receiver assembly.

YET STILL ANOTHER OBJECT of the present invention is to provide a single shot falling breech block action wherein the trigger assembly is replaceably mounted in the breech block assembly.

STILL YET ANOTHER OBJECT of the present invention is to provide a single shot falling breech block action wherein the stationary rack is replaceably and fixedly attached in the lower receiver assembly.

YET STILL ANOTHER OBJECT of the present invention is to provide a single shot falling breech block action wherein the movable rack is replaceably and forwardly and rearwardly slidably mounted in the lower receiver assembly and is engagable with the breech block assembly.

STILL YET ANOTHER OBJECT of the present invention is to provide a single shot falling breech block action wherein the pinion is clockwise and counterclockwise rotatively, and forwardly and rearwardly movably, positioned in the lower receiver and is rotatively engaged with the stationary rack and the movable rack.

YET STILL ANOTHER OBJECT of the present invention is to provide a single shot falling breech block action wherein the action plate is forwardly and rearwardly slidably mounted in the lower receiver assembly and is rotatively attached to the pinion, so that the pinion can rotate relative thereto.

STILL YET ANOTHER OBJECT of the present invention is to provide a single shot falling breech block action wherein the action plate is abutable against the breech block assembly.

YET STILL ANOTHER OBJECT of the present invention is to provide a single shot falling breech block action wherein the pinion rotating apparatus rotates the pinion, so that when the pinion rotating apparatus is rotated clockwise the pinion is rotated clockwise and walks rearwardly along the horizontal stationary rack while the action plate slides rearwardly and begins to cock the single shot falling breech block action and the movable rack slides rearwardly and causes the breech block assembly to slide downwardly to load a cartridge and when the pinion rotating means is rotated counterclockwise the pinion is rotated counterclockwise and walks forwardly along the horizontal stationary rack while the action plate slides forwardly and the movable rack slides forwardly and causes the breech block assembly to slide upwardly and fully cocking the single shot falling breech block action.

STILL YET ANOTHER OBJECT of the present invention is to provide a single shot falling breech block action wherein the upper receiver assembly has a generally rectangular-parallelepiped-shaped body with a vertical front and a vertical rear that is disposed behind the vertical front of the generally rectangular-parallelepiped-shaped body of the upper receiver assembly.

YET STILL ANOTHER OBJECT of the present invention is to provide a single shot falling breech block action wherein the generally rectangular-parallelepiped-shaped body of the upper receiver assembly further has a horizontal top that extends from the vertical front of the generally rectangular-parallelepiped-shaped body of the upper receiver assembly to the vertical rear of the generally rectangular-parallelepiped-shaped body of the upper receiver assembly.

STILL YET ANOTHER OBJECT of the present invention is to provide a single shot falling breech block action wherein the generally rectangular-parallelepiped-shaped body of the upper receiver assembly further has a horizontal bottom that is disposed below the horizontal top of the assembly generally rectangular-parallelepiped-shaped body of the upper receiver assembly and extends from the vertical front of the generally rectangular-parallelepiped-shaped body of the upper receiver assembly to the vertical rear of the generally rectangular-parallelepiped-shaped body of the upper receiver assembly.

YET STILL ANOTHER OBJECT of the present invention is to provide a single shot falling breech block action wherein the generally rectangular-parallelepiped-shaped body of the upper receiver assembly further has a pair of opposing and vertical sides.

STILL YET ANOTHER OBJECT of the present invention is to provide a single shot falling breech block action wherein each side of the pair of opposing and vertical sides of the generally rectangular-parallelepiped-shaped body of the upper receiver assembly extends from a side of the vertical front of the generally rectangular-parallelepiped-shaped body of the upper receiver assembly to a respective side of the vertical rear of the generally rectangular-parallelepiped-shaped body of the upper receiver assembly and from a side of the horizontal top of the generally rectangular-parallelepiped-shaped body of the upper receiver assembly to a respective side of the horizontal bottom of the generally rectangular-parallelepiped-shaped body of the upper receiver assembly.

YET STILL ANOTHER OBJECT of the present invention is to provide a single shot falling breech block action wherein the generally rectangular-parallelepiped-shaped body of the upper receiver assembly further has an imaginary intermediate vertical plane that is disposed at a substantial midpoint between the vertical front of the generally rectangular-parallelepiped-shaped body of the upper receiver assembly and the vertical rear of the generally rectangular-parallelepiped-shaped body of the upper receiver assembly.

STILL YET ANOTHER OBJECT of the present invention is to provide a single shot falling breech block action wherein the generally rectangular-parallelepiped-shaped body of the upper receiver assembly further has a breech block throughraceway that extends continuously from the horizontal top of the generally rectangular-parallelepiped-shaped body of the upper receiver assembly to the horizontal bottom of the generally rectangular-parallelepiped-shaped body of the upper receiver assembly and continuously from slightly rearward of the imaginary intermediate vertical plane of the generally rectangular-parallelepiped-shaped body of the upper receiver assembly to slightly forward of the vertical rear of the generally rectangular-parallelepiped-shaped body of the upper receiver assembly.

YET STILL ANOTHER OBJECT of the present invention is to provide a single shot falling breech block action wherein the horizontal top of the generally rectangular-parallelepiped-shaped body of the upper receiver assembly has a horizontal raised portion that extends from the vertical front of the generally rectangular-parallelepiped-shaped body of the upper receiver assembly to the breech block throughraceway of the generally rectangular-parallelepiped-shaped body of the upper receiver assembly and which has a pair of upwardly-and-inwardly-tapering vertical sides.

STILL YET ANOTHER OBJECT of the present invention is to provide a single shot falling breech block action wherein the generally rectangular-parallelepiped-shaped body of the upper receiver assembly further has a partially-threaded, cylindrically-shaped, and horizontally-oriented barrel mounting throughbore that extends longitudinally between, and opens into both, the vertical front of the generally rectangular-parallelepiped-shaped body of the upper receiver assembly and the breech block throughraceway of the generally rectangular-parallelepiped-shaped body of the upper receiver assembly.

YET STILL ANOTHER OBJECT of the present invention is to provide a single shot falling breech block action wherein the generally rectangular-parallelepiped-shaped body of the upper receiver assembly further has a pair of opposing and downwardly-and-inwardly-tapering recoil shoulders that are disposed slightly forward of the imaginary intermediate vertical plane of the generally rectangular-parallelepiped-shaped body of the upper receiver assembly.

STILL YET ANOTHER OBJECT of the present invention is to provide a single shot falling breech block action wherein each shoulder of the upper receiver assembly body pair of opposing and downwardly-and-inwardly-tapering recoil shoulders of the generally rectangular-parallelepiped-shaped body of the upper receiver assembly opens into, and extends downwardly and inwardly from, a respective side of the pair of opposing and vertical sides of the generally rectangular-parallelepiped-shaped body of the upper receiver assembly to, and opens into, the horizontal bottom of the generally rectangular-parallelepiped-shaped body of the upper receiver assembly.

YET STILL ANOTHER OBJECT of the present invention is to provide a single shot falling breech block action wherein the pair of opposing and downwardly-and-inwardly-tapering recoil shoulders of the generally rectangular-parallelepiped-shaped body of the upper receiver assembly are coated with a release material.

STILL YET ANOTHER OBJECT of the present invention is to provide a single shot falling breech block action wherein the horizontal bottom of the generally rectangular-parallelepiped-shaped body of the upper receiver assembly has a pair of threaded, spaced-apart, and longitudinally-oriented mounting bores that extend upwardly therefrom.

YET STILL ANOTHER OBJECT of the present invention is to provide a single shot falling breech block action wherein one bore of the pair of threaded, spaced-apart, and longitudinally-oriented mounting bores in the horizontal bottom of the generally rectangular-parallelepiped-shaped body of the upper receiver assembly is disposed slightly rearward of the vertical front of the generally rectangular-parallelepiped-shaped body of the upper receiver assembly and another bore of the pair of threaded, spaced-apart, and longitudinally-oriented mounting bores in the horizontal bottom of the generally rectangular-parallelepiped-shaped body of the upper receiver assembly is disposed slightly forward of the vertical rear of the generally rectangular-parallelepiped-shaped body of the upper receiver assembly.

STILL YET ANOTHER OBJECT of the present invention is to provide a single shot falling breech block action wherein the horizontal bottom of the generally rectangular-parallelepiped-shaped body of the upper receiver assembly further has a pair of spaced-apart and longitudinally-oriented take down screw plunger detents that extend upwardly therefrom.

YET STILL ANOTHER OBJECT of the present invention is to provide a single shot falling breech block action wherein the pair of spaced-apart and longitudinally-oriented take down screw plunger detents in the horizontal bottom of the generally rectangular-parallelepiped-shaped body of the upper receiver assembly are disposed longitudinally between the pair of opposing and downwardly-and-inwardly-tapering recoil shoulders of the generally rectangular-parallelepiped-shaped body of the upper receiver assembly and a forwardmost bore of the pair of threaded, spaced-apart, and longitudinally-oriented mounting bores in the horizontal bottom of the generally rectangular-parallelepiped-shaped body of the upper receiver assembly.

STILL YET ANOTHER OBJECT of the present invention is to provide a single shot falling breech block action wherein the partially-threaded, cylindrically-shaped, and longitudinally-oriented barrel mounting throughbore in the generally rectangular-parallelepiped-shaped body of the upper receiver assembly is threadably engagable with a threaded rear end of a barrel of a single shot rifle.

YET STILL ANOTHER OBJECT of the present invention is to provide a single shot falling breech block action wherein the upper receiver assembly is a barrel of a single shot rifle.

STILL YET ANOTHER OBJECT of the present invention is to provide a single shot falling breech block action wherein the barrel of the single shot rifle has a rear end with a breech block throughraceway that extends vertically therethrough, a pair of opposing and downwardly-and-inwardly-tapering recoil shoulders, and a pair of threaded, spaced-apart, and longitudinally-oriented mounting bores that extend upwardly.

YET STILL ANOTHER OBJECT of the present invention is to provide a single shot falling breech block action wherein the upper receiver assembly has a barrel of a single shot rifle integral therewith.

STILL YET ANOTHER OBJECT of the present invention is to provide a single shot falling breech block action wherein the lower receiver assembly has a pair of spaced-apart, longitudinally-oriented, and non-threaded mounting throughbores that are in vertical alignment with the pair of threaded, spaced-apart, and longitudinally-oriented mounting bores in the horizontal bottom of the generally rectangular-parallelepiped-shaped body of the upper receiver assembly.

YET STILL ANOTHER OBJECT of the present invention is to provide a single shot falling breech block action wherein the upper receiver assembly is replaceably attached to the lower receiver assembly by a pair of action mounting screws that extend freely through the pair of spaced-apart, longitudinally-oriented, and non-threaded mounting throughbores in the lower receiver assembly, through a pair of action mounting cylindrically-shaped and vertical spacers, and threadably engage the pair of threaded, spaced-apart, and longitudinally-oriented mounting bores in the horizontal bottom of the generally rectangular-parallelepiped-shaped body of the upper receiver assembly.

STILL YET ANOTHER OBJECT of the present invention is to provide a single shot falling breech block action wherein the vertical rear of the generally rectangular-parallelepiped-shaped body of the upper receiver assembly is positioned slightly forward from a butt portion of an appropriately modified stock of a single shot rifle so as to form a slight gap therebetween, so that percussion from the fired single shot rifle is not transferred to the butt portion of the appropriately modified stock of the single shot rifle and ultimately to a shoulder of a user.

YET STILL ANOTHER OBJECT of the present invention is to provide a single shot falling breech block action wherein the slight gap between the vertical rear of the generally rectangular-parallelepiped-shaped body of the upper receiver assembly and the butt portion of the appropriately modified stock of the single shot rifle is maintained by the upper receiver assembly body pair of opposing, release material coated, and downwardly-and-inwardly-tapering recoil shoulders of the upper generally rectangular-parallelepiped-shaped body of the upper receiver assembly being aligned with two apertures in corresponding positions in an intermediate portion of the appropriately modified stock of the single shot rifle and with glass bedding compound disposed in the two apertures in the corresponding positions in the intermediate portion of the appropriately modified stock of the single shot rifle and curing with the single shot falling breech block action and the appropriately modified stock of the single shot rifle being held together by the pair of action mounting screws, so that a simple and inexpensive vehicle for maintaining close tolerances is provided.

STILL YET ANOTHER OBJECT of the present invention is to provide a single shot falling breech block action wherein the release material coating on the pair of opposing, release material coated, and downwardly-and-inwardly-tapering recoil shoulders of the generally rectangular-parallelepiped-shaped body of the upper receiver assembly prevents the glass bedding material from sticking thereto, so that the upper receiver assembly can be readily removed from the appropriately modified stock of the single shot rifle during take down thereof.

YET STILL ANOTHER OBJECT of the present invention is to provide a single shot falling breech block action wherein the lower receiver assembly includes a generally rectangular-shaped lower receiver that has a rounded front, and a rounded rear that is disposed behind the rounded front of the generally rectangular-shaped lower receiver of the receiver assembly.

STILL YET ANOTHER OBJECT of the present invention is to provide a single shot falling breech block action wherein the generally rectangular-shaped lower receiver of the receiver assembly further has a horizontal top, and a horizontal bottom that is disposed below the horizontal top of the generally rectangular-shaped lower receiver of the receiver assembly.

YET STILL ANOTHER OBJECT of the present invention is to provide a single shot falling breech block action wherein the generally rectangular-shaped lower receiver of the receiver assembly further has a pair of opposing longitudinal sides that extend from the rounded front of the generally rectangular-shaped lower receiver of the receiver assembly to the rounded rear of the generally rectangular-shaped lower receiver of the receiver assembly.

STILL YET ANOTHER OBJECT of the present invention is to provide a single shot falling breech block action wherein the generally rectangular-shaped lower receiver of the lower receiver assembly further has a pair of parallel and opposing vertical walls that extend perpendicularly upwardly along the pair of longitudinal sides of the generally rectangular-shaped lower receiver of the lower receiver assembly from the rounded front of the generally rectangular-shaped lower receiver of the lower receiver assembly to the rounded rear of the generally rectangular-shaped lower receiver of the lower receiver assembly.

YET STILL ANOTHER OBJECT of the present invention is to provide a single shot falling breech block action wherein the horizontal top of the generally rectangular-shaped lower receiver of the lower receiver assembly has a pair of mounting counterbore seats that are concentric with the pair of spaced-apart, longitudinally-oriented, and non-threaded mounting throughbores in the lower receiver assembly and assist in seating the pair of action mounting cylindrically-shaped and vertical spacers.

STILL YET ANOTHER OBJECT of the present invention is to provide a single shot falling breech block action wherein the horizontal top of the generally rectangular-shaped lower receiver of the lower receiver assembly further has a low area that is lower than the horizontal top of the generally rectangular-shaped lower receiver of the lower receiver assembly and which extends from slightly forward of a rearmost throughbore of the pair of spaced-apart, longitudinally-oriented, and non-threaded mounting throughbores in the lower receiver assembly to between a forwardmost detent of the pair of spaced-apart and longitudinally-oriented take down screw plunger detents in the horizontal bottom of the generally rectangular-parallelepiped-shaped body of the upper receiver assembly and a forwardmost throughbore of the pair of spaced-apart, longitudinally-oriented, and non-threaded mounting throughbores in the lower receiver assembly.

YET STILL ANOTHER OBJECT of the present invention is to provide a single shot falling breech block action wherein the low area in the horizontal top of the generally rectangular-shaped lower receiver of the receiver assembly has a breech block throughraceway that extends therethrough from the low area in the horizontal top of the generally rectangular-shaped lower receiver of the lower receiver assembly to the horizontal bottom of the generally rectangular-shaped lower receiver of the lower receiver assembly, and which is in vertical alignment with the breech block throughraceway in the generally rectangular-parallelepiped-shaped body of the upper receiver assembly, and which forms a smooth continuous breech block chamber therewith through which the breech block assembly is replaceably and vertically slidably mounted.

STILL YET ANOTHER OBJECT of the present invention is to provide a single shot falling breech block action wherein the low area in the horizontal top of the generally rectangular-shaped lower receiver of the receiver assembly further has a pinion guide throughslot that extends therethrough from the lower low area in the horizontal top of the generally rectangular-shaped lower receiver of the lower receiver assembly to the horizontal bottom of the generally rectangular-shaped lower receiver of the lower receiver assembly, and which extends longitudinally from slightly forward of the throughraceway in the low area in the horizontal top of the generally rectangular-shaped lower receiver of the lower receiver assembly to slightly forward of the forwardmost detent of the pair of spaced-apart and longitudinally-oriented take down screw plunger detents in the horizontal bottom of the generally rectangular-parallelepiped-shaped body of the upper receiver assembly.

YET STILL ANOTHER OBJECT of the present invention is to provide a single shot falling breech block action wherein the low area in the horizontal top of the generally rectangular-shaped lower receiver of the lower receiver assembly further has an extractor throughslot that extends therethrough from the low area in the horizontal top in the generally rectangular-shaped lower receiver of the lower receiver assembly to the horizontal bottom of the generally rectangular-shaped lower receiver of the lower receiver assembly, and to one side of, and in proximity to, a rearmost border of the pinion guide throughslot in the low area in the horizontal top of the generally rectangular-shaped lower receiver of the lower receiver assembly.

STILL YET ANOTHER OBJECT of the present invention is to provide a single shot falling breech block action wherein each wall of the pair of parallel and opposing vertical walls of the generally rectangular-shaped lower receiver of the lower receiver assembly has an inner surface with a horizontal action plate raceway slot that extends continuously longitudinally therealong, at a top thereof, and slightly above the horizontal top of the generally rectangular-shaped lower receiver of the lower receiver assembly.

YET STILL ANOTHER OBJECT of the present invention is to provide a single shot falling breech block action wherein the inner surface of the pair of parallel and opposing vertical walls of the generally rectangular-shaped lower receiver of the lower receiver assembly, that is opposite to that in which the extractor throughslot in the low area in the horizontal top of the generally rectangular-shaped lower receiver of the lower receiver assembly is most closest, further has a horizontal movable rack raceway slot that extends continuously longitudinally therealong below, and parallel to, the horizontal action plate raceway slot in the appropriate wall of the pair of parallel and opposing vertical walls of the generally rectangular-shaped lower receiver of the lower receiver assembly, and in which the movable rack is replaceably and forwardly and rearwardly slidably mounted, so that during take down the movable rack of the lower receiver can be slid out of the horizontal movable rack raceway slot in the inner surface of the appropriate wall of the pair of parallel and opposing vertical walls of the generally rectangular-shaped lower receiver of the lower receiver assembly to be readily serviced, if necessary.

STILL YET ANOTHER OBJECT of the present invention is to provide a single shot falling breech block action wherein the inner surface of the pair of parallel and opposing vertical walls of the generally rectangular-shaped lower receiver of the lower receiver assembly, in which the extractor throughslot in the low area in the horizontal top of the generally rectangular-shaped lower receiver of the lower receiver assembly is most closest, further has a horizontal stationary rack raceway slot that extends continuously longitudinally therealong below, and parallel to, the horizontal action plate raceway slot in the appropriate wall of the pair of parallel and opposing vertical walls of the generally rectangular-shaped lower receiver of the lower receiver assembly, and into which the stationary rack is replaceably and fixedly attached.

YET STILL ANOTHER OBJECT of the present invention is to provide a single shot falling breech block action wherein the horizontal stationary rack raceway slot in the inner surface of the appropriate wall of the pair of parallel and opposing vertical walls of the generally rectangular-shaped lower receiver of the lower receiver assembly, opposes, and is in horizontal alignment with, the horizontal movable rack raceway slot in the inner surface of the appropriate wall of the pair of parallel and opposing vertical walls of the generally rectangular-shaped lower receiver of the lower receiver assembly.

STILL YET ANOTHER OBJECT of the present invention is to provide a single shot falling breech block action wherein the horizontal stationary rack raceway slot in the inner surface of the appropriate wall of the pair of parallel and opposing vertical walls of the generally rectangular-shaped lower receiver of the lower receiver assembly has a pair of spaced-apart stationary rack mounting throughbores that extend laterally therethrough.

YET STILL ANOTHER OBJECT of the present invention is to provide a single shot falling breech block action wherein a forwardmost throughbore of the pair of spaced-apart stationary rack mounting throughbores in the horizontal stationary rack raceway slot in the inner surface of the appropriate wall of the pair of parallel and opposing vertical walls of the generally rectangular-shaped lower receiver of the lower receiver assembly is disposed in the low area in the horizontal top of the generally rectangular-shaped lower receiver of the lower receiver assembly slightly rearward of a forwardmost border thereof while a rearmost throughbore of the pair of spaced-apart stationary rack mounting throughbores is also disposed in the low area in the horizontal top of the generally rectangular-shaped lower receiver of the lower receiver assembly, in proximity to the extractor throughslot in the low area in the receiver horizontal top of the generally rectangular-shaped lower receiver of the lower receiver assembly.

STILL YET ANOTHER OBJECT of the present invention is to provide a single shot falling breech block action wherein the stationary rack has a pair of stationary rack mounting throughbores that are disposed laterally at ends thereof.

YET STILL ANOTHER OBJECT of the present invention is to provide a single shot falling breech block action wherein the stationary rack of the lower receiver is replaceably engaged against movement in the horizontal stationary rack raceway slot in the inner surface of the appropriate wall of the pair of parallel and opposing vertical walls of the generally rectangular-shaped lower receiver of the lower receiver assembly, by a pair of replaceable stationary rack mounting studs that extend through the pair of spaced-apart stationary rack mounting throughbores in the horizontal stationary rack raceway slot in the inner surface of the appropriate wall of the pair of parallel and opposing vertical walls of the generally rectangular-shaped lower receiver of the lower receiver assembly, and which extend into the pair of stationary rack mounting throughbores in the ends of the stationary rack of the lower receiver assembly, so that during take down the pair of replaceable stationary rack mounting studs of the lower receiver assembly can be removed and the stationary rack of the lower receiver assembly can be slid out of the horizontal stationary rack raceway slot in the inner surface of the appropriate wall of the pair of parallel and opposing vertical walls of the generally rectangular-shaped lower receiver of the lower receiver assembly to be readily serviced, if necessary.

STILL YET ANOTHER OBJECT of the present invention is to provide a single shot falling breech block action wherein the lower receiver assembly further includes a generally rectangular-parallelepiped-shaped extractor that has a lower end with a laterally-oriented throughbore that extends laterally therethrough, an upper end that is disposed above the lower end of the generally rectangular-parallelepiped-shaped extractor of the lower receiver assembly, a front that faces forwardly and extends from the lower end of the generally rectangular-parallelepiped-shaped extractor of the lower receiver assembly to the upper end of the generally rectangular-parallelepiped-shaped extractor of the lower receiver assembly, and an extractor slot that opens into both the upper end of the generally rectangular-parallelepiped-shaped extractor of the lower receiver assembly and the front of the generally rectangular-parallelepiped-shaped extractor of the lower receiver assembly so as to form a seat to engage and extract a spent cartridge.

YET STILL ANOTHER OBJECT of the present invention is to provide a single shot falling breech block action wherein the lower end of the generally rectangular-parallelepiped-shaped extractor of the lower receiver assembly sits forwardly and rearwardly pivotally in the extractor throughslot in the low area in the horizontal top of the generally rectangular-shaped lower receiver of the lower receiver assembly and is forwardly and rearwardly pivotally mounted to the stationary rack by a rearmost stud of the pair of replaceably stationary rack mounting studs of the lower receiver assembly which also replaceably enters the laterally-oriented throughbore in the lower end of the generally rectangular-parallelepiped-shaped extractor of the lower receiver assembly.

STILL YET ANOTHER OBJECT of the present invention is to provide a single shot falling breech block action wherein the movable rack has a laterally-and-inwardly-facing and cylindrically-shaped stud that faces laterally perpendicularly inwardly from a rearmost end of the movable rack of the lower receiver assembly, towards the stationary rack of the lower receiver.

YET STILL ANOTHER OBJECT of the present invention is to provide a single shot falling breech block action wherein the pinion is horizontal and has a vertical guide shaft that extends perpendicularly downwardly from a center thereof and which has a lower end with a laterally-oriented and threaded throughbore that extends laterally therethrough.

STILL YET ANOTHER OBJECT of the present invention is to provide a single shot falling breech block action wherein the horizontal pinion of the lower receiver assembly further has a centrally and longitudinally disposed threaded throughbore that extends centrally and longitudinally therethrough and centrally and longitudinally into the vertical guide shaft of the horizontal pinion of the lower receiver assembly.

YET STILL ANOTHER OBJECT of the present invention is to provide a single shot falling breech block action wherein the vertical guide shaft of the horizontal pinion of the lower receiver assembly extends freely downwardly through the pinion guide throughslot in the low area in the horizontal top of the generally rectangular-shaped lower receiver of the lower receiver assembly and is freely rotatable therein while being freely movable forwardly and rearwardly therealong, and with the laterally-oriented and threaded throughbore in the lower end of the vertical guide shaft of the horizontal pinion of the lower receiver assembly positioned therebelow.

STILL YET ANOTHER OBJECT of the present invention is to provide a single shot falling breech block action wherein the pinion rotating apparatus includes a slender and cylindrically-shaped finger lever that has a threaded proximal end that threadably engages the laterally-oriented and threaded throughbore in the lower end of the vertical guide shaft of the horizontal pinion, and a spherical-shaped free distal end that is spherically shaped to prevent possible injury to a user's hand.

YET STILL ANOTHER OBJECT of the present invention is to provide a single shot falling breech block action wherein the finger lever of the pinion rotating apparatus is rotatable, both clockwise and counterclockwise, in a generally horizontal plane that is substantially parallel to the horizontal bottom of the generally rectangular-shaped lower receiver of the lower receiver assembly.

STILL YET ANOTHER OBJECT of the present invention is to provide a single shot falling breech block action wherein the action plate is generally rectangular-shaped and has a horizontal top, a horizontal bottom that is disposed below the horizontal top of the generally rectangular-shaped action plate of the lower receiver assembly, a pair of parallel sides, a rear, and a front that is disposed forward of, and parallel to, the rear of the generally rectangular-shaped action plate of the lower receiver assembly.

YET STILL ANOTHER OBJECT of the present invention is to provide a single shot falling breech block action wherein the generally rectangular-shaped action plate of the lower receiver assembly further has a generally centrally disposed and non-threaded action plate mounting throughbore that extends vertically therethrough from the horizontal top of the generally rectangular-shaped action plate of the lower receiver assembly to the horizontal bottom of the generally rectangular-shaped action plate of the lower receiver assembly, in proximity to the rear of the generally rectangular-shaped action plate of the lower receiver assembly, and which is in vertical alignment with the centrally and longitudinally disposed threaded throughbore in the horizontal pinion of the lower receiver assembly.

STILL YET ANOTHER OBJECT of the present invention is to provide a single shot falling breech block action the horizontal top of the generally rectangular-shaped action plate of the lower receiver assembly has a generally centrally disposed and non-threaded action plate mounting counter-bore that is concentric with the generally centrally disposed and non-threaded action plate mounting throughbore in the generally rectangular-shaped action plate of the lower receiver assembly.

YET STILL ANOTHER OBJECT of the present invention is to provide a single shot falling breech block action wherein the generally rectangular-shaped action plate of the lower receiver assembly further has a threaded action plate take down throughbore that extends therethrough from the horizontal top of the generally rectangular-shaped action plate of the lower receiver assembly to the horizontal bottom of the generally rectangular-shaped action plate of the lower receiver assembly, and which is between the front of the generally rectangular-shaped action plate of the lower receiver assembly and the generally centrally disposed and the non-threaded action plate mounting throughbore in the generally rectangular-shaped action plate of the lower receiver assembly.

STILL YET ANOTHER OBJECT of the present invention is to provide a single shot falling breech block action wherein the rear of the generally rectangular-shaped action plate of the lower receiver assembly has a generally rectangular-shaped cocking boss extension that extends rearwardly from a substantial center thereof, and which is co-planar with the generally rectangular-shaped action plate of the lower receiver assembly, and which terminates in a cocking boss.

YET STILL ANOTHER OBJECT of the present invention is to provide a single shot falling breech block action wherein the generally rectangular-shaped cocking boss extension of the rear of the generally rectangular-shaped action plate of the lower receiver assembly has a width less than that of the rear of the generally rectangular-shaped action plate of the lower receiver assembly so as to form an extractor boss on one side thereof.

STILL YET ANOTHER OBJECT of the present invention is to provide a single shot falling breech block action wherein the pair of parallel sides of the generally rectangular-shaped action plate of the lower receiver assembly are forwardly and rearwardly slidable, and replaceably positioned, in the horizontal action plate raceway slot in the inner surface of the pair of parallel and opposing vertical walls of the generally rectangular-shaped lower receiver of the lower receiver assembly, with the extractor boss of the rear of the generally rectangular-shaped action plate of the lower receiver assembly facing rearwardly and being abutable against the front of the generally rectangular-parallelepiped-shaped extractor of the lower receiver assembly, so that the action plate is forwardly and rearwardly slidably mounted in the lower receiver assembly and the generally rectangular-parallelepiped-shaped extractor of the lower receiver assembly can be pivoted rearwardly.

YET STILL ANOTHER OBJECT of the present invention is to provide a single shot falling breech block action wherein the generally rectangular-shaped action plate of the lower receiver assembly is replaceably attached to the horizontal pinion of the lower receiver assembly by an action plate mounting screw that extends freely vertically through the generally centrally disposed and non-threaded action plate mounting throughbore in the generally rectangular-shaped action plate of the lower receiver assembly, and which threadably engages the centrally and longitudinally disposed threaded throughbore in the horizontal pinion of the lower receiver assembly, with a head thereof sitting unobstructingly in the generally centrally disposed and non-threaded action plate mounting counterbore in the horizontal top of the generally rectangular-shaped action plate of the lower receiver assembly, and with the horizontal pinion of the lower receiver assembly being free to rotate both clockwise and counterclockwise relative to the generally rectangular-shaped action plate of the lower receiver assembly.

STILL YET ANOTHER OBJECT of the present invention is to provide a single shot falling breech block action wherein the lower receiver assembly further includes a take down screw sub-assembly that includes a screw that has a hollow and externally-threaded shaft and a head, a plunger that is slidably positioned in, and slidably extendable from, the hollow and externally-threaded shaft of the screw of the take down screw sub-assembly of the lower receiver assembly, and which is biased by a spring that is also contained in the hollow and externally-threaded shaft of the screw of the take down screw sub-assembly of the lower receiver assembly.

YET STILL ANOTHER OBJECT of the present invention is to provide a single shot falling breech block action wherein the head of the screw of the take down screw sub-assembly of the lower receiver assembly is positioned unobstructingly in the pinion guide throughslot in the low area in the horizontal top of the generally rectangular-shaped lower receiver of the lower receiver assembly, and which is freely movable forwardly and rearwardly therealong, with the hollow and externally-threaded shaft of the screw of the take down screw sub-assembly of the lower receiver assembly vertically threadably engaging the threaded action plate take down throughbore in the generally rectangular-shaped action plate of the lower receiver assembly and thereby being forwardly and rearwardly movable therewith, and with the plunger of the take down screw sub-assembly of the lower receiver assembly being replaceably engagable with one detent of the pair of spaced-apart and longitudinally oriented take down screw plunger detents in the horizontal bottom of the generally rectangular-parallelepiped-shaped body of the upper receiver assembly, by virtue of the biasing of the spring of the take down screw sub-assembly of the lower receiver assembly.

STILL YET ANOTHER OBJECT of the present invention is to provide a single shot falling breech block action wherein the breech block assembly includes a hollow and generally rectangular-parallelepiped-shaped breech block that has a horizontal and concave-shaped top, an open bottom that is disposed below the horizontal and concave-shaped top of the hollow and generally rectangular-parallelepiped-shaped breech block of the breech block assembly, a vertical and closed back, a vertical and substantially open front that is disposed forward of the vertical and closed back of the generally rectangular-parallelepiped-shaped breech block of the breech block assembly, and a pair of parallel, vertical, and opposing sides.

YET STILL ANOTHER OBJECT of the present invention is to provide a single shot falling breech block action wherein the hollow and generally rectangular-parallelepiped-shaped breech block of the breech block assembly contains a generally rectangular-parallelepiped-shaped internal trigger assembly chamber that opens into both the open bottom of the hollow and generally rectangular-parallelepiped-shaped breech block of the breech block assembly and the vertical and substantially open front of the generally rectangular-parallelepiped-shaped breech block of the breech block assembly.

STILL YET ANOTHER OBJECT of the present invention is to provide a single shot falling breech block action wherein the vertical and substantially open front of the hollow and generally rectangular-parallelepiped-shaped breech block of the breech block assembly has a firing pin tip throughbore that extends horizontally therethrough, and which is disposed between a lowest point of the horizontal and concave-shaped top of the hollow and generally rectangular-parallelepiped-shaped breech block of the breech block assembly and a top border of an opening in the vertical and substantially open front of the hollow and generally rectangular-parallelepiped-shaped breech block of the breech block assembly.

YET STILL ANOTHER OBJECT of the present invention is to provide a single shot falling breech block action wherein the vertical and closed back of the hollow and generally rectangular-parallelepiped-shaped breech block of the breech block assembly has an inner surface with a firing pin spring seat bore that is in horizontal alignment with the firing pin tip throughbore in the vertical and substantially open front of the hollow and generally rectangular-parallelepiped-shaped breech block of the breech block assembly.

STILL YET ANOTHER OBJECT of the present invention is to provide a single shot falling breech block action wherein each side of the pair of parallel, vertical, and opposing sides of the hollow and generally rectangular-parallelepiped-shaped breech block of the breech block assembly has an inner surface with a trigger safety raceway extending continuously and horizontally therealong.

YET STILL ANOTHER OBJECT of the present invention is to provide a single shot falling breech block action wherein the trigger safety raceway of the inner surface of each side of the pair of parallel, vertical, and opposing sides of the hollow and generally rectangular-parallelepiped-shaped breech block of the breech block assembly are parallel to each other, and open into, and extend continuously horizontally from, the vertical and substantially open front of the hollow and generally rectangular-parallelepiped-shaped breech block of the breech block assembly to the vertical and closed back of the hollow and generally rectangular-parallelepiped-shaped breech block of the breech block assembly, in an orientation that is parallel to, and slightly above, the open bottom of the hollow and generally rectangular-parallelepiped-shaped breech block of the breech block assembly.

STILL YET ANOTHER OBJECT of the present invention is to provide a single shot falling breech block action wherein the inner surface of one side of the pair of parallel, vertical, and opposing sides of the hollow and generally rectangular-parallelepiped-shaped breech block of the breech block assembly has a pair of spaced-apart trigger safety plunger detents that are spaced horizontally therealong, between the open bottom of the hollow and generally rectangular-parallelepiped-shaped breech block of the breech block assembly and the trigger safety raceway in the inner surface of the one side of the pair of parallel, vertical, and opposing sides of the hollow and generally rectangular-parallelepiped-shaped breech block of the breech block assembly, in proximity to the vertical and substantially open front of the hollow and generally rectangular-parallelepiped-shaped breech block of the breech block assembly.

YET STILL ANOTHER OBJECT of the present invention is to provide a single shot falling breech block action wherein another side of the pair of parallel, vertical, and opposing sides of the hollow and generally rectangular-parallelepiped-shaped breech block of the breech block assembly that is opposite to the one side that has the pair of spaced-apart trigger safety plunger detents of the inner surface of the one side of the pair of parallel, vertical, and opposing sides of the hollow and generally rectangular-parallelepiped-shaped breech block of the breech block assembly disposed therein, has an outer surface with a movable rack stud slot that opens into both, and extends continuously between, the vertical and substantially open front of the hollow and generally rectangular-parallelepiped-shaped breech block of the breech block assembly and the vertical and closed back of the hollow and generally rectangular-parallelepiped-shaped breech block of the breech block assembly.

STILL YET ANOTHER OBJECT of the present invention is to provide a single shot falling breech block action wherein the movable rack stud slot in the outer surface of the another side of the pair of parallel, vertical, and opposing sides of the hollow and generally rectangular-parallelepiped-shaped breech block of the breech block assembly has a horizontal front slot portion, that is wider than, and in horizontal alignment with, the trigger safety raceway in the inner surface of the another side of the pair of parallel, vertical, and opposing sides of the hollow and generally rectangular-parallelepiped-shaped breech block of the breech block assembly, and which opens into, and extends continuously horizontally rearwardly from, the vertical and substantially open front of the hollow and generally rectangular-parallelepiped-shaped breech block of the breech block assembly.

YET STILL ANOTHER OBJECT of the present invention is to provide a single shot falling breech block action wherein the movable rack stud slot in the outer surface of the another side of the pair of parallel, vertical, and opposing sides of the hollow and generally rectangular-parallelepiped-shaped breech block of the breech block assembly further has an inclined intermediate slot portion that opens into, and extends continuously rearwardly and upwardly in a straight line from, a rear end of the horizontal front slot portion of the movable rack stud slot in the outer surface of the another side of the pair of parallel, vertical, and opposing sides of the hollow and generally rectangular-parallelepiped-shaped breech block of the breech block assembly.

STILL YET ANOTHER OBJECT of the present invention is to provide a single shot falling breech block action wherein the movable rack stud slot in the outer surface of the another side of the pair of parallel, vertical, and opposing sides of the hollow and generally rectangular-parallelepiped-shaped breech block of the breech block assembly further has a horizontal rear slot portion that opens into, and extends continuously rearwardly from, an upper end of the inclined intermediate slot portion of the movable rack stud slot in the outer surface of the another side of the pair of parallel, vertical, and opposing sides of the hollow and generally rectangular-parallelepiped-shaped breech block of the breech block assembly, and which opens into the vertical and closed back of the hollow and generally rectangular-parallelepiped-shaped breech block of the breech block assembly.

YET STILL ANOTHER OBJECT of the present invention is to provide a single shot falling breech block action wherein the horizontal rear slot portion of the movable rack stud slot in the outer surface of the another side of the pair of parallel, vertical, and opposing sides of the hollow and generally rectangular-parallelepiped-shaped breech block of the breech block assembly is disposed above, parallel to, behind, and longer than, the horizontal front slot portion of the movable rack stud slot in the outer surface of the another side of the pair of parallel, vertical, and opposing sides of the hollow and generally rectangular-parallelepiped-shaped breech block of the breech block assembly.

STILL YET ANOTHER OBJECT of the present invention is to provide a single shot falling breech block action wherein the hollow and generally rectangular-parallelepiped-shaped breech block of the breech block assembly further has a pair of trigger assembly mounting throughbores that extend horizontally through both sides of the pair of parallel, vertical, and opposing sides of the hollow and generally rectangular-parallelepiped-shaped breech block of the breech block assembly, and which straddle the horizontal rear slot portion of the movable rack stud slot in the outer surface of the another side of the pair of parallel, vertical, and opposing sides of the hollow and generally rectangular-parallelepiped-shaped breech block of the breech block assembly.

YET STILL ANOTHER OBJECT of the present invention is to provide a single shot falling breech block action wherein the breech block assembly further includes a firing pin that has a generally rectangular-parallelepiped-shaped main portion with a breech slightly convex-shaped and vertical front, a slightly convex-shaped and vertical rear that is disposed behind the slightly convex-shaped and vertical front of the generally rectangular-parallelepiped-shaped main portion of the firing pin of the breech block assembly and which has an outer surface with a generally centrally-disposed firing pin seat bore, a horizontal bottom, and a pair of vertical and opposing sides that extend from the slightly convex-shaped and vertical front of the generally rectangular-parallelepiped-shaped main portion of the firing pin of the breech block assembly to the slightly convex-shaped and vertical rear of the generally rectangular-parallelepiped-shaped main portion of the firing pin of the breech block assembly.

STILL YET ANOTHER OBJECT of the present invention is to provide a single shot falling breech block action wherein the generally rectangular-parallelepiped-shaped main portion of the firing pin of the breech block assembly further has a width that is slightly less than that of the generally rectangular-parallelepiped-shaped internal trigger assembly chamber in the hollow and generally rectangular-parallelepiped-shaped breech block of the breech block assembly so as to be readily forwardly and rearwardly slidable therein.

YET STILL ANOTHER OBJECT of the present invention is to provide a single shot falling breech block action wherein the firing pin of the breech block assembly further has a generally convexo-concave and vertical cocking portion that extends vertically downwardly from the horizontal bottom of the generally rectangular-parallelepiped-shaped main portion of the firing pin of the breech block assembly, and which has a front convex cocking surface that is in vertical alignment with the slightly convex-shaped and vertical front of the generally rectangular-parallelepiped-shaped main portion of the firing pin of the breech block assembly.

STILL YET ANOTHER OBJECT of the present invention is to provide a single shot falling breech block action wherein the firing pin of the breech block assembly further has a firing pin tip that extends horizontally outwardly from the slightly convex-shaped and vertical front of the generally rectangular-parallelepiped-shaped main portion of the firing pin of the breech block assembly, and which is in horizontal alignment with the generally centrally-disposed firing pin seat bore in the outer surface of the slightly convex-shaped and vertical rear of the generally rectangular-parallelepiped-shaped main portion of the firing pin of the breech block assembly.

YET STILL ANOTHER OBJECT of the present invention is to provide a single shot falling breech block action wherein the horizontal bottom of the generally rectangular-parallelepiped-shaped main portion of the firing pin of the breech block assembly has an inwardly-and-upwardly-tapering sear recess that extends horizontally rearwardly from a rear concave surface of the generally convexo-concave and vertical cocking portion of the firing pin of the breech block assembly to a substantial midpoint of the horizontal bottom of the generally rectangular-parallelepiped-shaped main portion of the firing pin of the breech block assembly, and which opens into both, and extends continuously horizontally between, the pair of vertical and opposing sides of the generally rectangular-parallelepiped-shaped main portion of the firing pin of the breech block assembly.

STILL YET ANOTHER OBJECT of the present invention is to provide a single shot falling breech block action wherein the firing pin of the breech block assembly further has a firing pin spring with a front end that sits horizontally in the generally centrally-disposed firing pin seat bore in the outer surface of the slightly convex-shaped and vertical rear of the generally rectangular-parallelepiped-shaped main portion of the firing pin of the breech block assembly, and a rear end.

YET STILL ANOTHER OBJECT of the present invention is to provide a single shot falling breech block action wherein the firing pin of the breech block assembly is forwardly and rearwardly slidably positioned in the generally rectangular-parallelepiped-shaped internal trigger assembly chamber in the hollow and generally rectangular-parallelepiped-shaped breech block of the breech block assembly, with the firing pin tip of the firing pin of the breech block assembly in horizontal alignment with the firing pin tip throughbore in the vertical and substantially open front of the hollow and generally rectangular-parallelepiped-shaped breech block of the breech block assembly, and with the rear end of the firing pin spring of the firing pin of the breech block assembly sitting in the firing pin spring seat bore in the inner surface of the vertical and closed back of the generally rectangular-parallelepiped-shaped breech block of the breech block assembly, so that the firing pin of the breech block assembly is biased by virtue of the firing pin spring of the firing pin of the breech block assembly and the firing pin tip of the firing pin of the breech block assembly can extend through the firing pin tip throughbore in the vertical and substantially open front of the hollow and generally rectangular-parallelepiped-shaped breech block of the breech block assembly.

STILL YET ANOTHER OBJECT of the present invention is to provide a single shot falling breech block action wherein the hollow and generally rectangular-parallelepiped-shaped breech block of the breech block assembly is vertically slidably positioned in the breech block throughraceway in the low area in the horizontal top of the generally rectangular-shaped lower receiver of the lower receiver assembly and in the breech block throughraceway in the generally rectangular-parallelepiped-shaped body of the upper receiver assembly, with the laterally-and-inwardly-oriented and cylindrically-shaped stud of the horizontal movable rack of the lower receiver being replaceably slidably engagable in the movable rack stud slot in the outer surface of the another side of the pair of parallel, vertical, and opposing sides of the hollow and generally rectangular-parallelepiped-shaped breech block of the breech block assembly.

YET STILL ANOTHER OBJECT of the present invention is to provide a single shot falling breech block action wherein the trigger assembly includes a generally rectangular-parallelepiped-shaped trigger housing that has a horizontal top, an open bottom that is disposed below the horizontal top of the generally rectangular-parallelepiped-shaped trigger housing of the trigger assembly, a vertical closed rear, and a vertical front that is disposed forward of the vertical closed rear of the generally rectangular-parallelepiped-shaped trigger housing of the trigger assembly.

STILL YET ANOTHER OBJECT of the present invention is to provide a single shot falling breech block action wherein the generally rectangular-parallelepiped-shaped trigger housing of the trigger assembly further has a pair of opposing, parallel, and vertical sides that extend from the open bottom of the generally rectangular-parallelepiped-shaped trigger housing of the trigger assembly past the horizontal top of the generally rectangular-parallelepiped-shaped trigger housing of the trigger assembly so as to form therewith a pair of horizontal firing pin guide lips.

YET STILL ANOTHER OBJECT of the present invention is to provide a single shot falling breech block action wherein the pair of horizontal firing pin guide lips of the horizontal top of the generally rectangular-parallelepiped-shaped trigger housing of the trigger assembly extend horizontally from the vertical front of the generally rectangular-parallelepiped-shaped trigger housing of the trigger assembly to the vertical closed rear of the generally rectangular-parallelepiped-shaped trigger housing of the trigger assembly.

STILL YET ANOTHER OBJECT of the present invention is to provide a single shot falling breech block action, wherein the generally rectangular-parallelepiped-shaped trigger housing of the trigger assembly further has a substantially T-shaped sear throughraceway that extends vertically continuously between, and open into both, the horizontal top of the generally rectangular-parallelepiped-shaped trigger housing of the trigger assembly and the open bottom of the generally rectangular-parallelepiped-shaped trigger housing of the trigger assembly, and which also opens into the vertical front of the generally rectangular-parallelepiped-shaped trigger housing of the trigger assembly.

YET STILL ANOTHER OBJECT of the present invention is to provide a single shot falling breech block action wherein each side of the pair of opposing, parallel, and vertical sides of the generally rectangular-parallelepiped-shaped trigger housing of the trigger assembly has a rectangular-shaped and horizontal sear spring brace through-slot that are in horizontal alignment with each other, and which open into both the vertical front of the generally rectangular-parallelepiped-shaped trigger housing of the trigger assembly and the substantially T-shaped sear throughraceway of the generally rectangular-parallelepiped-shaped trigger housing of the trigger assembly.

STILL YET ANOTHER OBJECT of the present invention is to provide a single shot falling breech block action wherein each side of the pair of opposing, parallel, and vertical sides of the generally rectangular-parallelepiped-shaped trigger housing of the trigger assembly further has a pair of trigger housing mounting throughbores that are in horizontal alignment with each other and with the pair of trigger assembly mounting throughbores in the hollow and generally rectangular-parallelepiped-shaped breech block of the breech block assembly.

YET STILL ANOTHER OBJECT of the present invention is to provide a single shot falling breech block action wherein the trigger assembly further includes a sear that has a substantially T-shaped lateral cross section which is similar to that of the substantially T-shaped sear throughraceway in the generally rectangular-parallelepiped-shaped trigger housing of the trigger assembly so as to be vertically slidable therein.

STILL YET ANOTHER OBJECT of the present invention is to provide a single shot falling breech block action wherein the sear of the trigger assembly has a horizontal top, a horizontal bottom that is disposed below the horizontal top of the sear of the trigger assembly, a vertical front, a pair of opposing, parallel, and vertical sides that extend vertically from the top of the sear of the trigger assembly to the horizontal bottom of the sear of the trigger assembly, and a vertical rear that is disposed behind the vertical front of the sear of the trigger assembly.

YET STILL ANOTHER OBJECT of the present invention is to provide a single shot falling breech block action wherein the horizontal top of the sear of the trigger assembly has an inwardly-and-upwardly-tapering projection that extends horizontally rearwardly from the vertical front of the sear of the trigger assembly to a substantial midpoint of the horizontal top of the sear of the trigger assembly, and which extends sidewardly between the pair of opposing, parallel, and vertical sides of the sear of the trigger assembly, and which is similar to the inwardly-and-upwardly-tapering sear recess of the horizontal bottom of the generally rectangular-parallelepiped-shaped main portion of the firing pin of the breech block assembly so as to be replaceably engagable therein.

STILL YET ANOTHER OBJECT of the present invention is to provide a single shot falling breech block action wherein the horizontal bottom of the sear of the trigger assembly has a rectangular-parallelepiped-shaped sear spring recess that extends perpendicularly upwardly therefrom, and which opens into the pair of opposing, parallel, and vertical sides of the sear of the trigger assembly, and which is disposed between, and parallel to, the vertical front of the sear of the trigger assembly and the vertical rear of the trigger assembly sear of the trigger assembly.

YET STILL ANOTHER OBJECT of the present invention is to provide a single shot falling breech block action wherein the sear of the trigger assembly further has a sear spring that is disposed vertically in the rectangular-parallelepiped-shaped sear spring recess in the horizontal bottom of the sear of the trigger assembly, and which has an upper end that sits in a recess in an upper horizontal border of the rectangular-parallelepiped-shaped sear spring recess in the horizontal bottom of the sear of the trigger assembly.

STILL YET ANOTHER OBJECT of the present invention is to provide a single shot falling breech block action wherein the sear of the trigger assembly further has a sear spring horizontal brace that has a recess therein in which a lower end of the sear spring of the sear of the trigger assembly sits.

YET STILL ANOTHER OBJECT of the present invention is to provide a single shot falling breech block action wherein the sear of the trigger assembly is vertically slidably positioned in the substantially T-shaped sear throughraceway in the generally rectangular-parallelepiped-shaped trigger housing of the trigger assembly, with the sear spring horizontal brace of the sear of the trigger assembly replaceably engaged in the rectangular-shaped and horizontal sear spring brace throughslot in each of the pair of opposing, parallel, and vertical sides of the generally rectangular-parallelepiped-shaped trigger housing of the trigger assembly, and with the sear of the trigger assembly being biased therein by virtue of the sear spring of the sear of the trigger assembly.

STILL YET ANOTHER OBJECT of the present invention is to provide a single shot falling breech block action wherein the trigger assembly further includes a generally concavo-convex-shaped vertical trigger that has a horizontal top, a vertical front, a vertical rear that is disposed behind the vertical front of the generally concavo-convex-shaped vertical trigger of the trigger assembly, a pair of opposing vertical sides, and a rectangular-parallelepiped-shaped block that extends vertically. upwardly from the horizontal top of the generally concavo-convex-shaped vertical trigger of the trigger assembly, horizontally rearwardly from the vertical front of the generally concavo-convex-shaped vertical trigger of the trigger assembly to a substantial midpoint of the horizontal top of the generally concavo-convex-shaped vertical trigger of the trigger assembly, and sidewardly from one side of the pair of opposing vertical sides of the generally concavo-convex-shaped vertical trigger of the trigger assembly to another side of the pair of opposing vertical sides of the generally concavo-convex-shaped vertical trigger of the trigger assembly.

YET STILL ANOTHER OBJECT of the present invention is to provide a single shot falling breech block action wherein the rectangular-parallelepiped-shaped block of the generally concavo-convex-shaped vertical trigger of the trigger assembly has a vertical rear, a horizontal top, and a pair of opposing vertical sides.

STILL YET ANOTHER OBJECT of the present invention is to provide a single shot falling breech block action wherein the horizontal top of the rectangular-parallelepiped-shaped block of the generally concavo-convex-shaped vertical trigger of the trigger assembly has a horizontal trigger safety recess that extends sidewardly between, and opens into, the pair of opposing vertical sides of the rectangular-parallelepiped-shaped block of the generally concavo-convex-shaped vertical trigger of the trigger assembly, while also opening into the vertical rear of the horizontal top of the rectangular-parallelepiped-shaped block of the generally concavo-convex-shaped vertical trigger of the trigger assembly, and which is releaseably engagable with the horizontal bottom of the sear of the trigger assembly.

YET STILL ANOTHER OBJECT of the present invention is to provide a single shot falling breech block action wherein the rectangular-parallelepiped-shaped block of the generally concavo-convex-shaped vertical trigger of the trigger assembly further has a laterally-oriented trigger mounting throughbore that extends laterally therethrough, at a substantial midpoint thereof, between the pair of opposing vertical sides of the rectangular-parallelepiped-shaped block of the generally concavo-convex-shaped vertical trigger of the trigger assembly, and which is in horizontal alignment with a lowermost throughbore of the pair of trigger assembly mounting throughbores in the generally rectangular-parallelepiped-shaped breech block of the breech block assembly.

STILL YET ANOTHER OBJECT of the present invention is to provide a single shot falling breech block action wherein the trigger assembly further includes a trigger spring that has a lower end that sits vertically in a seat in the horizontal top of the generally concavo-convex-shaped vertical trigger of the trigger assembly, in proximity to the vertical rear of the generally concavo-convex-shaped vertical trigger of the trigger assembly.

YET STILL ANOTHER OBJECT of the present invention is to provide a single shot falling breech block action wherein the generally rectangular-parallelepiped-shaped trigger housing of the trigger assembly is replaceably positioned in the generally rectangular-parallelepiped-shaped internal trigger assembly chamber in the hollow and generally rectangular-parallelepiped-shaped breech block of the breech block assembly, with the horizontal bottom of the generally rectangular-parallelepiped-shaped main portion of the firing pin of the breech block assembly being forwardly and rearwardly slidably positioned on the horizontal top of the generally rectangular-parallelepiped-shaped trigger housing of the trigger assembly, and with the pair of horizontal firing pin guide lips of the horizontal top of the generally rectangular-parallelepiped-shaped trigger housing of the trigger assembly providing a guide therefor, and with the inwardly-and-upwardly-tapering projection of the horizontal top of the sear of the trigger assembly being replaceably engagable in the inwardly-and-upwardly-tapering sear recess in the horizontal bottom of the generally rectangular-parallelepiped-shaped main portion of the firing pin of the breech block assembly.

STILL YET ANOTHER OBJECT of the present invention is to provide a single shot falling breech block action wherein the generally rectangular-parallelepiped-shaped trigger housing of the trigger assembly is replaceably maintained in the generally rectangular-parallelepiped-shaped internal trigger assembly chamber in the hollow and generally rectangular-parallelepiped-shaped breech block of the breech block assembly by an uppermost pin of a pair of trigger housing mounting pins that replaceably extends horizontally through an uppermost throughbore of the pair of trigger assembly mounting throughbores in the hollow and generally rectangular-parallelepiped-shaped breech block of the breech block assembly and through a corresponding uppermost throughbore of the pair of trigger housing mounting throughbores in the pair of opposing, parallel, and vertical sides of the generally rectangular-parallelepiped-shaped trigger housing of the trigger assembly.

YET STILL ANOTHER OBJECT of the present invention is to provide a single shot falling breech block action wherein the generally concavo-convex-shaped vertical trigger of the trigger assembly is forwardly and rearwardly pivotally mounted in the generally rectangular-parallelepiped-shaped trigger housing of the trigger assembly, with the horizontal top of the rectangular-parallelepiped-shaped block of the generally concavo-convex-shaped vertical trigger of the trigger assembly abutable against, and releasable from, the horizontal bottom of the sear of the trigger assembly, and with the laterally-oriented trigger mounting throughbore of the rectangular-parallelepiped-shaped block of the generally concavo-convex-shaped vertical trigger of the trigger assembly being in horizontal alignment with a corresponding lowermost throughbore of the trigger housing mounting throughbores in the pair of opposing, parallel, and vertical sides of the generally rectangular-parallelepiped-shaped trigger housing of the trigger assembly and with a corresponding lowermost throughbore of the trigger housing mounting throughbores in the hollow and generally rectangular-parallelepiped-shaped breech block of the breech block assembly.

STILL YET ANOTHER OBJECT of the present invention is to provide a single shot falling breech block action wherein the generally concavo-convex-shaped vertical trigger of the trigger assembly is forwardly and rearwardly pivotally maintained in the generally rectangular-parallelepiped-shaped trigger housing of the trigger assembly, by a lowermost pin of the pair of trigger housing mounting pins that replaceably extends horizontally through the lowermost throughbore of the pair of trigger assembly mounting throughbores in the hollow and generally rectangular-parallelepiped-shaped breech block of the breech block assembly, through the laterally-oriented trigger mounting throughbore of the rectangular-parallelepiped-shaped block of the generally concavo-convex-shaped vertical trigger of the trigger assembly, and through a corresponding lowermost throughbore of the pair of trigger housing mounting throughbores in the pair of opposing, parallel, and vertical sides of the generally rectangular-parallelepiped-shaped trigger housing of the trigger assembly, and which also further replaceably maintains the generally rectangular-parallelepiped-shaped trigger housing of the trigger assembly in the generally rectangular-parallelepiped-shaped internal chamber in the hollow and generally rectangular-parallelepiped-shaped breech block of the breech block assembly.

YET STILL ANOTHER OBJECT of the present invention is to provide a single shot falling breech block action wherein the trigger assembly further includes a substantially U-shaped trigger guard that has a forwardmost leg with a rectangular-parallelepiped-shaped top that has a horizontal top with a centrally-disposed and threaded trigger safety mounting bore that extends centrally downwardly therein, and a vertical side with a centrally-disposed horizontal trigger safety plunger bore that extends laterally therein.

STILL YET ANOTHER OBJECT of the present invention is to provide a single shot falling breech block action wherein the substantially U-shaped trigger guard of the trigger assembly further has a trigger safety plunger that is slidably positioned in, and slidably extendable from, the centrally-disposed horizontal trigger safety plunger bore in the vertical side of the rectangular-parallelepiped-shaped top of the forwardmost leg of the substantially U-shaped trigger guard of the trigger assembly, and which is biased by a safety plunger spring that is also contained therein and which provides a more positive engagement.

YET STILL ANOTHER OBJECT of the present invention is to provide a single shot falling breech block action wherein the substantially U-shaped trigger guard of the trigger assembly further has a substantially C-shaped horizontal safety plate with a horizontal top, a horizontal bottom that is disposed below the horizontal top of the substantially C-shaped horizontal safety plate of the substantially U-shaped trigger guard of the trigger assembly, a vertical front, a vertical rear that is parallel to, disposed behind, and narrower than, the vertical front of the substantially C-shaped horizontal safety plate of the substantially U-shaped trigger guard of the trigger assembly, and a pair of spaced-apart longitudinal sides.

STILL YET ANOTHER OBJECT of the present invention is to provide a single shot falling breech block action wherein the vertical front of the substantially C-shaped horizontal safety plate of the substantially U-shaped trigger guard of the trigger assembly has a width that is greater than that of the rectangular-parallelepiped-shaped top of the forwardmost leg of the substantially U-shaped trigger guard of the trigger assembly so as to allow the substantially C-shaped horizontal safety plate of the substantially U-shaped trigger guard of the trigger assembly to laterally overlap the rectangular-parallelepiped-shaped top of the forwardmost leg of the substantially U-shaped trigger guard of the trigger assembly, an equal amount on both sides thereof.

YET STILL ANOTHER OBJECT of the present invention is to provide a single shot falling breech block action wherein the substantially C-shaped horizontal safety plate of the substantially U-shaped trigger guard of the trigger assembly further has a vertical safety boss that is parallel to, and forward of, the vertical rear of the substantially C-shaped horizontal safety plate of the substantially U-shaped trigger guard of the trigger assembly.

STILL YET ANOTHER OBJECT of the present invention is to provide a single shot falling breech block action wherein the substantially C-shaped horizontal safety plate of the substantially U-shaped trigger guard of the trigger assembly further has a safety plate mounting throughbore that extends vertically therethrough from the horizontal top of the substantially C-shaped horizontal safety plate of the substantially U-shaped trigger guard of the trigger assembly to the horizontal bottom of the substantially C-shaped horizontal safety plate of the substantially U-shaped trigger guard of the trigger assembly, in proximity to the vertical front of the substantially C-shaped horizontal safety plate of the substantially U-shaped trigger guard of the trigger assembly, and in vertical alignment with the centrally-disposed and threaded trigger safety mounting bore of the horizontal top of the rectangular-parallelepiped-shaped top of the forwardmost leg of the substantially U-shaped trigger guard of the trigger assembly.

YET STILL ANOTHER OBJECT of the present invention is to provide a single shot falling breech block action wherein the horizontal top of the substantially C-shaped horizontal safety plate of the substantially U-shaped trigger guard of the trigger assembly has a safety plate mounting counter-bore that is concentric with the safety plate mounting throughbore in the substantially C-shaped horizontal safety plate of the substantially U-shaped trigger guard of the trigger assembly.

STILL YET ANOTHER OBJECT of the present invention is to provide a single shot falling breech block action wherein the substantially C-shaped horizontal safety plate of the substantially U-shaped trigger guard of the trigger assembly is replaceably mounted to the substantially U-shaped trigger guard of the trigger assembly, with the horizontal bottom of the substantially C-shaped horizontal safety plate of the substantially U-shaped trigger guard of the trigger assembly in horizontal abutment with the horizontal top of the rectangular-parallelepiped-shaped top of the forwardmost leg of the substantially U-shaped trigger guard of the trigger assembly, by a safety plate mounting screw that extends vertically through the safety plate mounting throughbore in the substantially C-shaped horizontal safety plate of the substantially U-shaped trigger guard of the trigger assembly and which threadably engages the centrally-disposed and threaded trigger safety mounting bore of the horizontal top of the rectangular-parallelepiped-shaped top of the forwardmost leg of the substantially U-shaped trigger guard of the trigger assembly, and whose head sits unobstructingly in the safety plate mounting counter-bore in the horizontal top of the substantially C-shaped horizontal safety plate of the substantially U-shaped trigger guard of the trigger assembly.

YET STILL ANOTHER OBJECT of the present invention is to provide a single shot falling breech block action wherein the substantially U-shaped trigger guard of the trigger assembly is forwardly and rearwardly slidably positioned in the generally rectangular-parallelepiped-shaped internal trigger assembly chamber in the hollow and generally rectangular-parallelepiped-shaped breech block of the breech block assembly, with the pair of spaced-apart longitudinal sides of the substantially C-shaped horizontal safety plate of the substantially U-shaped trigger guard of the trigger assembly slidably engaging the trigger safety raceway in the inner surface of each side of the pair of parallel, vertical, and opposing sides of the hollow and generally rectangular-parallelepiped-shaped breech block of the breech block assembly, with the vertical safety boss of the substantially C-shaped horizontal safety plate of the substantially U-shaped trigger guard of the trigger assembly releaseably engagable with the horizontal trigger safety recess in the horizontal top of the rectangular-parallelepiped-shaped block of the generally concavo-convex-shaped vertical trigger of the trigger assembly, and with the trigger safety plunger of the substantially U-shaped trigger guard of the trigger assembly releaseably engagable with one detent of the pair of spaced-apart trigger safety plunger detents in the inner surface of the one side of the pair of parallel, vertical, and opposing sides of the hollow and generally rectangular-parallelepiped-shaped breech block of the breech block assembly.

STILL YET ANOTHER OBJECT of the present invention is to provide a method of using a single shot falling breech block action that includes the steps of rotating a slender and cylindrically-shaped finger lever of a lower receiver assembly of the single shot falling breech block action clockwise, rotating a horizontal pinion of the lower receiver assembly clockwise, walking the horizontal pinion rearwardly along a horizontal stationary rack of the lower receiver while being guided therealong by a pinion guide throughslot in a generally rectangular-shaped lower receiver of the lower receiver assembly, sliding a generally rectangular-shaped action plate of the lower receiver assembly rearwardly in a horizontal action plate raceway slot in a pair of parallel and opposing vertical walls of the generally rectangular-shaped lower receiver, causing a cocking boss of a rear extension of the generally rectangular-shaped action plate to abut against and begin to move a front convex cocking surface of a generally convexo-concave and vertical cocking portion of a firing pin of a breech block assembly of the single shot falling breech block action rearwardly against the biasing of a firing pin spring of the firing pin, sliding a horizontal movable rack of the lower receiver assembly rearwardly at twice the speed of the cocking boss, by virtue of the horizontal pinion also moving rearwardly as it rotates, sliding a laterally-and-inwardly-oriented and cylindrically-shaped stud of the horizontal movable rack rearwardly in a horizontal front slot portion of a movable rack stud slot of an outer surface of a hollow and generally rectangular-parallelepiped-shaped breech block of the breech block assembly until a firing pin tip of the firing pin is pushed out of a primer of a spent cartridge, sliding the laterally-and-inwardly-oriented and cylindrically-shaped stud upwardly and rearwardly in a straight line in an inclined intermediate portion of the movable rack stud slot, sliding the hollow and generally rectangular-parallelepiped shaped breech block downwardly in a breech block throughraceway in a generally rectangular-parallelepiped-shaped body of an upper receiver assembly and a breech block throughraceway in the generally rectangular-shaped lower receiver, rotating the slender and cylindrically-shaped finger lever clockwise, causing the cocking boss to continue to move the front convex cocking surface rearwardly against the continual biasing of the firing pin spring, sliding the laterally-and-inwardly-oriented and cylindrically-shaped stud rearwardly in a horizontal rear slot portion of the movable rack stud slot until an inwardly-and-upwardly-tapering projection of a horizontal top of a sear of a trigger assembly of the single shot falling breech block action replaceably engages a mating inwardly-and-upwardly-tapering recess in a horizontal bottom of a generally rectangular-parallelepiped-shaped main portion of the firing pin, maintaining the inwardly-and-upwardly-tapering projection in the mating inwardly-and-upwardly-tapering recess by the biasing of a sear spring of the sear, pivoting a generally concavo-convex-shaped vertical trigger of the trigger assembly forwardly about a lowermost pin of a pair of trigger housing mounting pins of the trigger assembly by the biasing of a trigger spring of the trigger assembly until a horizontal top of a rectangular-parallelepiped-shaped block of the trigger assembly generally concavo-convex-shaped vertical trigger abuts against a horizontal bottom of the sear and an extractor boss of the rear of the generally rectangular-shaped action plate abuts against a front of a generally rectangular-parallelepiped-shaped extractor of the lower receiver assembly so that the single shot falling breech block action is now fully cocked, rotating the slender and cylindrically-shaped finger lever slightly clockwise until the extractor boss pivots the generally rectangular-parallelepiped-shaped extractor rearwardly and extracts a spent cartridge, rotating the slender and cylindrically-shaped finger lever slightly counterclockwise so that the single shot falling breech block action is returned to fully cocked, sliding a substantially U-shaped trigger guard of the trigger assembly forwardly with a pair of spaced-apart longitudinal sides of a substantially C-shaped horizontal safety plate of the substantially U-shaped trigger guard sliding forwardly in a trigger safety raceway in an inner surface of each side of a pair of parallel, vertical, and opposing sides of the hollow and generally rectangular-parallelepiped-shaped breech block until a vertical safety boss of the trigger assembly trigger guard substantially C-shaped horizontal safety plate engages a trigger safety recess in the horizontal top of the rectangular-parallelepiped-shaped block and a trigger safety plunger of the substantially U-shaped trigger guard releaseably engages a forwardmost detent of a pair of spaced-apart trigger safety plunger detents in the inner surface of a side of the pair of parallel, vertical, and opposing sides so that the generally concavo-convex-shaped vertical trigger is prevented from being pulled and the sear is prevented from dropping and the single shot falling breech block action is thereby prevented from being fired, rotating the slender and cylindrically-shaped finger lever counterclockwise, sliding the laterally-and-inwardly-oriented and cylindrically-shaped stud forwardly in the horizontal rear slot portion of the movable rack stud slot, sliding the laterally-and-inwardly-oriented and cylindrically-shaped stud downwardly and forwardly in the inclined intermediate slot portion of the movable rack stud slot, sliding the laterally-and-inwardly-oriented and cylindrically-shaped stud forwardly in the horizontal front slot portion of the movable rack stud slot, sliding the breech block assembly upwardly in the breech block throughraceway in the generally rectangular-shaped lower receiver and the breech block throughraceway in the generally rectangular-parallelepiped-shaped body, closing the single shot falling breech block action, sliding the substantially U-shaped trigger guard rearwardly with the pair of spaced-apart longitudinal sides of the substantially C-shaped horizontal safety plate sliding rearwardly in the trigger safety raceway until the vertical safety boss is released from the trigger safety recess and the trigger safety plunger releaseably engages a rearmost detent of the pair of spaced-apart trigger safety plunger detents so that the generally concavo-convex-shaped vertical trigger of the trigger assembly can be pulled and the sear can drop and the single shot falling breech block action can be fired, pulling the generally concavo-convex-shaped vertical trigger against the biasing of the trigger spring, releasing hold of the generally concavo-convex-shaped vertical trigger on the sear, moving the firing pin rapidly forwardly by virtue of the firing spring being stronger than the sear spring, releasing the inwardly-and-upwardly-tapering projection of the sear from the inwardly-and-upwardly-tapering sear recess of the horizontal bottom of the generally rectangular-parallelepiped-shaped main portion of the firing pin of the breech block assembly, forcing the sear downwardly, and extending a firing pin tip of the firing pin through a firing pin tip throughbore in a vertical and substantially open front of the hollow and generally rectangular-parallelepiped-shaped breech block so that the single shot falling breech block action has been fired, and repeating the aforementioned steps.

FINALLY, YET STILL ANOTHER OBJECT of the present invention is to provide a method of using a single shot falling breech block action that further includes the steps of unscrewing and removing a screw of a take down screw sub-assembly of the lower receiver assembly along with an integrated plunger of the take down screw sub-assembly from a take down throughbore in the generally rectangular-shaped action plate through the pinion guide throughslot, rotating the slender and cylindrically-shaped finger lever slightly counterclockwise, rotating the horizontal pinion slightly counterclockwise, walking the horizontal pinion forwardly until the laterally-and-inwardly-oriented and cylindrically-shaped stud of the horizontal movable rack receiver slides forwardly and completely leaves the movable rack stud slot, pressing the breech block assembly downwardly, and removing the breech block assembly through the breech block throughraceway in the generally rectangular-shaped lower receiver so that the breech block assembly can serviced.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
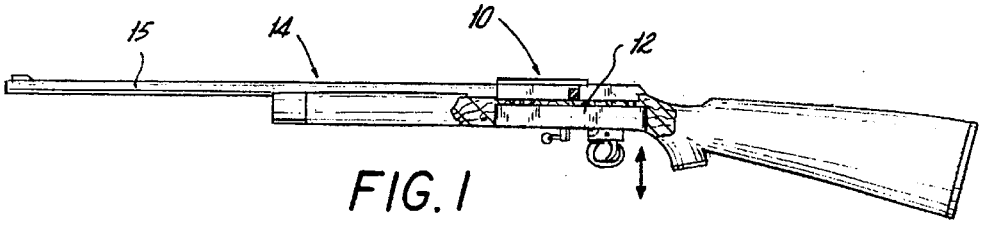
FIG. 1 is a diagrammatic side elevational view of the present invention installed on an appropriately modified conventional single shot rifle stock of a conventional single shot rifle.

| | |
|---|---|
| 10 | single shot falling breech block action of the present invention |
| 12 | appropriately modified conventional single shot rifle stock |
| 14 | conventional single shot rifle |
| 15 | conventional single shot rifle barrel |
| 16 | upper receiver assembly |
| 18 | lower receiver assembly |
| 20 | breech block assembly |
| 22 | trigger assembly |
| 24 | upper receiver assembly generally rectangular-parallelepiped-shaped body |
| 26 | upper receiver assembly body vertical front |
| 28 | upper receiver assembly body vertical rear |
| 30 | upper receiver assembly body horizontal top |
| 32 | upper receiver assembly body horizontal bottom |
| 34 | upper receiver assembly body pair of opposing and vertical sides |
| 36 | upper receiver assembly body imaginary intermediate vertical plane |
| 38 | upper receiver assembly body breech block throughraceway |
| 40 | upper receiver assembly body horizontal top horizontal raised portion |
| 42 | upper receiver assembly body horizontal top raised portion pair of upwardly-and-inwardly-tapering vertical sides |
| 44 | upper receiver assembly body partially-threaded, cylindrically-shaped, and horizontally-oriented barrel mounting throughbore |
| 46 | upper receiver assembly body pair of opposing, release material coated, and downwardly-and-inwardly-tapering recoil shoulders |
| 48 | upper receiver assembly body horizontal bottom pair of threaded, spaced-apart, and longitudinally-oriented mounting bores |
| 49 | upper receiver assembly body horizontal bottom pair of spaced-apart and longitudinally-oriented take down screw plunger detents |
| 50 | conventional single shot rifle barrel back end |
| 52 | lower receiver assembly pair of spaced-apart, longitudinally-oriented, and non-threaded mounting throughbores |
| 54 | pair of action mounting screws |
| 56 | pair of action mounting cylindrically-shaped and vertical spacers |
| 58 | lower receiver assembly generally rectangular-shaped lower receiver |
| 60 | lower receiver assembly lower receiver rounded front |
| 62 | lower receiver assembly lower receiver rounded rear |
| 64 | lower receiver assembly lower receiver horizontal top |
| 65 | lower receiver assembly lower receiver horizontal bottom |
| 66 | lower receiver assembly lower receiver pair of opposing longitudinal sides |
| 68 | lower receiver assembly lower receiver top pair of mounting counter-bore seats |
| 69 | lower receiver assembly lower receiver top low area |
| 70 | lower receiver assembly lower receiver top low area breech block throughraceway |
| 72 | lower receiver assembly lower receiver top low area pinion guide throughslot |
| 74 | lower receiver assembly lower receiver top low area extractor throughslot |
| 76 | lower receiver assembly lower receiver pair of parallel and opposing vertical walls |
| 78 | lower receiver assembly lower receiver vertical wall inner surface |

-continued

| LIST OF REFERENCE NUMERALS UTILIZED IN THE DRAWING | |
|---|---|
| 80 | lower receiver assembly lower receiver vertical wall inner surface horizontal action plate raceway slot |
| 82 | lower receiver assembly lower receiver vertical wall inner surface horizontal movable rack raceway slot |
| 83 | lower receiver assembly lower receiver vertical wall inner surface horizontal stationary rack raceway slot |
| 84 | lower receiver assembly lower receiver vertical wall inner surface stationary rack raceway pair of spaced-apart stationary rack mounting throughbores |
| 86 | lower receiver assembly lower receiver horizontal stationary rack |
| 88 | lower receiver assembly lower receiver stationary rack end pair of mounting throughbores |
| 90 | lower receiver assembly lower receiver horizontal stationary rack pair of replaceable studs |
| 92 | lower receiver assembly generally rectangular-parallelepiped-shaped extractor |
| 94 | lower receiver assembly extractor lower end |
| 96 | lower receiver assembly extractor lower end laterally-oriented throughbore |
| 98 | lower receiver assembly extractor upper end |
| 100 | lower receiver assembly extractor front |
| 102 | lower receiver assembly extractor slot |
| 104 | lower receiver assembly lower receiver horizontal movable rack |
| 106 | lower receiver assembly movable rack rearmost end laterally-and-inwardly-oriented and cylindrically-shaped stud |
| 108 | lower receiver assembly horizontal pinion |
| 110 | lower receiver assembly pinion vertical guide shaft |
| 112 | lower receiver assembly pinion guide shaft lower end |
| 114 | lower receiver assembly pinion guide shaft lower end laterally-oriented and threaded throughbore |
| 115 | lower receiver assembly pinion centrally and longitudinally disposed threaded throughbore |
| 116 | lower receiver assembly slender and cylindrically-shaped finger lever |
| 118 | lower receiver assembly finger lever threaded proximal end |
| 120 | lower receiver assembly finger lever spherical-shaped free distal end |
| 122 | lower receiver assembly generally rectangular-shaped action plate |
| 124 | lower receiver assembly action plate horizontal top |
| 126 | lower receiver assembly action plate horizontal bottom |
| 127 | lower receiver assembly action plate pair of parallel sides |
| 128 | lower receiver assembly action plate rear |
| 129 | lower receiver assembly action plate front |
| 130 | lower receiver assembly action plate generally centrally disposed and non-threaded action plate mounting throughbore |
| 132 | lower receiver assembly action plate top generally centrally disposed and non-threaded action plate mounting counter-bore |
| 134 | lower receiver assembly action plate threaded action plate take down throughbore |
| 136 | lower receiver assembly action-plate rear generally rectangular-shaped cocking boss extension |
| 138 | lower receiver assembly action plate rear cocking boss extension cocking boss |
| 140 | lower receiver assembly action plate rear extractor boss |
| 142 | lower receiver action plate mounting screw |
| 144 | lower receiver assembly take down screw sub-assembly |
| 146 | lower receiver assembly take down screw sub-assembly screw |
| 148 | lower receiver assembly take down screw sub-assembly screw hollow and externally-threaded shaft |
| 150 | lower receiver assembly take down screw sub-assembly plunger |
| 152 | lower receiver assembly take down screw sub-assembly spring |
| 154 | breech block assembly hollow and generally rectangular-parallelepiped-shaped breech block |
| 156 | breech block assembly breech block horizontal and concave-shaped top |
| 158 | breech block assembly breech block open bottom |
| 160 | breech block assembly breech block vertical and closed back |
| 162 | breech block assembly breech block vertical and substantially open front |
| 164 | breech block assembly breech block pair of parallel, vertical, and opposing sides |
| 166 | breech block assembly breech block generally rectangular-parallelepiped-shaped internal chamber |
| 168 | breech block assembly breech block front firing pin tip throughbore |

-continued

| LIST OF REFERENCE NUMERALS UTILIZED IN THE DRAWING | |
|---|---|
| 170 | breech block assembly breech block back inner surface |
| 172 | breech block assembly breech block back inner surface firing pin spring seat bore |
| 174 | breech block assembly breech block side inner surface |
| 176 | breech block assembly breech block side inner surface trigger safety raceway |
| 178 | breech block assembly breech block side inner surface pair of spaced-apart trigger safety plunger detents |
| 180 | breech block assembly breech block side outer surface |
| 182 | breech block assembly breech block side outer surface movable rack stud slot |
| 184 | breech block assembly breech block side outer surface movable rack stud slot horizontal front portion |
| 186 | breech block assembly breech block side outer surface movable rack stud slot inclined intermediate portion |
| 188 | breech block assembly breech block side outer surface movable rack stud slot horizontal rear portion |
| 190 | breech block assembly breech block side pair of trigger assembly mounting throughbores |
| 192 | breech block assembly firing pin |
| 194 | breach block assembly firing pin rectangular-parallelepiped-shaped main portion |
| 196 | breech block assembly firing pin main portion slightly convex-shaped and vertical front |
| 198 | breech block assembly firing pin main portion slightly convex-shaped and vertical rear |
| 200 | breech block assembly firing pin main portion rear outer surface |
| 204 | breech block assembly firing pin main portion rear outer surface generally centrally-disposed firing pin seat bore |
| 206 | breech block assembly firing pin main portion horizontal bottom |
| 207 | breech block assembly firing pin main portion pair of vertical and opposing sides |
| 208 | breech block assembly firing pin generally convexs-concave and vertical cocking portion |
| 212 | breech block assembly firing pin tip |
| 213 | breech block assembly firing pin main portion bottom inwardly-and-upwardly-tapering sear recess |
| 214 | breech block assembly firing pin cocking portion rear concave surface |
| 216 | breech block assembly firing pin spring |
| 218 | breech block assembly firing pin spring front end |
| 220 | breech block assembly firing pin spring rear end |
| 222 | trigger assembly generally rectangular-parallelepiped-shaped trigger housing |
| 224 | trigger assembly trigger housing horizontal top |
| 226 | trigger assembly trigger housing open bottom |
| 228 | trigger assembly trigger housing vertical closed rear |
| 230 | trigger assembly trigger housing vertical front |
| 232 | trigger assembly trigger housing pair of opposing, parallel, and vertical sides |
| 234 | trigger assembly trigger housing top pair of horizontal firing pin guide lips |
| 236 | trigger assembly trigger housing substantially T-shaped sear throughraceway |
| 238 | trigger assembly trigger housing vertical side rectangular-shaped and horizontal sear spring brace throughslot |
| 240 | trigger assembly trigger housing vertical side pair of trigger housing mounting throughbores |
| 242 | trigger assembly sear |
| 244 | trigger assembly sear horizontal top |
| 246 | trigger assembly sear horizontal bottom |
| 248 | trigger assembly sear vertical front |
| 250 | trigger assembly sear pair of opposing, parallel, and vertical sides |
| 251 | trigger assembly sear vertical rear |
| 252 | trigger assembly sear horizontal top inwardly-and-upwardly-tapering projection |
| 254 | trigger assembly sear horizontal bottom rectangular-parallelepiped-shaped sear spring recess |
| 256 | trigger assembly sear spring |
| 257 | trigger assembly sear spring upper end |
| 258 | trigger assembly sear spring horizontal brace |
| 260 | trigger assembly sear spring lower end |
| 262 | trigger assembly generally concavo-convex-shaped vertical trigger |
| 264 | trigger assembly trigger horizontal top |

-continued

| LIST OF REFERENCE NUMERALS UTILIZED IN THE DRAWING | |
|---|---|
| 266 | trigger assembly trigger vertical front |
| 267 | trigger assembly trigger vertical rear |
| 268 | trigger assembly trigger pair of opposing vertical sides |
| 270 | trigger assembly trigger rectangular-parallelepiped-shaped block |
| 272 | trigger assembly trigger block vertical rear |
| 274 | trigger assembly trigger block horizontal top |
| 276 | trigger assembly trigger block top horizontal trigger safety recess |
| 278 | trigger assembly trigger block laterally-oriented trigger mounting throughbore |
| 280 | trigger assembly trigger spring |
| 282 | trigger assembly trigger spring lower end |
| 284 | trigger assembly pair of trigger housing mounting pins |
| 286 | trigger assembly substantially Unshaped trigger guard |
| 288 | trigger assembly trigger guard forwardmost leg |
| 290 | trigger assembly trigger guard forwardmost leg rectangular-parallelepiped-shaped top |
| 292 | trigger assembly trigger guard forwardmost leg top horizontal top |
| 294 | trigger assembly trigger guard forwardmost leg top horizontal top centrally-disposed and threaded trigger safety mounting bore |
| 296 | trigger assembly trigger guard forwardmost leg top vertical side |
| 298 | trigger assembly trigger guard forwardmost leg top vertical side centrally-disposed horizontal trigger safety plunger bore |
| 300 | trigger assembly trigger guard trigger safety plunger |
| 302 | trigger assembly trigger guard trigger safety plunger spring |
| 304 | trigger assembly trigger guard substantially C-shaped horizontal safety plate |
| 306 | trigger assembly trigger guard safety plate horizontal top |
| 308 | trigger assembly trigger guard safety plate horizontal bottom |
| 310 | trigger assembly trigger guard safety plate vertical front |
| 312 | trigger assembly trigger guard safety plate vertical rear |
| 313 | trigger assembly trigger guard safety plate pair of spaced-apart longitudinal sides |
| 314 | trigger assembly trigger guard safety plate mounting throughbore |
| 316 | trigger assembly trigger guard top safety plate top safety plate mounting counter-bore |
| 318 | trigger assembly trigger guard safety plate vertical safety boss |
| 320 | trigger assembly trigger guard safety plate mounting screw |
| 322 | spent cartridge |
| 324 | upper receiver assembly vertical firing pin clearance groove |
| 326 | lower receiver assembly vertical firing pin clearance groove |
| 328 | new cartridge |

DETAILED DESCRIPTION OF THE PREFERRED EMBODIMENT

Referring now to the figures in which like numerals indicate like parts, and particularly to FIG. 1, which is a diagrammatic side elevational view of the present invention installed on an appropriately modified conventional single shot rifle stock of a conventional single shot rifle, the single shot falling breech block action of the present invention is shown generally at 10 installed on an appropriately modified conventional single shot rifle stock 12 of a conventional dingle shot rifle 14 and interacting with a conventional single shot rifle barrel 15.

Figure 2:
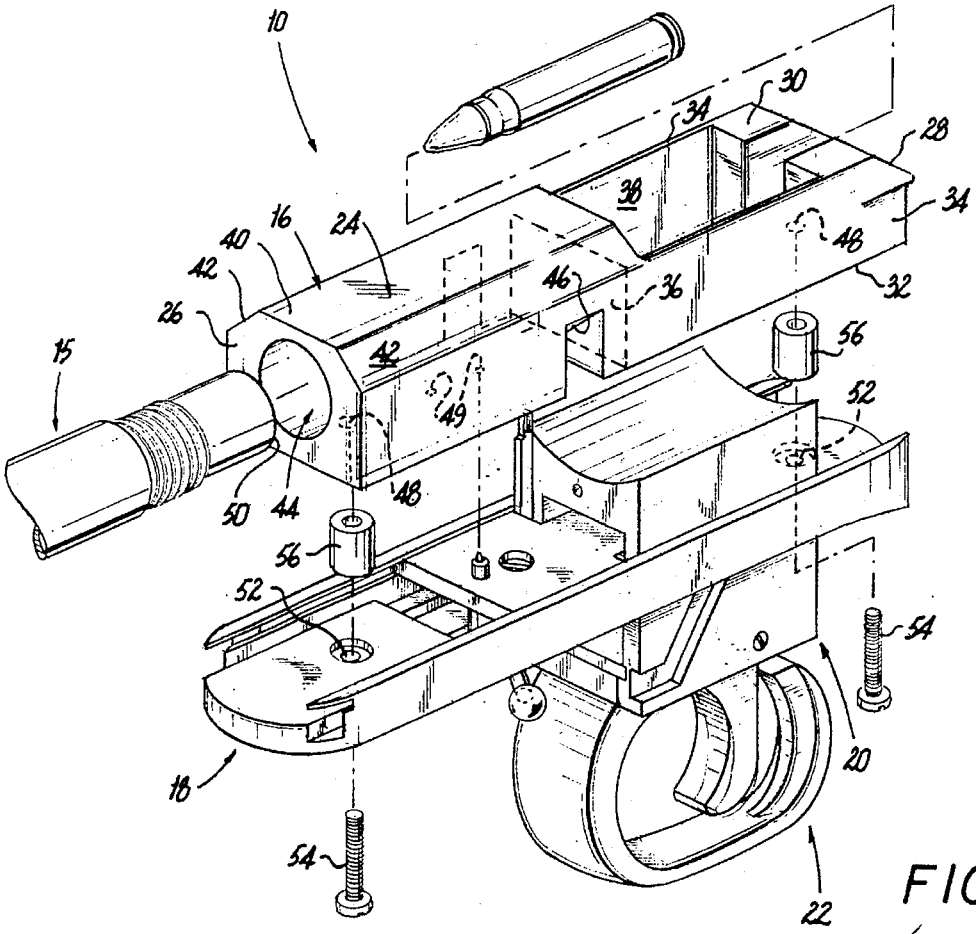
FIG. 2 is an exploded diagrammatic perspective view illustrating the installation of the present invention on the appropriately modified conventional single shot rifle stock of the conventional single shot rifle.

The general configuration of the single shot falling breech block action 10 can best be seen in FIG. 2, which is an exploded diagrammatic perspective view illustrating the installation of the present invention on the appropriately modified conventional single shot rifle stock of the conventional single shot rifle, and as such will be discussed with reference thereto.

The single shot falling breech block action 10 includes an upper receiver assembly 16, a lower receiver assembly 18 that is replaceably attached to the upper receiver assembly 16, a breech block assembly 20 that is vertically movably mounted in the lower receiver assembly 18, and a trigger assembly 22 that is movably mounted to the breech block assembly 20.

The upper receiver assembly 16 has an upper receiver assembly generally rectangular-parallelepiped-shaped body 24 with an upper receiver assembly body vertical front 26 and an upper receiver assembly body vertical rear 28 that is disposed behind the upper receiver assembly body vertical front 26 of the upper receiver assembly generally rectangular-parallelepiped-shaped body 24 of the upper receiver assembly 16.

The upper receiver assembly generally rectangular-parallelepiped-shaped body 24 of the upper receiver assembly 16 further has an upper receiver assembly body horizontal top 30 that extends from the upper receiver assembly body vertical front 26 of the upper receiver assembly generally rectangular-parallelepiped-shaped body 24 of the upper receiver assembly 16 to the upper receiver assembly body vertical rear 28 of the upper receiver assembly generally rectangular-parallelepiped-shaped body 24 of the upper receiver assembly 16.

The upper receiver assembly generally rectangular-parallelepiped-shaped body 24 of the upper receiver assembly 16 further has an upper receiver assembly body horizontal bottom 32 that is below the upper receiver assembly body horizontal top 30 of the upper receiver assembly generally rectangular-parallelepiped-shaped body 24 of the upper receiver assembly 16 and extends from the upper receiver assembly body vertical front 26 of the upper receiver assembly generally rectangular-parallelepiped-shaped body 24 of the upper receiver assembly 16 to the upper receiver assembly body vertical rear 28 of the upper receiver assembly generally rectangular-parallelepiped-shaped body 24 of the upper receiver assembly 16.

The upper receiver assembly generally rectangular-parallelepiped-shaped body 24 of the upper receiver assembly 16 further has an upper receiver assembly body pair of opposing and vertical sides 34.

Each side of the upper receiver assembly body pair of opposing and vertical sides 34 of the upper receiver assembly generally rectangular-parallelepiped-shaped body 24 of the upper receiver assembly 16 extends from a side of the upper receiver assembly body vertical front 26 of the upper receiver assembly generally rectangular-parallelepiped-shaped body 24 of the upper receiver assembly 16 to a respective side of the upper receiver assembly body vertical rear 28 of the upper receiver assembly generally rectangular-parallelepiped-shaped body 24 of the upper receiver assembly 16 and from a side of the upper receiver assembly body horizontal top 30 of the upper receiver assembly generally rectangular-parallelepiped-shaped body 24 of the upper receiver assembly 16 to a respective side of the upper receiver assembly body horizontal bottom 32 of the upper receiver assembly generally rectangular-parallelepiped-shaped body 24 of the upper receiver assembly 16.

The upper receiver assembly generally rectangular-parallelepiped-shaped body 24 of the upper receiver assembly 16 further has an upper receiver assembly body imaginary intermediate vertical plane 36 that is disposed at substantially the midpoint between the upper receiver assembly body vertical front 26 of the upper receiver assembly generally rectangular-parallelepiped-shaped body 24 of the upper receiver assembly 16 and the upper receiver assembly body vertical rear 28 of the upper receiver assembly generally rectangular-parallelepiped-shaped body 24 of the upper receiver assembly 16.

The upper receiver assembly generally rectangular-parallelepiped-shaped body 24 of the upper receiver assembly 16 further has an upper receiver assembly body breech block throughraceway 38 that extends from the upper receiver assembly body horizontal top 30 of the upper receiver assembly generally rectangular-parallelepiped-shaped body 24 of the upper receiver assembly 16 to the upper receiver assembly body horizontal bottom 32 of the upper receiver assembly generally rectangular-parallelepiped-shaped body 24 of the upper receiver assembly 16 and from slightly rearward of the upper receiver assembly body imaginary intermediate vertical plane 36 of the upper receiver assembly generally rectangular-parallelepiped-shaped body 24 of the upper receiver assembly 16 to slightly forward of the upper receiver assembly body vertical rear 28 of the upper receiver assembly generally rectangular-parallelepiped-shaped body 24 of the upper receiver assembly 16.

The upper receiver assembly body horizontal top 30 of the upper receiver assembly generally rectangular-parallelepiped-shaped body 24 of the upper receiver assembly 16 has an upper receiver assembly body horizontal top horizontal raised portion 40 that extends from the upper receiver assembly body vertical front 26 of the upper receiver assembly generally rectangular-parallelepiped-shaped body 24 of the upper receiver assembly 16 to the upper receiver assembly body breech block throughraceway 38 of the upper receiver assembly generally rectangular-parallelepiped-shaped body 24 of the upper receiver assembly 16 and has an upper receiver assembly body horizontal top raised portion pair of upwardly-and-inwardly-tapering vertical sides 42.

The upper receiver assembly generally rectangular-parallelepiped-shaped body 24 of the upper receiver assembly 16 further has an upper receiver assembly body partially-threaded, cylindrically-shaped, and horizontally-oriented barrel mounting throughbore 44 that extends horizontally between, and opens into both, the upper receiver assembly body vertical front 26 of the upper receiver assembly generally rectangular-parallelepiped-shaped body 24 of the upper receiver assembly 16 and the upper receiver assembly body breech block throughraceway 38 of the upper receiver assembly generally rectangular-parallelepiped-shaped body 24 of the upper receiver assembly 16.

The upper receiver assembly generally rectangular-parallelepiped-shaped body 24 of the upper receiver assembly 16 further has an upper receiver assembly body pair of opposing, release material coated, and downwardly-and-inwardly-tapering recoil shoulders 46 that are disposed slightly forward of the upper receiver assembly body imaginary intermediate vertical plane 36 of the upper receiver assembly generally rectangular-parallelepiped-shaped body 24 of the upper receiver assembly 16.

Each shoulder of the upper receiver assembly body pair of opposing, release material coated, and downwardly-and-inwardly-tapering recoil shoulders 46 of the upper receiver assembly generally rectangular-parallelepiped-shaped body 24 of the upper receiver assembly 16 opens into, and extends downwardly and inwardly from, a respective side of the upper receiver assembly body pair of opposing and vertical sides 34 of the upper receiver assembly generally rectangular-parallelepiped-shaped body 24 of the upper receiver assembly 16 to, and opens into, the upper receiver assembly body horizontal bottom 32 of the upper receiver assembly generally rectangular-parallelepiped-shaped body 24 of the upper receiver assembly 16.

The upper receiver assembly body horizontal bottom 32 of the upper receiver assembly generally rectangular-parallelepiped-shaped body 24 of the upper receiver assembly 16 has an upper receiver assembly body horizontal bottom pair of threaded, spaced-apart, and longitudinally-oriented mounting bores 48 that extend upwardly therefrom.

One bore of the upper receiver assembly body horizontal bottom pair of threaded, spaced-apart, and longitudinally-oriented mounting bores 48 in the upper receiver assembly body horizontal bottom 32 of the upper receiver assembly generally rectangular-parallelepiped-shaped body 24 of the upper receiver assembly 16 is disposed slightly rearward of the upper receiver assembly body vertical front 26 of the upper receiver assembly generally rectangular-parallelepiped-shaped body 24 of the upper receiver assembly 16 while another bore of the upper receiver assembly body horizontal bottom pair of threaded, spaced-apart, and longitudinally-oriented mounting bores 48 in the upper receiver assembly body horizontal bottom 32 of the upper receiver assembly generally rectangular-parallelepiped-shaped body 24 of the upper receiver assembly 16 is disposed slightly forward of the upper receiver assembly body vertical rear 28 of the upper receiver assembly generally rectangular-parallelepiped-shaped body 24 of the upper receiver assembly 16.

The upper receiver assembly body horizontal bottom 32 of the upper receiver assembly generally rectangular-parallelepiped-shaped body 24 of the upper receiver assembly 16 further has an upper receiver assembly body horizontal bottom pair of spaced-apart and longitudinally-oriented take down screw plunger detents 49 that extend upwardly therefrom.

The upper receiver assembly body horizontal bottom pair of spaced-apart and longitudinally-oriented take down screw plunger detents 49 in the upper receiver assembly body horizontal bottom 32 of the upper receiver assembly generally rectangular-parallelepiped-shaped body 24 of the upper receiver assembly 16 are disposed longitudinally between the upper receiver assembly body pair of opposing, release material coated, and downwardly-and-inwardly-tapering recoil shoulders 46 of the upper receiver assembly generally rectangular-parallelepiped-shaped body 24 of the upper receiver assembly 16 and the forwardmost bore of the upper receiver assembly body horizontal bottom pair of threaded, spaced-apart, and longitudinally-oriented mounting bores 48 in the upper receiver assembly body horizontal bottom 32 of the upper receiver assembly generally rectangular-parallelepiped-shaped body 24 of the upper receiver assembly 16.

The conventional single shot rifle barrel 15 of the conventional single shot rifle 14 has a conventional single shot rifle barrel back end 50 that threadably engages the upper receiver assembly body partially-threaded, cylindrically-shaped, and longitudinally-oriented barrel mounting throughbore 44 in the upper receiver assembly generally rectangular-parallelepiped-shaped body 24 of the upper receiver assembly 16 and is in communication with the upper receiver assembly body breech block throughraceway 38 of the upper receiver assembly generally rectangular-parallelepiped-shaped body 24 of the upper receiver assembly 16.

It is to be understood, however, that the entire upper receiver assembly 16 can be omitted and the conventional single shot rifle barrel back end 50 of the conventional single shot rifle barrel 15 of the conventional single shot rifle 14 can be modified to have the upper receiver assembly body breech block throughraceway 38 of the upper receiver assembly generally rectangular-parallelepiped-shaped body 24 of the upper receiver assembly 16 disposed therein as well as the upper receiver assembly body pair of opposing, release material coated, and downwardly-and-inwardly-tapering recoil shoulders 46 of the upper receiver assembly generally rectangular-parallelepiped-shaped body 24 of the upper receiver assembly 16 and the upper receiver assembly body horizontal bottom pair of threaded, spaced-apart, and longitudinally-oriented mounting bores 48 in the upper receiver assembly body horizontal bottom 32 of the upper receiver assembly generally rectangular-parallelepiped-shaped body 24 of the upper receiver assembly 16 without departing in any way from the spirit of the present invention.

It is to be further understood, however, that the upper receiver assembly 16 and the conventional single shot rifle barrel 15 of the conventional single shot rifle 14 can be one piece without departing in any way from the spirit of the present invention.

The lower receiver assembly 18 has a lower receiver assembly pair of spaced-apart, longitudinally-oriented, and non-threaded mounting throughbores 52 that are in vertical alignment with the upper receiver assembly body horizontal bottom pair of threaded, spaced-apart, and longitudinally-oriented mounting bores 48 in the upper receiver assembly body horizontal bottom 32 of the upper receiver assembly generally rectangular-parallelepiped-shaped body 24 of the upper receiver assembly 16.

The upper receiver assembly 16 is replaceably engaged to the lower receiver assembly 18, with the intermediate portion of the appropriately modified conventional single shot rifle stock 12 of a conventional single shot rifle 14 engaged therebetween, by a pair of action mounting screws 54 that extend freely through the lower receiver assembly pair of spaced-apart, longitudinally-oriented, and non-threaded mounting throughbores 52 in the lower receiver assembly 18 and a pair of action mounting cylindrically-shaped and vertical spacers 56, and threadably engage the upper receiver assembly body horizontal bottom pair of threaded, spaced-apart, and longitudinally-oriented mounting bores 48 in the upper receiver assembly body horizontal bottom 32 of the upper receiver assembly generally rectangular-parallelepiped-shaped body 24 of the upper receiver assembly 16.

It is to be understood that the upper receiver assembly body vertical rear 28 of the upper receiver assembly generally rectangular-parallelepiped-shaped body 24 of the upper receiver assembly 16 is positioned slightly forward from the butt portion of the appropriately modified conventional single shot rifle stock 12 of the conventional single shot rifle 14 so as to form a slight gap therebetween, so that the percussion from the fired conventional single shot rifle 14, in most part, is not transferred to the butt portion of the appropriately modified conventional single shot rifle stock 12 of the conventional single shot rifle 14 and ultimately to the shoulder of the user.

To maintain this gap between the upper receiver assembly 16 and the butt portion of the appropriately modified conventional single shot rifle stock 12 of the conventional single shot rifle, the upper receiver assembly body pair of opposing, release material coated, and downwardly-and-inwardly-tapering recoil shoulders 46 of the upper receiver assembly generally rectangular-parallelepiped-shaped body 24 of the upper receiver assembly 16 are aligned with two ⅜ or ½ inch apertures bored into corresponding positions in the intermediate portion of the appropriately modified conventional single shot rifle stock 12 of the conventional single shot rifle 14.

Glass bedding compound is poured into the two ⅜ or ½ inch apertures and allowed to cure with the single shot falling breech block action 10 and the appropriately modified conventional single shot rifle stock 12 of the conventional single shot rifle 14 being held together by the pair of action mounting screws 54 so as to form a simple and inexpensive vehicle for maintaining close tolerances.

It is to be understood that the presence of the release material coating on the upper receiver assembly body pair of opposing, release material coated, and downwardly-and-inwardly-tapering recoil shoulders 46 of the upper receiver assembly generally rectangular-parallelepiped-shaped body 24 of the upper receiver assembly 16 prevents the glass bedding material from sticking thereto, so that the upper receiver assembly 16 can be readily removed from the appropriately modified conventional single shot rifle stock 12 of the conventional single shot rifle 14 during take down thereof.

Figure 3:
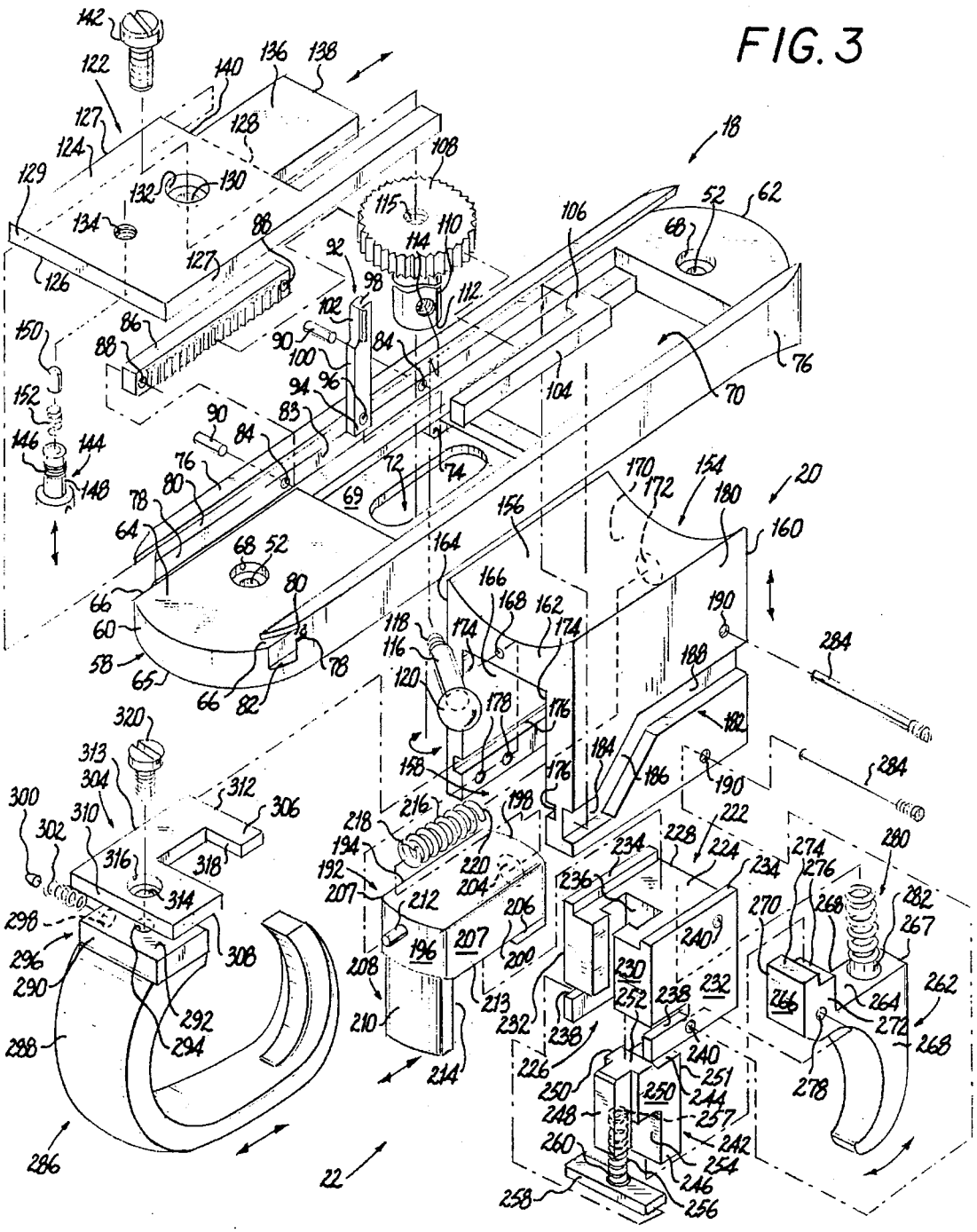
FIG. 3 is an exploded diagrammatic perspective view of the lower receiver assembly, the breech block assembly, and the trigger assembly of the present invention.

The specific configuration of the lower receiver assembly 18, the breech block assembly, and the trigger assembly 22 can best be seen in FIG. 3 which is an exploded diagrammatic perspective view of the lower receiver assembly, the breech block assembly, and the trigger assembly of the present invention, and as such will be discussed with reference thereto.

The lower receiver assembly 18 includes a lower receiver assembly generally rectangular-shaped lower receiver 58 that has a lower receiver assembly lower receiver rounded front 60, and a lower receiver assembly lower receiver rounded rear 62 that is disposed behind the lower receiver assembly lower receiver rounded front 60 of the lower receiver assembly generally rectangular-shaped lower receiver 58 of the receiver assembly 18.

The lower receiver assembly generally rectangular-shaped lower receiver 58 of the receiver assembly 18 further has a lower receiver assembly lower receiver horizontal top 64, and a lower receiver assembly lower receiver horizontal bottom 65 that is disposed below the lower receiver assembly lower receiver horizontal top 64 of the lower receiver assembly generally rectangular-shaped lower receiver 58 of the receiver assembly 18.

The lower receiver assembly generally rectangular-shaped lower receiver 58 of the receiver assembly 18 further has a lower receiver assembly lower receiver pair of opposing longitudinal sides 66 that extend from the lower receiver assembly lower receiver rounded front 60 of the lower receiver assembly generally rectangular-shaped lower receiver 58 of the receiver assembly 18 to the lower receiver assembly lower receiver rounded rear 62 of the lower receiver assembly generally rectangular-shaped lower receiver 58 of the receiver assembly 18.

The lower receiver assembly lower receiver horizontal top 64 of the lower receiver assembly generally rectangular-shaped lower receiver 58 of the lower receiver assembly 18 has a lower receiver assembly lower receiver top pair of mounting counterbore seats 68 that are concentric with the lower receiver assembly lower receiver pair of spaced-apart, longitudinally-oriented, and non-threaded mounting throughbores 52 in the lower receiver assembly 18 and assist in the seating of the pair of action mounting cylindrically-shaped and vertical spacers 56.

The lower receiver assembly lower receiver horizontal top 64 of the lower receiver assembly generally rectangular-shaped lower receiver 58 of the lower receiver assembly 18 further has a lower receiver assembly lower receiver top low area 69 that is lower than the lower receiver assembly lower receiver horizontal top 64 of the lower receiver assembly generally rectangular-shaped lower receiver 58 of the lower receiver assembly 18 and extends from slightly forward of the rearmost throughbore of the lower receiver assembly lower receiver pair of spaced-apart, longitudinally-oriented, and non-threaded mounting throughbores 52 in the lower receiver assembly 18 to between the forwardmost detent of the upper receiver assembly body horizontal bottom pair of spaced-apart and longitudinally-oriented take down screw plunger detents 49 in the upper receiver assembly body horizontal bottom 32 of the upper receiver assembly generally rectangular-parallelepiped-shaped body 24 of the upper receiver assembly 16 and the forwardmost throughbore of the lower receiver assembly pair of spaced-apart, longitudinally-oriented, and non-threaded mounting throughbores 52 in the lower receiver assembly 18.

The lower receiver assembly lower receiver top low area 69 in the lower receiver assembly lower receiver horizontal top 64 of the lower receiver assembly generally rectangular-shaped lower receiver 58 of the receiver assembly 18 has a lower receiver assembly lower receiver top low area breech block throughraceway 70 that extends therethrough from the lower receiver assembly lower receiver top low area 69 in the lower receiver assembly lower receiver horizontal top 64 of the lower receiver assembly generally rectangular-shaped lower receiver 58 of the lower receiver assembly 18 to the lower receiver assembly lower receiver horizontal bottom 65 of the lower receiver assembly generally rectangular-shaped lower receiver 58 of the lower receiver assembly 18 and is in vertical alignment with the upper receiver assembly body breech block throughraceway 38 in the upper receiver assembly generally rectangular-parallelepiped-shaped body 24 of the upper receiver assembly 16 and forms a smooth continuous breech block chamber therewith.

The lower receiver assembly lower receiver top low area 69 in the lower receiver assembly lower receiver horizontal top 64 of the lower receiver assembly generally rectangular-shaped lower receiver 58 of the receiver assembly 18 further has a lower receiver assembly lower receiver top low area pinion guide throughslot 72 that extends therethrough from the lower receiver assembly lower receiver top low area 69 in the lower receiver assembly lower receiver horizontal top 64 of the lower receiver assembly generally rectangular-shaped lower receiver 58 of the receiver assembly 18 to the lower receiver assembly lower receiver horizontal bottom 65 of the lower receiver assembly generally rectangular-shaped lower receiver 58 of the lower receiver assembly 18 and longitudinally from slightly forward of the lower receiver assembly lower receiver top low area throughraceway 70 in the lower receiver assembly lower receiver top low area 69 in the lower receiver assembly lower receiver horizontal top 64 of the lower receiver assembly generally rectangular-shaped lower receiver 58 of the lower receiver assembly 18 to slightly forward of the forwardmost detent of the upper receiver assembly body horizontal bottom pair of spaced-apart and longitudinally-oriented take down screw plunger detents 49 in the upper receiver assembly body horizontal bottom 32 of the upper receiver assembly generally rectangular-parallelepiped-shaped body 24 of the upper receiver assembly 16.

The lower receiver assembly lower receiver top low area 69 in the lower receiver assembly lower receiver horizontal top 64 of the lower receiver assembly generally rectangular-shaped lower receiver 58 of the lower receiver assembly 18 further has a lower receiver assembly lower receiver top low area extractor throughslot 74 that extends therethrough from the lower receiver assembly lower receiver top low area 69 in the lower receiver assembly lower receiver horizontal top 64 of the lower receiver assembly generally rectangular-shaped lower receiver 58 of the lower receiver assembly 18 to the lower receiver assembly lower receiver horizontal bottom 65 of the lower receiver assembly generally rectangular-shaped lower receiver 58 of the lower receiver assembly 18, to one side of, and in proximity to, the rearmost border of the lower receiver assembly lower receiver top low area pinion guide throughslot 72 in the lower receiver assembly lower receiver top low area 69 in the lower receiver assembly lower receiver horizontal top 64 of the lower receiver assembly lower generally rectangular-shaped lower receiver 58 of the lower receiver assembly 18.

The lower receiver assembly generally rectangular-shaped lower receiver 58 of the lower receiver assembly 18 further has a lower receiver assembly lower receiver pair of parallel and opposing vertical walls 76 that extend perpendicularly upwardly along the lower receiver assembly lower receiver pair of opposing longitudinal sides 66 of the lower receiver assembly generally rectangular-shaped lower receiver 58 of the lower receiver assembly 18 from the lower receiver assembly lower receiver rounded front 60 of the lower receiver assembly generally rectangular-shaped lower receiver 58 of the lower receiver assembly 18 to the lower receiver assembly lower receiver rounded rear 62 of the lower receiver assembly generally rectangular-shaped lower receiver 58 of the lower receiver assembly 18.

Each wall of the lower receiver assembly lower receiver pair of parallel and opposing vertical walls 76 of the lower receiver assembly generally rectangular-shaped lower receiver 58 of the lower receiver assembly 18 has a lower receiver assembly lower receiver vertical wall inner surface 78 that oppose each other and has a lower receiver assembly lower receiver vertical wall inner surface horizontal action plate raceway slot 80 that are parallel to, oppose each other, and extend continuously longitudinally therealong, at the top thereof, and slightly above the lower receiver assembly lower receiver horizontal top 64 of the lower receiver assembly generally rectangular-shaped lower receiver 58 of the lower receiver assembly 18.

The lower receiver assembly lower receiver vertical wall inner surface 78 of the lower receiver assembly lower receiver pair of parallel and opposing vertical walls 76 of the lower receiver assembly generally rectangular-shaped lower receiver 58 of the lower receiver assembly 18 that is opposite to that in which the lower receiver assembly lower receiver top low area extractor throughslot 74 in the lower receiver assembly lower receiver top low area 69 in the lower receiver assembly lower receiver horizontal top 64 of the lower receiver assembly generally rectangular-shaped lower receiver 58 of the lower receiver assembly 18 is most closest, further has a lower receiver assembly lower receiver vertical wall inner surface horizontal movable rack raceway slot 82.

The lower receiver assembly lower receiver vertical wall inner surface horizontal movable rack raceway slot 82 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 is disposed below, and parallel to, the lower receiver assembly lower receiver vertical wall inner surface horizontal action plate raceway slot 80 in the appropriate wall of the lower receiver assembly lower receiver pair of parallel and opposing vertical walls 76 of the lower receiver assembly generally rectangular-shaped lower receiver 58 of the lower receiver assembly 18 and is positioned in the lower receiver assembly lower receiver top low area 69 in the lower receiver assembly lower receiver horizontal top 64 of the lower receiver assembly generally rectangular-shaped lower receiver 58 of the lower receiver assembly 18 and extends continuously longitudinally along the length of the appropriate wall of the lower receiver assembly lower receiver pair of parallel and opposing vertical walls 76 of the lower receiver assembly generally rectangular-shaped lower receiver 58 of the lower receiver assembly 18.

The lower receiver assembly lower receiver vertical wall inner surface 78 of the lower receiver assembly lower receiver pair of parallel and opposing vertical walls 76 of the lower receiver assembly generally rectangular-shaped lower receiver 58 of the lower receiver assembly 18 in which the lower receiver assembly lower receiver top low area extractor throughslot 74 in the lower receiver assembly lower receiver top low area 69 in the lower receiver assembly lower receiver horizontal top 64 of the lower receiver assembly generally rectangular-shaped lower receiver 58 of the lower receiver assembly 18 is most closest further has extending continuously therealong a lower receiver assembly lower receiver vertical wall inner surface horizontal stationary rack raceway slot 83 that is disposed below, and parallel to, the lower receiver assembly lower receiver vertical wall inner surface horizontal action plate raceway slot 80 in the appropriate wall of the lower receiver assembly lower receiver pair of parallel and opposing vertical walls 76 of the lower receiver assembly generally rectangular-shaped lower receiver 58 of the lower receiver assembly 18.

The lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 is positioned in the lower receiver assembly lower receiver top low area 69 in the lower receiver assembly lower receiver horizontal top 64 of the lower receiver assembly generally rectangular-shaped lower receiver 58 of the lower receiver assembly 18.

The lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18, opposes, and is in horizontal alignment with, the lower receiver assembly lower receiver vertical wall inner surface horizontal movable rack raceway slot 82 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18.

The lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 has a lower receiver assembly lower receiver vertical wall inner surface stationary rack raceway pair of spaced-apart stationary rack mounting throughbores 84 that extend laterally therethrough.

The forwardmost throughbore of the lower receiver assembly lower receiver vertical wall inner surface pair of spaced-apart stationary rack mounting throughbores 84 in the lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 is disposed in the lower receiver assembly lower receiver top low area 69 in the lower receiver assembly lower receiver horizontal top 64 of the lower receiver assembly generally rectangular-shaped lower receiver 58 of the lower receiver assembly 18 slightly rearward of the forwardmost border thereof 126 while the rearmost throughbore of the lower receiver assembly lower receiver vertical wall inner surface pair of spaced-apart stationary rack mounting throughbores 84 is also disposed in the lower receiver assembly lower receiver top low area 69 in the lower receiver assembly lower receiver horizontal top 64 of the lower receiver assembly generally rectangular-shaped lower receiver 58 of the lower receiver assembly 18 at the lower receiver assembly lower receiver top low area extractor throughslot 74 in the lower receiver assembly lower receiver top low area 69 in the lower receiver assembly lower receiver horizontal top 64 of the lower receiver assembly generally rectangular-shaped lower receiver 58 of the lower receiver assembly 18.

The lower receiver assembly 18 further includes a lower receiver assembly lower receiver horizontal stationary rack 86 that has a lower receiver assembly lower receiver stationary rack end pair of mounting throughbores 88 that are disposed laterally at the ends thereof.

The lower receiver assembly lower receiver horizontal stationary rack 86 of the lower receiver 18 is replaceably engaged against horizontal movement in the lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 by a lower receiver assembly lower receiver horizontal stationary rack pair of replaceable studs 90 that extend through the lower receiver assembly lower receiver vertical wall inner surface pair of spaced-apart stationary rack mounting throughbores 84 in the lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 and enter the lower receiver assembly lower receiver stationary rack end pair of mounting throughbores 88 in the lower receiver assembly lower receiver horizontal stationary rack 86 of the lower receiver assembly 18, During take down, the lower receiver assembly lower receiver horizontal stationary rack pair of replaceable studs 90 of the lower receiver assembly lower receiver assembly 18 allow the lower receiver assembly lower receiver horizontal stationary rack 86 of the lower receiver assembly 18 to be readily serviced or replaced, if necessary by the removal thereof and by the lower receiver assembly lower receiver horizontal stationary rack 86 then being slid out of the lower receiver assembly lower receiver vertical wall inner surface horizontal stationary rack raceway slot 83 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18.

The lower receiver assembly 18 further includes a lower receiver assembly generally rectangular-parallelepiped-shaped extractor 92 that has a lower receiver assembly extractor lower end 94 with a lower receiver assembly extractor lower end laterally-oriented throughbore 96 that extends laterally therethrough.

The lower receiver assembly generally rectangular-parallelepiped-shaped extractor 92 of the lower receiver assembly 18 further has a lower receiver assembly extractor upper end 98 that is disposed above the lower receiver assembly extractor lower end 94 of the lower receiver assembly generally rectangular-parallelepiped-shaped extractor 92 of the lower receiver assembly 18, and a lower receiver assembly extractor front 100 that faces forward and extends from the lower receiver assembly extractor upper end 98 of the lower receiver assembly generally rectangular-parallelepiped-shaped extractor 92 of the lower receiver assembly 18 to the lower receiver assembly extractor lower end 94 of the lower receiver assembly generally rectangular-parallelepiped-shaped extractor 92 of the lower receiver assembly 18.

The lower receiver assembly generally rectangular-parallelepiped-shaped extractor 92 of the lower receiver assembly 18 further has a lower receiver assembly extractor slot 102 that opens into both the lower receiver assembly extractor upper end 98 of the lower receiver assembly generally rectangular-parallelepiped-shaped extractor 92 of the lower receiver assembly 18 and the lower receiver assembly extractor front 100 of the lower receiver assembly generally rectangular-parallelepiped-shaped extractor 92 of the lower receiver assembly 18 and forms a seat to engage and extract a spent cartridge.

The lower receiver assembly extractor lower end 94 of the lower receiver assembly generally rectangular-parallelepiped-shaped extractor 92 of the lower receiver assembly 18 sits forwardly and rearwardly pivotable in the lower receiver assembly lower receiver top low area extractor throughslot 74 in the lower receiver assembly lower receiver top low area 69 in the lower receiver assembly lower receiver horizontal top 64 of the lower receiver assembly generally rectangular-shaped lower receiver 58 of the lower receiver assembly 18 and is forwardly and rearwardly pivotally mounted to the lower receiver assembly lower receiver horizontal stationary rack 86 by the rearmost stud of the lower receiver assembly lower receiver horizontal stationary rack pair of replaceable studs 90 of the lower receiver assembly 18 also replaceably entering the lower receiver assembly extractor lower end laterally-oriented throughbore 96 in the lower receiver assembly extractor lower end 94 of the lower receiver assembly generally rectangular-parallelepiped-shaped extractor 92 of the lower receiver assembly 18.

The lower receiver assembly 18 further includes a lower receiver assembly lower receiver horizontal movable rack 104 that has a lower receiver assembly movable rack rearmost end laterally-and-inwardly-oriented and cylindrically-shaped stud 106 that faces laterally perpendicularly inwardly from the rearmost end of the lower receiver assembly horizontal movable rack 104 of the lower receiver assembly 18.

The lower assembly lower receiver horizontal movable rack 104 of the lower receiver 18 is replaceably and slidably mounted, for forward and rearward movement, in the lower receiver assembly lower receiver vertical wall inner surface horizontal movable rack raceway slot 82 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18, with the lower receiver assembly movable rack rearmost end laterally-and-inwardly-oriented and cylindrically-shaped stud 106 of the lower receiver assembly horizontal movable rack 104 of the lower receiver 18 positioned towards the lower receiver assembly lower receiver rounded rear 62 of the lower receiver assembly generally rectangular-shaped lower receiver 58 of the lower receiver assembly 18 and facing inwardly towards the lower receiver assembly horizontal stationary rack 86 of the lower receiver 18.

During take down, the lower receiver assembly horizontal movable rack 104 of the lower receiver 18 can be slid out of the lower receiver assembly lower receiver vertical wall inner surface horizontal movable rack raceway slot 82 in the lower receiver assembly lower receiver vertical wall inner surface 78 of the appropriate wall of the lower receiver assembly lower receiver pair of parallel and opposing vertical walls 76 of the lower receiver assembly generally rectangular-shaped lower receiver 58 of the lower receiver assembly 18 to be readily serviced or replaced, if necessary.

The lower receiver assembly 18 further includes a lower receiver assembly horizontal pinion 108 that has a lower receiver assembly pinion vertical guide shaft 110 that extends perpendicularly downwardly from the center-thereof and which has a lower receiver assembly pinion guide shaft lower end 112 with a lower receiver assembly pinion guide shaft lower end laterally-oriented and threaded throughbore 114 that extends laterally therethrough.

The lower receiver assembly horizontal pinion 108 of the lower receiver assembly 18 further has a lower receiver assembly pinion centrally and longitudinally disposed threaded throughbore 115 that extends centrally and longitudinally therethrough and centrally and longitudinally into the lower receiver assembly pinion vertical guide shaft 110 of the lower receiver assembly horizontal pinion 108 of the lower receiver assembly 18.

The lower receiver assembly pinion vertical guide shaft 110 of the lower receiver assembly horizontal pinion 108 of the lower receiver assembly 18 extends freely downwardly through the lower receiver assembly lower receiver top low area pinion guide throughslot 72 in the lower receiver assembly lower receiver top low area 69 in the lower receiver assembly lower receiver horizontal top 64 of the lower receiver assembly generally rectangular-shaped lower receiver 58 of the lower receiver assembly 18 and is freely rotatable therein while being freely movable forwardly and rearwardly therealong, with the lower receiver assembly pinion guide shaft lower end laterally-oriented and threaded throughbore 114 in the lower receiver assembly pinion guide shaft lower end 112 of the lower receiver assembly pinion vertical guide shaft 110 of the lower receiver assembly horizontal pinion 108 of the lower receiver assembly 18 positioned therebelow, and with the lower receiver assembly horizontal pinion 108 of the lower receiver assembly 18 operatively engaging both the lower receiver assembly horizontal stationary rack 86 of the lower receiver 18 and the lower receiver assembly horizontal movable rack 104 of the lower receiver assembly 18.

The lower receiver assembly 18 further includes a lower receiver assembly slender and cylindrically-shaped finger lever 116 that has a lower receiver assembly finger lever threaded proximal end 118 that threadably engages the lower receiver assembly pinion guide shaft lower end laterally-oriented and threaded throughbore 114 in the lower receiver assembly pinion guide shaft lower end 112 of the lower receiver assembly pinion vertical guide shaft 110 of the lower receiver assembly horizontal pinion 108, and a lower receiver assembly finger lever spherical-shaped free distal end 120 that is spherically shaped to prevent possible injury to a user's hand.

The lower receiver assembly slender and cylindrically-shaped finger lever 116 of the lower receiver assembly 18 is rotatable, both clockwise and counterclockwise, in a generally horizontal plane that is substantially parallel to the lower receiver assembly lower receiver horizontal bottom 65 of the lower receiver assembly generally rectangular-shaped lower receiver 58 of the lower receiver assembly 18.

The lower receiver assembly 18 further includes a lower receiver assembly generally rectangular-shaped action plate 122 that has a lower receiver assembly action plate horizontal top 124, a lower receiver assembly action plate horizontal bottom 126 that is disposed below the lower receiver assembly action plate horizontal top 124 of the lower receiver assembly generally rectangular-shaped action plate 122 of the lower receiver assembly 18, a lower receiver assembly action plate pair of parallel sides 127, a lower receiver assembly action plate rear 128, and a lower receiver assembly action plate front 129 that is disposed forward of, and parallel to, the lower receiver assembly action plate rear 128 of the lower receiver assembly action plate 122 of the lower receiver assembly 18.

The lower receiver assembly generally rectangular-shaped action plate 122 of the lower receiver assembly 18 further has a lower receiver assembly action plate generally centrally disposed and non-threaded action plate mounting throughbore 130 that extends vertical therethrough from the lower receiver assembly action plate horizontal top 124 of the lower receiver assembly generally rectangular-shaped action plate 122 of the lower receiver assembly 18 to the lower receiver assembly action plate horizontal bottom 126 of the lower receiver assembly generally rectangular-shaped action plate 122 of the lower receiver assembly 18, in proximity to the lower receiver assembly action plate rear 128 of the lower receiver assembly generally rectangular-shaped action plate 122 of the lower receiver assembly 18.

The lower receiver assembly action plate horizontal top 124 of the lower receiver assembly generally rectangular-shaped action plate 122 of the lower receiver assembly 18 has a lower receiver assembly action plate top generally centrally disposed and non-threaded action plate mounting counter-bore 132 that is concentric with the lower receiver assembly action plate generally centrally disposed and non-threaded action plate mounting throughbore 130 in the lower receiver assembly generally rectangular-shaped action plate 122 of the lower receiver assembly 18.

The lower receiver assembly generally rectangular-shaped action plate 122 of the lower receiver assembly 18 further has a lower receiver assembly action plate threaded action plate take down throughbore 134 that extends therethrough from the lower receiver assembly action plate horizontal top 124 of the lower receiver assembly generally rectangular-shaped action plate 122 of the lower receiver assembly 18 to the lower receiver assembly action plate horizontal bottom 126 of the lower receiver assembly generally rectangular-shaped action plate 122 of the lower receiver assembly 18, between the lower receiver assembly action plate front 129 of the lower receiver assembly generally rectangular-shaped action plate 122 of the lower receiver assembly 18 and the lower receiver assembly action plate generally centrally disposed and non-threaded action plate mounting throughbore 130 in the lower receiver assembly generally rectangular-shaped action plate 122 of the lower receiver assembly 18.

The lower receiver assembly action plate rear 128 of the lower receiver assembly generally rectangular-shaped action plate 122 of the lower receiver assembly 18 has extending rearwardly from the general center thereof, a lower receiver assembly action plate rear generally rectangular-shaped cocking boss extension 136 that is co-planar with the lower receiver assembly generally rectangular-shaped action plate 122 of the lower receiver assembly 18 and which terminates in a lower receiver assembly action plate rear cocking boss extension cocking boss 138.

The lower receiver assembly action plate rear generally rectangular-shaped cocking boss extension 136 of the lower receiver assembly action plate rear 128 of the lower receiver assembly generally rectangular-shaped action plate 122 of the lower receiver assembly 18 has a width less than that of the lower receiver assembly action plate rear 128 of the lower receiver assembly generally rectangular-shaped action plate 122 of the lower receiver assembly 18 so as to form a lower receiver assembly action plate rear extractor boss 140 on one side thereof.

The lower receiver assembly action plate pair of parallel sides 127 of the lower receiver assembly generally rectangular-shaped action plate 122 of the lower receiver assembly 18 are forwardly and rearwardly slidable, and replaceably positioned, in the lower receiver assembly lower receiver vertical wall inner surface horizontal action plate raceway slot 80 in the lower receiver assembly lower receiver pair of parallel and opposing vertical walls 76 of the lower receiver assembly generally rectangular-shaped lower receiver 58 of the lower receiver assembly 18, with the lower receiver assembly action plate rear extractor boss 140 of the lower receiver assembly action plate rear 128 of the lower receiver assembly generally rectangular-shaped action plate 122 of the lower receiver assembly 18 facing rearwardly and being abutable against the lower receiver assembly extractor front 100 of the lower receiver assembly generally rectangular-parallelepiped-shaped extractor 92 of the lower receiver assembly 18.

The lower receiver assembly generally rectangular-shaped action plate 122 of the lower receiver assembly 18 is replaceably attached to the lower receiver assembly horizontal pinion 108 of the lower receiver assembly 18 by a lower receiver action plate mounting screw 142.

The action plate mounting screw 142 of the lower receiver assembly 18 extends freely vertically through the lower receiver assembly action plate generally centrally disposed and non-threaded action plate mounting throughbore 130 in the lower receiver assembly generally rectangular-shaped action plate 122 of the lower receiver assembly 18 and threadably engages the lower receiver assembly pinion centrally and longitudinally disposed threaded throughbore 115 in the lower receiver assembly horizontal pinion 108 of the lower receiver assembly 18, with the head of the action plate mounting screw 142 of the lower receiver assembly 18 sitting unobstructingly in the lower receiver assembly action plate top generally centrally disposed and non-threaded action plate mounting counter-bore 132 in the lower receiver assembly action plate horizontal top 124 of the lower receiver assembly generally rectangular-shaped action plate 122 of the lower receiver assembly 18, and with the lower receiver assembly horizontal pinion 108 of the lower receiver assembly 18 being free to rotate clockwise and counterclockwise relative to the lower receiver assembly generally rectangular-shaped action plate 122 of the lower receiver assembly 18.

The lower receiver assembly 18 further includes a lower receiver assembly take down screw sub-assembly 144 that includes a lower receiver assembly take down screw sub-assembly screw 146 that has a lower receiver assembly take down screw sub-assembly screw hollow and externally-threaded shaft 148.

The lower receiver assembly take down screw sub-assembly 144 of the lower receiver assembly 18 further includes a lower receiver assembly take down screw sub-assembly plunger 150 that is slidably positioned in, and slidably extendable from, the lower receiver assembly take down screw sub-assembly screw hollow and externally-threaded shaft 148 of the lower receiver assembly take down screw sub-assembly screw 146 of the lower receiver assembly take down screw sub-assembly 144 of the lower receiver assembly 18 and is biased by a lower receiver assembly take down screw sub-assembly spring 152 that is also contained therein.

The head of the lower receiver assembly take down screw sub-assembly screw 146 of the lower receiver assembly take down screw sub-assembly 144 of the lower receiver assembly 18 is positioned unobstructingly in the lower receiver assembly lower receiver top low area pinion guide through-slot 72 in the lower receiver assembly lower receiver top low area 69 in the lower receiver assembly lower receiver horizontal top 64 of the lower receiver assembly generally rectangular-shaped lower receiver 58 of the lower receiver assembly 18 and is freely movable forwardly and rearwardly therealong, with the lower receiver assembly take down screw sub-assembly screw hollow and externally-threaded shaft 148 of the lower receiver assembly take down screw sub-assembly screw 146 of the lower receiver assembly take down screw sub-assembly 144 of the lower receiver assembly 18 vertically threadably engaging the lower receiver assembly action plate threaded action plate take down throughbore 134 in the lower receiver assembly generally rectangular-shaped action plate 122 of the lower receiver assembly 18 and thereby being forwardly and rearwardly movable therewith, and with the lower receiver assembly take down screw sub-assembly plunger 150 of the lower receiver assembly take down screw sub-assembly 144 of the lower receiver assembly 18 being replaceably engagable with either detent of the upper receiver assembly body horizontal bottom pair of spaced-apart and longitudinally oriented take down screw plunger detents 49 in the upper receiver assembly body horizontal bottom 32 of the upper receiver assembly generally rectangular-parallelepiped-shaped body 24 of the upper receiver assembly 16 by virtue of the biasing of the lower receiver assembly take down screw sub-assembly spring 152 of the lower receiver assembly take down screw sub-assembly 144 of the lower receiver assembly 18.

The breech block assembly 20 includes a breech block assembly hollow and generally rectangular-parallelepiped-shaped breech block 154 that has a breech block assembly breech block horizontal and concave-shaped top 156, a breech block assembly breech block open bottom 158 that is disposed below the breech block assembly breech block horizontal and concave-shaped top 156 of the breech block assembly hollow and generally rectangular-parallelepiped-shaped breech block 154 of the breech block assembly 20, a breech block assembly breech block vertical and closed back 160, a breech block assembly breech block vertical and substantially open front 162 that is disposed in front of the breech block assembly breech block vertical and closed back 160 of the breech block assembly hollow and generally rectangular-parallelepiped-shaped breech block 154 of the breech block assembly 20, and a breech block assembly breech block pair of parallel, vertical, and opposing sides 164.

The breech block assembly hollow and generally rectangular-parallelepiped-shaped breech block 154 of the breech block assembly 20 contains a breech block assembly breech block generally rectangular-parallelepiped-shaped internal chamber 166 that opens into both the breech block assembly block open bottom 158 of the breech block assembly hollow and generally rectangular-parallelepiped-shaped breech block 154 of the breech block assembly 20 and the breech block assembly breech block vertical and substantially open front 162 of the breech block assembly hollow and generally rectangular-parallelepiped-shaped breech block 154 of the breech block assembly 20.

The breech block assembly breech block vertical and substantially open front 162 of the breech block assembly hollow and generally rectangular-parallelepiped-shaped breech block 154 of the breech block assembly 20 has a breech block assembly breech block front firing pin tip throughbore 168 that extends horizontally therethrough and is disposed between the lowest point of the breech block assembly breech block horizontal and concave-shaped top 156 of the breech block assembly hollow and generally rectangular-parallelepiped-shaped breech block 154 of the breech block assembly 20 and the top border of the opening in the breech block assembly breech block vertical and substantially open front 162 of the breech block assembly hollow and generally rectangular-parallelepiped-shaped breech block 154 of the breech block assembly 20.

The breech block assembly breech block vertical and closed back 160 of the breech block assembly hollow and generally rectangular-parallelepiped-shaped breech block 154 of the breech block assembly 20 has a breech block assembly breech block back inner surface 170 with a breech block assembly breech block back inner surface firing pin spring seat bore 172 that is in horizontal alignment with the breech block assembly breech block front firing pin tip throughbore 168 in the breech block assembly breech block vertical and substantially open front 162 of the breech block assembly hollow and generally rectangular-parallelepiped-shaped breech block 154 of the breech block assembly 20.

Each side of the breech block assembly breech block pair of parallel, vertical, and opposing sides 164 of the breech block assembly hollow and generally rectangular-parallelepiped-shaped breech block 154 of the breech block assembly 20 has a breech block assembly breech block side inner surface 174 that has extending continuously horizontally therealong a breech block assembly breech block side inner surface trigger safety raceway 176.

The breech block assembly breech block side inner surface trigger safety raceway 176 of the breech block assembly breech block side inner surface 174 of each side of the breech block assembly breech block pair of parallel, vertical, and opposing sides 164 of the breech block assembly hollow and generally rectangular-parallelepiped-shaped breech block 154 of the breech block assembly 20 are parallel to each other, and open into, and extend continuously horizontally from, the breech block assembly breech block vertical and substantially open front 162 of the breech block assembly hollow and generally rectangular-parallelepiped-shaped breech block 154 of the breech block assembly 20 to the breech block assembly breech block vertical and closed back 160 of the breech block assembly hollow and generally rectangular-parallelepiped-shaped breech block 154 of the breech block assembly 20 in an orientation that is parallel to, and slightly above, the breech block assembly block open bottom 158 of the breech block assembly hollow and generally rectangular-parallelepiped-shaped breech block 154 of the breech block assembly 20.

The breech block assembly breech block side inner surface 174 of one side of the breech block assembly breech block pair of parallel, vertical, and opposing sides 164 of the breech block assembly hollow and generally rectangular-parallelepiped-shaped breech block 154 of the breech block assembly 20 has a breech block assembly breech block side inner surface pair of spaced-apart trigger safety plunger detents 178 that are spaced horizontally therealong between the breech block assembly block open bottom 158 of the breech block assembly hollow and generally rectangular-parallelepiped-shaped breech block 154 of the breech block assembly 20 and the breech block assembly breech block side inner surface trigger safety raceway 176 of the breech block assembly breech block side inner surface 174 of the appropriate side of the breech block assembly breech block pair of parallel, vertical, and opposing sides 164 of the breech block assembly hollow and generally rectangular-parallelepiped-shaped breech block 154 of the breech block assembly 20, in proximity to the breech block assembly breech block vertical and substantially open front 162 of the breech block assembly hollow and generally rectangular-parallelepiped-shaped breech block 154 of the breech block assembly 20.

The side of the breech block assembly breech block pair of parallel, vertical, and opposing sides 164 of the breech block assembly hollow and generally rectangular-parallelepiped-shaped breech block 154 of the breech block assembly 20 that does not have the breech block assembly breech block side inner surface pair of spaced-apart trigger safety plunger detents 178 of the breech block assembly breech block side inner surface 174 of the appropriate side of the breech block assembly breech block pair of parallel, vertical, and opposing sides 164 of the breech block assembly hollow and generally rectangular-parallelepiped-shaped breech block 154 of the breech block assembly 20 disposed thereon, has a breech block assembly breech block side outer surface 180 with a breech block assembly breech block side outer surface movable rack stud slot 182 that opens into both, and extends continuously between, the breech block assembly breech block vertical and substantially open front 162 of the breech block assembly hollow and generally rectangular-parallelepiped-shaped breech block 154 of the breech block assembly 20 and the breech block assembly breech block vertical and closed back 160 of the breech block assembly hollow and generally rectangular-parallelepiped-shaped breech block 154 of the breech block assembly 20.

The breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 has a breech block assembly breech block side outer surface movable rack stud slot horizontal front portion 184, that is wider than, and in general horizontal alignment with, the breech block assembly breech block side inner surface trigger safety raceway 176 of the breech block assembly breech block side inner surface 174 of the respective side of the breech block assembly breech block pair of parallel, vertical, and opposing sides 164 of the breech block assembly hollow and generally rectangular-parallelepiped-shaped breech block 154 of the breech block assembly 20, and opens into, and extends continuously horizontally rearwardly from, the breech block assembly breech block vertical and substantially open front 162 of the breech block assembly hollow and generally rectangular-parallelepiped-shaped breech block 154 of the breech block assembly 20.

The breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 further has a breech block assembly breech block side outer surface movable rack stud slot inclined intermediate portion 186 that opens into, and extends continuously rearwardly and upwardly from, the rear end of the breech block assembly breech block side outer surface movable rack stud slot horizontal front portion 184 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20.

The breech block assembly breech block side outer surface movable rack stud slot inclined intermediate portion 186 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 can be oriented at about 45 degrees.

It is to be understood, however, that the 45 degree orientation of the breech block assembly breech block side outer surface movable rack stud slot inclined intermediate portion 186 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 is illustrative only and can vary depending on the dimensions of the breech block assembly hollow and generally rectangular-parallelepiped-shaped breech block 154 of the breech block assembly 20 so as to optimize the operation of the present invention.

The breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 further has a breech block assembly breech block side outer surface movable rack stud slot horizontal rear portion 188 that opens into, and extends continuously rearwardly from, the rear end of the breech block assembly breech block side outer surface movable rack stud slot inclined intermediate portion 186 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 and opens into the breech block assembly breech block vertical and closed back 160 of the breech block assembly hollow and generally rectangular-parallelepiped-shaped breech block 154 of the breech block assembly 20.

The breech block assembly breech block side outer surface movable rack stud slot horizontal rear portion 188 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20 is disposed above, parallel to, and longer than, the breech block assembly breech block side outer surface movable rack stud slot horizontal front portion 184 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20.

The breech block assembly hollow and generally rectangular-parallelepiped-shaped breech block 154 of the breech block assembly 20 further has a breech block assembly breech block side pair of trigger assembly mounting throughbores 190 that extend horizontally through both sides of the breech block assembly breech block pair of parallel, vertical, and opposing sides 164 of the breech block assembly hollow and generally rectangular-parallelepiped-shaped breech block 154 of the breech block assembly 20, and straddle the breech block assembly breech block side outer surface movable rack stud slot horizontal rear portion 188 of the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20.

The breech block assembly 20 further includes a breech block assembly firing pin 192 that has a breech block assembly firing pin generally rectangular-parallelepiped-shaped main portion 194 with a breech block assembly firing pin main portion slightly convex-shaped and vertical front 196, a breech block assembly firing pin main portion slightly convex-shaped and vertical rear 198 that is disposed behind the breech block assembly firing pin main portion slightly convex-shaped and vertical front 196 of the breech block assembly firing pin generally rectangular-parallelepiped-shaped main portion 194 of the breech block assembly firing pin 192 of the breech block assembly 20 and has a breech block assembly firing pin main portion rear outer surface 200 with a breech block assembly firing pin main portion rear outer surface generally centrally-disposed firing pin seat bore 204, a breech block assembly firing pin main portion horizontal bottom 206, and a breech block assembly firing pin main portion pair of vertical and opposing sides 207 that extend from the breech block assembly firing pin main portion slightly convex-shaped and vertical front 196 of the breech block assembly firing pin generally rectangular-parallelepiped-shaped main portion 194 of the breech block assembly firing pin 192 of the breech block assembly 20 to the breech block assembly firing pin main portion slightly convex-shaped and vertical rear 198 of the breech block assembly firing pin generally rectangular-parallelepiped-shaped main portion 194 of the breech block assembly firing pin 192 of the breech block assembly 20.

The breech block assembly firing pin generally rectangular-parallelepiped-shaped main portion 194 of the breech block assembly firing pin 192 of the breech block assembly 20 further has a width less than that of the breech block assembly breech block generally rectangular-parallelepiped-shaped internal chamber 166 in the breech block assembly hollow and generally rectangular-parallelepiped-shaped breech block 154 of the breech block assembly 20 so as to be readily forwardly and rearwardly slidable therein.

The breech block assembly firing pin 192 of the breech block assembly 20 further has a breech block assembly firing pin generally convexo-concave and vertical cocking portion 208 that extends vertically downwardly from the breech block assembly firing pin main portion horizontal bottom 206 of the breech block assembly firing pin generally rectangular-parallelepiped-shaped main portion 194 of the breech block assembly firing pin 192 of the breech block assembly 20 and has a breech block assembly firing pin cocking portion front convex cocking surface 210 is in vertical alignment with the breech block assembly firing pin main portion slightly convex-shaped and vertical front 196 of the breech block assembly firing pin generally rectangular-parallelepiped-shaped main portion 194 of the breech block assembly firing pin 192 of the breech block assembly 20.

The breech block assembly firing pin 192 of the breech block assembly 20 further has a breech block assembly firing pin tip 212 that extends horizontally outwardly from the breech block assembly firing pin main portion slightly convex-shaped and vertical front 196 of the breech block assembly firing pin generally rectangular-parallelepiped-shaped main portion 194 of the breech block assembly firing pin 192 of the breech block assembly 20, in horizontal alignment with the breech block assembly firing pin main portion rear outer surface generally centrally-disposed firing pin seat bore 204 in the breech block assembly firing pin main portion rear outer surface 200 of the breech block assembly firing pin main portion slightly convex-shaped and vertical rear 198 of the breech block assembly firing pin generally rectangular-parallelepiped-shaped main portion 194 of the breech block assembly firing pin 192 of the breech block assembly 20.

The breech block assembly firing pin main portion horizontal bottom 206 of the breech block assembly firing pin generally rectangular-parallelepiped-shaped main portion 194 of the breech block assembly firing pin 192 of the breech block assembly 20 has a breech block assembly firing pin main portion bottom inwardly-and-upwardly-tapering sear recess 213 that extends horizontally rearwardly from a breech block assembly firing pin cocking portion rear concave surface 214 of the breech block assembly firing pin generally convexo-concave and vertical cocking portion 208 of the breech block assembly firing pin 192 of the breech block assembly 20 to the substantial midpoint of the breech block assembly firing pin main portion horizontal bottom 206 of the breech block assembly firing pin generally rectangular-parallelepiped-shaped main portion 194 of the breech block assembly firing pin 192 of the breech block assembly 20 and which opens into both, and extends continuously horizontally between, the breech block assembly firing pin main portion pair of vertical and opposing sides 207 of the breech block assembly firing pin generally rectangular-parallelepiped-shaped main portion 194 of the breech block assembly firing pin 192 of the breech block assembly 20.

The breech block assembly firing pin 192 of the breech block assembly 20 further has a breech block assembly firing pin spring 216 with a breech block assembly firing pin spring front end 218 that sits horizontally in the breech block assembly firing pin main portion rear outer surface generally centrally-disposed firing pin seat bore 204 in the breech block assembly firing pin main portion rear outer surface 200 of the breech block assembly firing pin main portion slightly convex-shaped and vertical rear 198 of the breech block assembly firing pin generally rectangular-parallelepiped-shaped main portion 194 of the breech block assembly firing pin 192 of the breech block assembly 20, and a breech block assembly firing pin spring rear end 220.

The breech block assembly firing pin 192 of the breech block assembly 20 is positioned in the breech block assembly breech block generally rectangular-parallelepiped-shaped internal chamber 166 in the breech block assembly hollow and generally rectangular-parallelepiped-shaped breech block 154 of the breech block assembly 20 for forward and rearward slidable movement relative thereto, with the breech block assembly firing pin tip 212 of the breech block assembly firing pin 192 of the breech block assembly 20 in horizontal alignment with the breech block assembly breech block front firing pin tip throughbore 168 in the breech block assembly breech block vertical and substantially open front 162 of the breech block assembly hollow and generally rectangular-parallelepiped-shaped breech block 154 of the breech block assembly 20, and with the breech block assembly firing pin spring rear end 220 of the breech block assembly firing pin spring 216 of the breech block assembly firing pin 192 of the breech block assembly 20 sitting in the breech block assembly breech block back inner surface firing pin spring seat bore 172 in the breech block assembly breech block back inner surface 170 of the breech block assembly breech block vertical and closed back 160 of the breech block assembly hollow and generally rectangular-parallelepiped-shaped breech block 154 of the breech block assembly 20, so that the breech block assembly firing pin 192 of the breech block assembly 20 is biased therein by virtue of the breech block assembly firing pin spring 216 of the breech block assembly firing pin 192 of the breech block assembly 20.

The breech block assembly hollow and generally rectangular-parallelepiped-shaped breech block 154 of the breech block assembly 20 is vertically slidably positioned in the lower receiver assembly lower receiver top low area throughraceway 70 in the lower receiver assembly lower receiver top low area 69 in the lower receiver assembly lower receiver horizontal top 64 of the lower receiver assembly generally rectangular-shaped lower receiver 58 of the lower receiver assembly 18 and the upper receiver assembly body breech block throughraceway 38 of the upper receiver assembly generally rectangular-parallelepiped-shaped body 24 of the upper receiver assembly 16, with the lower receiver assembly movable rack rearmost end laterally-and-inwardly-oriented and cylindrically-shaped stud 106 of the lower receiver assembly horizontal movable rack 104 of the lower receiver 18 being replaceably slidably engagable with the breech block assembly breech block side outer surface movable rack stud slot 182 in the breech block assembly breech block side outer surface 180 of the appropriate side of the breech block assembly breech block pair of parallel, vertical, and opposing sides 164 of the breech block assembly hollow and generally rectangular-parallelepiped-shaped breech block 154 of the breech block assembly 20.

The trigger assembly 22 includes a trigger assembly generally rectangular-parallelepiped-shaped trigger housing 222 that has a trigger assembly trigger housing horizontal top 224, a trigger assembly trigger housing open bottom 226 that is disposed below the trigger assembly trigger housing horizontal top 224 of the trigger assembly generally rectangular-parallelepiped-shaped trigger housing 222 of the trigger assembly 22, a trigger assembly trigger housing vertical closed rear 228, and a trigger assembly trigger housing vertical front 230 that is disposed forward of the trigger assembly trigger housing vertical closed rear 228 of the trigger assembly generally rectangular-parallelepiped-shaped trigger housing 222 of the trigger assembly 22.

The trigger assembly generally rectangular-parallelepiped-shaped trigger housing 222 of the trigger assembly 22 further has a trigger assembly trigger housing pair of opposing, parallel, and vertical sides 232 that extend from the trigger assembly trigger housing open bottom 226 of the trigger assembly generally rectangular-parallelepiped-shaped trigger housing 222 of the trigger assembly 22 past the trigger assembly trigger housing horizontal top 224 of the trigger assembly generally rectangular-parallelepiped-shaped trigger housing 222 of the trigger assembly 22 and forms therewith a trigger assembly trigger housing top pair of horizontal firing pin guide lips 234.

The trigger assembly trigger housing top pair of horizontal firing pin guide lips 234 of the trigger assembly trigger housing horizontal top 224 of the trigger assembly generally rectangular-parallelepiped-shaped trigger housing 222 of the trigger assembly 22 extend horizontally from the trigger assembly trigger housing vertical front 230 of the trigger assembly generally rectangular-parallelepiped-shaped trigger housing 222 of the trigger assembly 22 to the trigger assembly trigger housing vertical closed rear 228 of the trigger assembly generally rectangular-parallelepiped-shaped trigger housing 222 of the trigger assembly 22.

The trigger assembly generally rectangular-parallelepiped-shaped trigger housing 222 of the trigger assembly 22 further has a trigger assembly trigger housing substantially T-shaped sear throughraceway 236 that extends vertically continuously between, and open into both, the trigger assembly trigger housing horizontal top 224 of the trigger assembly generally rectangular-parallelepiped-shaped trigger housing 222 of the trigger assembly 22 and the trigger assembly trigger housing open bottom 226 of the trigger assembly generally rectangular-parallelepiped-shaped trigger housing 222 of the trigger assembly 22, and which also opens into the trigger assembly trigger housing vertical front 230 of the trigger assembly generally rectangular-parallelepiped-shaped trigger housing 222 of the trigger assembly 22.

Each side of the trigger assembly trigger housing pair of opposing, parallel, and vertical sides 232 of the trigger assembly generally rectangular-parallelepiped-shaped trigger housing 222 of the trigger assembly 22 has a trigger assembly trigger housing vertical side rectangular-shaped and horizontal sear spring brace throughslot 238 that are horizontally aligned with each other and open into both the trigger assembly trigger housing vertical front 230 of the trigger assembly generally rectangular-parallelepiped-shaped trigger housing 222 of the trigger assembly 22 and the trigger assembly trigger housing substantially T-shaped sear throughraceway 236 of the trigger assembly generally rectangular-parallelepiped-shaped trigger housing 222 of the trigger assembly 22.

Each side of the trigger assembly trigger housing pair of opposing, parallel, and vertical sides 232 of the trigger assembly generally rectangular-parallelepiped-shaped trigger housing 222 of the trigger assembly 22 further has a trigger assembly trigger housing vertical side pair of trigger housing mounting throughbores 240 that are horizontally aligned with each other and with the breech block assembly breech block side pair of trigger assembly mounting throughbores 190 in the breech block assembly hollow and generally rectangular-parallelepiped-shaped breech block 154 of the breech block assembly 20.

The trigger assembly 22 further includes a trigger assembly sear 242 that has a substantially T-shaped lateral cross section which is similar to that of the trigger assembly trigger housing substantially T-shaped sear throughraceway 236 of the trigger assembly generally rectangular-parallelepiped-shaped trigger housing 222 of the trigger assembly 22, so that the trigger assembly sear 242 of the trigger assembly 22 is vertically slidable therein.

The trigger assembly sear 242 of the trigger assembly 22 has a trigger assembly sear horizontal top 244, a trigger assembly sear horizontal bottom 246 that is disposed below the trigger assembly sear horizontal top 244 of the trigger assembly sear 242 of the trigger assembly 22, a trigger assembly sear vertical front 248, a trigger assembly sear pair of opposing, parallel, and vertical sides 250 that extend vertically from the trigger assembly sear horizontal top 244 of the trigger assembly sear 242 of the trigger assembly 22 to the trigger assembly sear horizontal bottom 246 of the trigger assembly sear 242 of the trigger assembly 22, and a trigger assembly sear vertical rear 251 that is disposed behind the trigger assembly rear vertical front 248 of the trigger assembly sear 242 of the trigger assembly 22.

The trigger assembly sear horizontal top 244 of the trigger assembly sear 242 of the trigger assembly 22 has a trigger assembly sear horizontal top inwardly-and-upwardly-tapering projection 252 that extends horizontally rearwardly from the trigger assembly sear vertical front 248 of the trigger assembly sear 242 of the trigger assembly 22 to the substantial midpoint of the trigger assembly sear horizontal top 244 of the trigger assembly sear 242 of the trigger assembly 22, and which extends horizontally between, the trigger assembly sear pair of opposing, parallel, and vertical sides 250 of the trigger assembly sear 242 of the trigger assembly 22, and which is similar to the breech block assembly firing pin main portion bottom inwardly-and-upwardly-tapering sear recess 213 of the breech block assembly firing pin main portion horizontal bottom 206 of the breech block assembly firing pin generally rectangular-parallelepiped-shaped main portion 194 of the breech block assembly firing pin 192 of the breech block assembly 20 so as to be replaceably engagable therein.

The trigger assembly sear horizontal bottom 246 of the trigger assembly sear 242 of the trigger assembly 22 has a trigger assembly sear horizontal bottom rectangular-parallelepiped-shaped sear spring recess 254 that extends perpendicularly upwardly therefrom to the substantial midpoint of, and opens into, the trigger assembly sear pair of opposing, parallel, and vertical sides 250 of the trigger assembly sear 242 of the trigger assembly 22, and which is disposed between, and parallel to, the trigger assembly sear vertical front 248 of the trigger assembly sear 242 of the trigger assembly 22 and the trigger assembly sear vertical rear 251 of the trigger assembly sear 242 of the trigger assembly 22.

The trigger assembly sear 242 of the trigger assembly 22 further has a trigger assembly sear spring 256 that is disposed vertically in the trigger assembly sear horizontal bottom rectangular-parallelepiped-shaped sear spring recess 254 in the trigger assembly sear horizontal bottom 246 of the trigger assembly sear 242 of the trigger assembly 22, and which has a trigger assembly sear spring upper end 257 that sits in a recess in the upper horizontal border of the trigger assembly sear horizontal bottom rectangular-parallelepiped-shaped sear spring recess 254 in the trigger assembly sear horizontal bottom 246 of the trigger assembly sear 242 of the trigger assembly 22.

The trigger assembly sear 242 of the trigger assembly 22 further has a trigger assembly sear spring horizontal brace 258 that has a recess therein in which a trigger assembly sear spring lower end 260 of the trigger assembly sear spring 256 of the trigger assembly sear 242 of the trigger assembly 22 sits.

The trigger assembly sear 242 of the trigger assembly 22 is vertically slidably positioned in the trigger assembly trigger housing substantially T-shaped sear throughraceway 236 of the trigger assembly generally rectangular-parallelepiped-shaped trigger housing 222 of the trigger assembly 22, with the trigger assembly sear spring horizontal brace 258 of the trigger assembly sear 242 of the trigger assembly 22 replaceably engaged in the trigger assembly trigger housing vertical side rectangular-shaped and horizontal sear spring brace throughslot 238 in each of the trigger assembly trigger housing pair of opposing, parallel, and vertical sides 232 of the trigger assembly generally rectangular-parallelepiped-shaped trigger housing 222 of the trigger assembly 22, and with the trigger assembly sear 242 of the trigger assembly 22 thereby being biased therein by virtue of the trigger assembly sear spring 256 of the trigger assembly sear 242 of the trigger assembly 22.

The trigger assembly 22 further includes a trigger assembly generally concavo-convex-shaped vertical trigger 262 that has a trigger assembly trigger horizontal top 264, a trigger assembly trigger vertical front 266, a trigger assembly trigger vertical rear 267 that is disposed behind the trigger assembly trigger vertical front 266 of the trigger assembly generally concavo-convex-shaped vertical trigger 262 of the trigger assembly 22, a trigger assembly trigger pair of opposing vertical sides 268, and a trigger assembly trigger rectangular-parallelepiped-shaped block 270 that extends vertically upwardly from the trigger assembly trigger horizontal top 264 of the trigger assembly generally concavo-convex-shaped vertical trigger 262 of the trigger assembly 22 and horizontally rearwardly from the trigger assembly trigger vertical front 266 of the trigger assembly generally concavo-convex-shaped vertical trigger 262 of the trigger assembly 22 to the substantial midpoint of the trigger assembly trigger horizontal top 264 of the trigger assembly generally concavo-convex-shaped vertical trigger 262 of the trigger assembly 22 and laterally from one side of the trigger assembly trigger pair of opposing vertical sides 268 of the trigger assembly generally concavo-convex-shaped vertical trigger 262 of the trigger assembly 22 to another side of the trigger assembly trigger pair of opposing vertical sides 268 of the trigger assembly generally concavo-convex-shaped vertical trigger 262 of the trigger assembly 22.

The trigger assembly trigger rectangular-parallelepiped-shaped block 270 of the trigger assembly generally concavo-convex-shaped vertical trigger 262 of the trigger assembly 22 has a trigger assembly trigger block vertical rear 272, and a trigger assembly trigger block horizontal top 274.

The trigger assembly trigger block horizontal top 274 of the trigger assembly trigger rectangular-parallelepiped-shaped block 270 of the trigger assembly generally concavo-convex-shaped vertical trigger 262 of the trigger assembly 22 has a trigger assembly trigger block top horizontal trigger safety recess 276 that extends laterally between, and opens into, the trigger assembly trigger pair of opposing vertical sides 268 of the trigger assembly generally concavo-convex-shaped vertical trigger 262 of the trigger assembly 22, while also opening into the trigger assembly trigger block vertical rear 272 of the trigger assembly generally concavo-convex-shaped vertical trigger 262 of the trigger assembly 22.

The trigger assembly trigger rectangular-parallelepiped-shaped block 270 of the trigger assembly generally concavo-convex-shaped vertical trigger 262 of the trigger assembly 22 further has a trigger assembly trigger block laterally-oriented trigger mounting throughbore 278 that extends laterally therethrough, at the substantial midpoint thereof, from one side of the trigger assembly trigger pair of opposing vertical sides 268 of the trigger assembly generally concavo-convex-shaped vertical trigger 262 of the trigger assembly 22 to the another side of the trigger assembly trigger pair of opposing vertical sides 268 of the trigger assembly generally concavo-convex-shaped vertical trigger 262 of the trigger assembly 22, and which is in horizontal alignment with the lowermost throughbore of the breech block assembly breech block side pair of trigger assembly mounting throughbores 190 in the breech block assembly hollow and generally rectangular-parallelepiped-shaped breech block 154 of the breech block assembly 20.

The trigger assembly 22 further includes a trigger assembly trigger spring 280 that has a trigger assembly trigger spring lower end 282 that sits vertically in a seat in the trigger assembly trigger horizontal top 264 of the trigger assembly generally concavo-convex-shaped vertical trigger 262 of the trigger assembly 22, in proximity to the trigger assembly trigger vertical rear 267 of the trigger assembly generally concavo-convex-shaped vertical trigger 262 of the trigger assembly 22.

The trigger assembly generally rectangular-parallelepiped-shaped trigger housing 222 of the trigger assembly 22 is replaceably positioned in the breech block assembly breech block generally rectangular-parallelepiped-shaped internal chamber 166 in the breech block assembly hollow and generally rectangular-parallelepiped-shaped breech block 154 of the breech block assembly 20, with the breech block assembly firing pin main portion horizontal bottom 206 of the breech block assembly firing pin generally rectangular-parallelepiped-shaped main portion 194 of the breech block assembly firing pin 192 of the breech block assembly 20 forwardly and rearwardly slidably positioned on the trigger assembly trigger housing horizontal top 224 of the trigger assembly generally rectangular-parallelepiped-shaped trigger housing 222 of the trigger assembly 22, and with the trigger assembly trigger housing top pair of horizontal firing pin guide lips 234 of the trigger assembly trigger housing horizontal top 224 of the trigger assembly generally rectangular-parallelepiped-shaped trigger housing 222 of the trigger assembly 22 providing a guide therefor.

The trigger assembly generally rectangular-parallelepiped-shaped trigger housing 222 of the trigger assembly 22 is replaceably maintained in the breech block assembly breech block generally rectangular-parallelepiped-shaped internal chamber 166 in the breech block assembly hollow and generally rectangular-parallelepiped-shaped breech block 154 of the breech block assembly 20 by the uppermost pin of a trigger assembly pair of trigger housing mounting pins 284 that replaceably extends horizontally through the uppermost throughbore of the breech block assembly breech block side pair of trigger assembly mounting throughbores 190 in the breech block assembly hollow and generally rectangular-parallelepiped-shaped breech block 154 of the breech block assembly 20 and the corresponding uppermost throughbore of the trigger assembly trigger housing vertical side pair of trigger housing mounting throughbores 240 in the trigger assembly trigger housing pair of opposing, parallel, and vertical sides 232 of the trigger assembly generally rectangular-parallelepiped-shaped trigger housing 222 of the trigger assembly 22.

The trigger assembly generally concavo-convex-shaped vertical trigger 262 of the trigger assembly 22 is forwardly and rearwardly pivotally positioned in the trigger assembly generally rectangular-parallelepiped-shaped trigger housing 222 of the trigger assembly 22, with the trigger assembly trigger block horizontal top 274 of the trigger assembly trigger rectangular-parallelepiped-shaped block 270 of the trigger assembly generally concavo-convex-shaped vertical trigger 262 of the trigger assembly 22 abutable against, and releasable from, the trigger assembly sear horizontal bottom 246 of the trigger assembly sear 242 of the trigger assembly 22, and with the trigger assembly trigger block laterally-oriented trigger mounting throughbore 278 in the trigger assembly trigger rectangular-parallelepiped-shaped block 270 of the trigger assembly generally concavo-convex-shaped vertical trigger 262 of the trigger assembly 22 in horizontal alignment with the corresponding lowermost throughbores of both the trigger assembly trigger housing vertical side pair of trigger housing mounting throughbores 240 in the trigger assembly trigger housing pair of opposing, parallel, and vertical sides 232 of the trigger assembly generally rectangular-parallelepiped-shaped trigger housing 222 of the trigger assembly 22 and the breech block assembly breech block side pair of trigger assembly mounting throughbores 190 in the breech block assembly hollow and generally rectangular-parallelepiped-shaped breech block 154 of the breech block assembly 20.

The trigger assembly generally concavo-convex-shaped vertical trigger 262 of the trigger assembly 22 is forwardly and rearwardly pivotally maintained in the trigger assembly generally rectangular-parallelepiped-shaped trigger housing 222 of the trigger assembly 22, by the lowermost pin of the trigger assembly pair of trigger housing mounting pins 284 that replaceably extends horizontally through the lowermost throughbore of the breech block assembly breech block side pair of trigger assembly mounting throughbores 190 in the breech block assembly hollow and generally rectangular-parallelepiped-shaped breech block 154 of the breech block assembly 20, through the trigger assembly trigger block laterally-oriented trigger mounting throughbore 278 in the trigger assembly trigger rectangular-parallelepiped-shaped block 270 of the trigger assembly generally concavo-convex-shaped vertical trigger 262 of the trigger assembly 22, and through the corresponding lowermost throughbore of the trigger assembly trigger housing vertical side pair of trigger housing mounting throughbores 240 in the trigger assembly trigger housing pair of opposing, parallel, and vertical sides 232 of the trigger assembly generally rectangular-parallelepiped-shaped trigger housing 222 of the trigger assembly 22, and which thereby also further replaceably maintains the trigger assembly generally rectangular-parallelepiped-shaped trigger housing 222 of the trigger assembly 22 in the breech block assembly breech block generally rectangular-parallelepiped-shaped internal chamber 166 in the breech block assembly hollow and generally rectangular-parallelepiped-shaped breech block 154 of the breech block assembly 20.

The trigger assembly 22 further includes a trigger assembly substantially U-shaped trigger guard 286 that has a trigger assembly trigger guard forwardmost leg 288 with a trigger assembly trigger guard forwardmost leg rectangular-parallelepiped-shaped top 290 that has a trigger assembly trigger guard forwardmost leg top horizontal top 292 with a trigger assembly trigger guard forwardmost leg top horizontal top centrally-disposed and threaded trigger safety mounting bore 294 that extends centrally downwardly therein, and a trigger assembly trigger guard forwardmost leg top vertical side 296 with a trigger assembly trigger guard forwardmost leg top vertical side centrally-disposed horizontal trigger safety plunger bore 298 that extends laterally therein.

The trigger assembly substantially U-shaped trigger guard 286 of the trigger assembly 22 further has a trigger assembly trigger guard trigger safety plunger 300 that is slidably positioned in, and slidably extendable from, the trigger assembly trigger guard forwardmost leg top vertical side centrally-disposed horizontal trigger safety plunger bore 298 in the trigger assembly trigger guard forwardmost leg top vertical side 296 of the trigger assembly trigger guard forwardmost leg rectangular-parallelepiped-shaped top 290 of the trigger assembly trigger guard forwardmost leg 288 of the trigger assembly substantially U-shaped trigger guard 286 of the trigger assembly 22 and is biased by a trigger assembly trigger guard trigger safety plunger spring 302 that is also contained therein and which provides a more positive engagement.

The trigger assembly substantially U-shaped trigger guard 286 of the trigger assembly 22 further has a trigger assembly trigger guard substantially C-shaped horizontal safety plate 304 with a trigger assembly trigger guard safety plate horizontal top 306, a trigger assembly trigger guard safety plate horizontal bottom 308 that is disposed below the trigger assembly trigger guard safety plate horizontal top 306 of the trigger assembly trigger guard substantially C-shaped horizontal safety plate 304 of the trigger assembly substantially U-shaped trigger guard 286 of the trigger assembly 22, a trigger assembly trigger guard safety plate vertical front 310, a trigger assembly trigger guard safety plate vertical rear 312 that is parallel to, disposed behind, and narrower than, the trigger assembly trigger guard safety plate vertical front 310 of the trigger assembly trigger guard substantially C-shaped horizontal safety plate 304 of the trigger assembly substantially U-shaped trigger guard 286 of the trigger assembly 22, and a trigger assembly trigger guard safety plate pair of spaced-apart longitudinal sides 313.

The width of the trigger assembly trigger guard safety plate vertical front 310 of the trigger assembly trigger guard substantially C-shaped horizontal safety plate 304 of the trigger assembly substantially U-shaped trigger guard 286 of the trigger assembly 22 is greater than that of the trigger assembly trigger guard forwardmost leg rectangular-parallelepiped-shaped top 290 of the trigger assembly trigger guard forwardmost leg 288 of the trigger assembly substantially U-shaped trigger guard 286 of the trigger assembly 22 and thereby allowing the trigger assembly trigger guard substantially C-shaped horizontal safety plate 304 of the trigger assembly substantially U-shaped trigger guard 286 of the trigger assembly 22 to laterally overlap the trigger assembly trigger guard forwardmost leg rectangular-parallelepiped-shaped top 290 of the trigger assembly trigger guard forwardmost leg 288 of the trigger assembly substantially U-shaped trigger guard 286 of the trigger assembly 22 an equal amount on both sides thereof.

The trigger assembly trigger guard substantially C-shaped horizontal safety plate 304 of the trigger assembly substantially U-shaped trigger guard 286 of the trigger assembly 22 further has a trigger assembly trigger guard safety plate mounting throughbore 314 that extends vertically therethrough from the trigger assembly trigger guard safety plate horizontal top 306 of the trigger assembly trigger guard substantially C-shaped horizontal safety plate 304 of the trigger assembly substantially U-shaped trigger guard 286 of the trigger assembly 22 to the trigger assembly trigger guard safety plate horizontal bottom 308 of the trigger assembly trigger guard substantially C-shaped horizontal safety plate 304 of the trigger assembly substantially U-shaped trigger guard 286 of the trigger assembly 22, in proximity to the trigger assembly trigger guard safety plate vertical front 310 of the trigger assembly trigger guard substantially C-shaped horizontal safety plate 304 of the trigger assembly substantially U-shaped trigger guard 286 of the trigger assembly 22, and is in vertical alignment with the trigger assembly trigger guard forwardmost leg top horizontal top centrally-disposed and threaded trigger safety mounting bore 294 in the trigger assembly trigger guard forwardmost leg top horizontal top 292 of the trigger assembly trigger guard forwardmost leg rectangular-parallelepiped-shaped top 290 of the trigger assembly trigger guard forwardmost leg 288 of the trigger assembly substantially U-shaped trigger guard 286 of the trigger assembly 22.

The trigger assembly trigger guard safety plate horizontal top 306 of the trigger assembly trigger guard substantially C-shaped horizontal safety plate 304 of the trigger assembly substantially U-shaped trigger guard 286 of the trigger assembly 22 further has a trigger assembly trigger guard top safety plate top safety plate mounting counter-bore 316 that is concentric with the trigger assembly trigger guard safety plate mounting throughbore 314 in the trigger assembly trigger guard substantially C-shaped horizontal safety plate 304 of the trigger assembly substantially U-shaped trigger guard 286 of the trigger assembly 22.

The trigger assembly trigger guard substantially C-shaped horizontal safety plate 304 of the trigger assembly substantially U-shaped trigger guard 286 of the trigger assembly 22 further has a trigger assembly trigger guard safety plate vertical safety boss 318 that is parallel to, and forward of, the trigger assembly trigger guard safety plate vertical rear 312 of the trigger assembly trigger guard trigger substantially C-shaped horizontal safety plate 304 of the trigger assembly substantially U-shaped trigger guard 286 of the trigger assembly 22.

The trigger assembly trigger guard substantially C-shaped horizontal safety plate 304 of the trigger assembly substantially U-shaped trigger guard 286 of the trigger assembly 22 is replaceably mounted to the trigger assembly substantially U-shaped trigger guard 286 of the trigger assembly 22, with the trigger assembly trigger guard safety plate horizontal bottom 308 of the trigger assembly trigger guard substantially C-shaped horizontal safety plate 304 of the trigger assembly substantially U-shaped trigger guard 286 of the trigger assembly 22 in horizontal abutment with the trigger assembly trigger guard forwardmost leg top horizontal top 292 of the trigger assembly trigger guard forwardmost leg rectangular-parallelepiped-shaped top 290 of the trigger assembly trigger guard forwardmost leg 288 of the trigger assembly substantially U-shaped trigger guard 286 of the trigger assembly 22, by a trigger assembly trigger guard safety plate mounting screw 320 that extends vertically through the trigger assembly trigger guard safety plate mounting throughbore 314 in the trigger assembly trigger guard substantially C-shaped horizontal safety plate 304 of the trigger assembly substantially U-shaped trigger guard 286 of the trigger assembly 22 and threadably engages the trigger assembly trigger guard forwardmost leg top horizontal top centrally-disposed and threaded trigger safety mounting bore 294 in the trigger assembly trigger guard forwardmost leg top horizontal top 292 of the trigger assembly trigger guard forwardmost leg rectangular-parallelepiped-shaped top 290 of the trigger assembly trigger guard forwardmost leg 288 of the trigger assembly substantially U-shaped trigger guard 286 of the trigger assembly 22, and whose head sits unobstructingly in the trigger assembly trigger guard safety plate top safety plate mounting counter-bore 316 in the trigger assembly trigger guard safety plate horizontal top 306 of the trigger assembly trigger guard substantially C-shaped horizontal safety plate 304 of the trigger assembly substantially U-shaped trigger guard 286 of the trigger assembly 22.

The trigger assembly substantially U-shaped trigger guard 286 of the trigger assembly 22 is forwardly and rearwardly slidably positioned in the breech block assembly breech block generally rectangular-parallelepiped-shaped internal chamber 166 in the breech block assembly hollow and generally rectangular-parallelepiped-shaped breech block 154 of the breech block assembly 20, with the trigger assembly trigger guard safety plate pair of spaced-apart longitudinal sides 313 of the trigger assembly trigger guard substantially C-shaped horizontal safety plate 304 of the trigger assembly substantially U-shaped trigger guard 286 of the trigger assembly 22 slidably engaging the breech block assembly breech block side inner surface trigger safety raceway 176 in the breech block assembly breech block side inner surface 174 of each side of the breech block assembly breech block pair of parallel, vertical, and opposing sides 164 of the breech block assembly hollow and generally rectangular-parallelepiped-shaped breech block 154 of the breech block assembly 20, with the trigger assembly trigger guard safety plate vertical safety boss 318 of the trigger assembly trigger guard substantially C-shaped horizontal safety plate 304 of the trigger assembly substantially U-shaped trigger guard 286 of the trigger assembly 22 releaseably engaging the trigger assembly trigger block top horizontal trigger safety recess 276 in the trigger assembly trigger block horizontal top 274 of the trigger assembly trigger rectangular-parallelepiped-shaped block 270 of the trigger assembly generally concavo-convex-shaped vertical trigger 262 of the trigger assembly 22, and with the trigger assembly trigger guard trigger safety plunger 300 of the trigger assembly substantially U-shaped trigger guard 286 of the trigger assembly 22 releaseably engaging either detent of the breech block assembly breech block side inner surface pair of spaced-apart trigger safety plunger detents 178 in the breech block assembly breech block side inner surface 174 of the appropriate side of the breech block assembly breech block pair of parallel, vertical, and opposing sides 164 of the breech block assembly hollow and generally rectangular-parallelepiped-shaped breech block 154 of the breech block assembly 20.

The operation of the single shot falling breech block action 10 can best be seen in FIGS. 4–7, and as such will be discussed with reference thereto.

Figure 4:
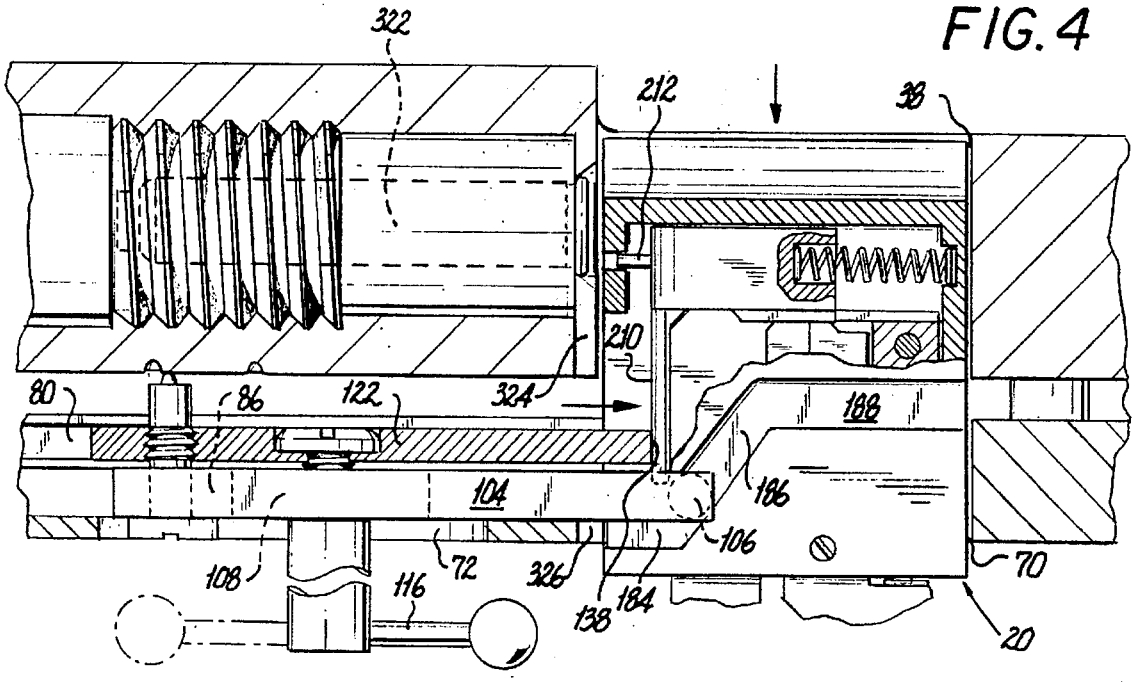
FIG. 4 is a diagrammatic side elevational view in partial cross section, with parts broken away, of the present invention in the process of being cocked or re-cocked with the lever finger being rotated clockwise causing both the action plate and the movable rack to move rearwardly and thereby causing the firing pin to move rearwardly and the breech block to fall downwardly.

As shown in FIG. 4, which is a diagrammatic side elevational view in partial cross section, with parts broken away, of the present invention in the process of being cocked or re-cocked, as the case may be, the initial step of cocking or re-cocking is as follows:

STEP 1: Rotate the lower receiver assembly slender and cylindrically-shaped finger lever 116 of the lower receiver assembly 18 clockwise causing the attached lower receiver assembly horizontal pinion 108 of the lower receiver assembly 18 to also rotate clockwise and walk rearwardly along the engaged lower receiver assembly lower receiver horizontal stationary rack 86 of the lower receiver 18, and guided therealong by the lower receiver assembly lower receiver top low area pinion guide throughslot 72 in the lower receiver assembly generally rectangular-shaped lower receiver 58 of the lower receiver assembly 18. Since the lower receiver assembly generally rectangular-shaped action plate 122 of the lower receiver assembly 18 is attached to the lower receiver assembly horizontal pinion 108 of the lower receiver assembly 18, the lower receiver assembly generally rectangular-shaped action plate 122 of the lower receiver assembly 18 also slides rearwardly in the lower receiver assembly lower receiver vertical wall inner surface horizontal action plate raceway slot 80 in the lower receiver assembly lower receiver pair of parallel and opposing vertical walls 76 of the lower receiver assembly generally rectangular-shaped lower receiver 58 of the lower receiver assembly 18, and whose lower receiver assembly action plate rear cocking boss extension cocking boss 138 abuts against and begins to move the breech block assembly firing pin cocking portion front convex cocking surface 210 of the breech block assembly firing pin generally convexo-concave and vertical cocking portion 208 of the breech block assembly firing pin 192 of the breech block assembly 20 rearwardly, against the biasing of the breech block assembly firing pin spring 216 of the breech block assembly firing pin 192 of the breech block assembly 20. As the lower receiver assembly horizontal pinion 108 of the lower receiver assembly 18 moves rearwardly, the engaged lower receiver assembly horizontal movable rack 104 of the lower receiver assembly 18 also slides rearwardly, but at twice the speed of the lower receiver assembly action plate rear cocking boss extension cocking boss 138 of the lower receiver assembly generally rectangular-shaped action plate 122 of the lower receiver assembly 18, by virtue of the lower receiver assembly horizontal pinion 108 of the lower receiver assembly 18 also moving rearwardly as it rotates. The lower receiver assembly movable rack rearmost end laterally-and-inwardly-oriented and cylindrically-shaped stud 106 of the lower receiver assembly horizontal movable rack 104 of the lower receiver 18 slides rearwardly in the breech block assembly breech block side outer surface movable rack stud slot horizontal front portion 184 of the breech block assembly breech block side outer surface movable rack stud slot 182 until the breech block assembly firing pin tip 212 of the breech block assembly firing pin 192 of the breech block assembly 20 is pushed out of the primer of a spent cartridge 322, in the re-cocking scenario. Once this has occurred, the lower receiver assembly movable rack rearmost end laterally-and-inwardly-oriented and cylindrically-shaped stud 106 of the lower receiver assembly horizontal movable rack 104 of the lower receiver 18 continues to slide upwardly in the breech block assembly breech block side outer surface movable rack stud slot inclined intermediate portion 186 of the breech block assembly breech block side outer surface movable rack stud slot 182 causing the breech block assembly 20 to slide downwardly in the upper receiver assembly body breech block throughraceway 38 of the upper receiver assembly generally rectangular-parallelepiped-shaped body 24 of the upper receiver assembly 16 and the lower receiver assembly lower receiver top low area throughraceway 70 in the lower receiver assembly generally rectangular-shaped lower receiver 58 of the lower receiver assembly 18. It is to be understood, however, that in order to prevent damage to the breech block assembly firing pin tip 212 of the breech block assembly firing pin 192 of the breech block assembly 20, if the breech block assembly 22 is inadvertently lowered while the breech block assembly firing pin tip 212 of the breech block assembly firing pin 192 of the breech block assembly 20 is inadvertently engaged with the primer of the spent cartridge 322, the upper receiver assembly 16 has an upper receiver assembly vertical firing pin clearance groove 324 and the lower receiver assembly 18 has a lower receiver assembly vertical firing pin clearance groove 326 that is vertical alignment with the upper receiver assembly vertical firing pin clearance groove 324 of the upper receiver assembly 16 and which provide clearance for the inadvertently extended breech block assembly firing pin tip 212 of the breech block assembly firing pin 192.

Figure 5:
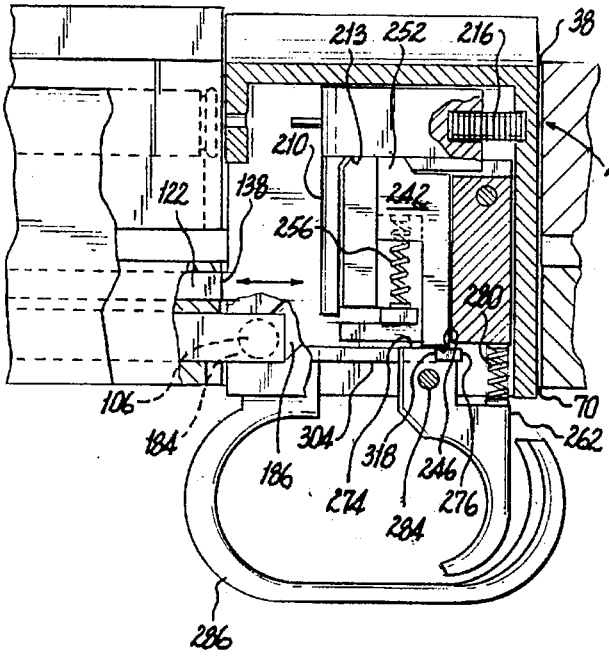
FIG. 5 is a diagrammatic side elevational view in partial cross section, with parts broken away, of the present invention in the fully cocked position, which is caused by the finger lever being moved counterclockwise, with the firing pin in the rearward position, the breech block in the raised position, and the firing pin safety in the on position.

As shown in FIG. 5, which is a diagrammatic side elevational view in partial cross section, with parts broken away, of the present invention with the safety on, and being fully cocked or fully re-cocked, as the case may be, the final steps of cocking or re-cocking are as follows:

STEP 2: Continue to rotate the lower receiver assembly slender and cylindrically-shaped finger lever 116 of the lower receiver assembly 18 clockwise causing the lower receiver assembly action plate rear cocking boss extension cocking boss 138 of the lower receiver assembly generally rectangular-shaped action plate 122 of the lower receiver assembly 18 to continue to move the breech block assembly firing pin cocking portion front convex cocking surface 210 of the breech block assembly firing pin generally convexo-concave and vertical cocking portion 208 of the breech block assembly firing pin 192 of the breech block assembly 20 rearwardly, against the biasing of the breech block assembly firing pin spring 216 of the breech block assembly firing pin 192 of the breech block assembly 20. The lower receiver assembly movable rack rearmost end laterally-and-inwardly-oriented and cylindrically-shaped stud 106 of the lower receiver assembly horizontal movable rack 104 of the lower receiver 18 slides rearwardly in the breech block assembly breech block side outer surface movable rack stud slot horizontal rear portion 188 of the breech block assembly breech block side outer surface movable rack stud slot 182 in the breech block assembly breech block side outer surface 180 of the breech block assembly breech block pair of parallel, vertical, and opposing sides 164 of the breech block assembly hollow and generally rectangular-parallelepiped-shaped breech block 154 of the breech block assembly 20 until the trigger assembly sear horizontal top inwardly-and-upwardly-tapering projection 252 of the trigger assembly sear horizontal top 244 of the trigger assembly sear 242 of the trigger assembly 22 replaceably engages the breech block assembly firing pin main portion bottom inwardly-and-upwardly-tapering sear recess 213 of the breech block assembly firing pin main portion horizontal bottom 206 of the breech block assembly firing pin generally rectangular-parallelepiped-shaped main portion 194 of the breech block assembly firing pin 192 of the breech block assembly 20, and which is maintained therein by the biasing of the trigger assembly sear spring 256 of the trigger assembly sear 242 of the trigger assembly 22. The trigger assembly generally concavo-convex-shaped vertical trigger 262 of the trigger assembly 22 pivots about the lowermost pin of the trigger assembly pair of trigger housing mounting pins 284, by the biasing of the trigger assembly trigger spring 280 of the trigger assembly 22, until the trigger assembly trigger block horizontal top 274 of the trigger assembly trigger rectangular-parallelepiped-shaped block 270 of the trigger assembly generally concavo-convex-shaped vertical trigger 262 of the trigger assembly 22 abuts against the trigger assembly sear horizontal bottom 246 of the trigger assembly sear 242 of the trigger assembly 22 and the lower receiver assembly action plate rear extractor boss 140 of the lower receiver assembly generally rectangular-shaped action plate 122 of the lower receiver assembly 18 abuts against the lower receiver assembly extractor front 100 of the lower receiver assembly generally rectangular-parallelepiped-shaped extractor 92 of the lower receiver assembly 18. The single shot falling breech block action 10 is now fully cocked or fully re-cocked.

STEP 3: Continue to rotate the lower receiver assembly slender and cylindrically-shaped finger lever 116 of the lower receiver assembly 18 slightly clockwise until the lower receiver assembly action plate rear extractor boss 140 of the lower receiver assembly generally rectangular-shaped action plate 122 of the lower receiver assembly 18 pivots the lower receiver assembly generally rectangular-parallelepiped-shaped extractor 92 of the lower receiver assembly 18 rearwardly and extracts the spent cartridge 322, in the re-cocking scenario.

STEP 4: Rotate the lower receiver assembly slender and cylindrically-shaped finger lever 116 of the lower receiver assembly 18 slightly counterclockwise causing the single shot falling breech block action 10 to return to being fully cocked or fully re-cocked.

STEP 5: Slide the trigger assembly substantially U-shaped trigger guard 286 of the trigger assembly 22 forwardly with the trigger assembly trigger guard safety plate pair of spaced-apart longitudinal sides 313 of the trigger assembly trigger guard substantially C-shaped horizontal safety plate 304 of the trigger assembly substantially U-shaped trigger guard 286 of the trigger assembly 22 sliding forwardly in the breech block assembly breech block side inner surface trigger safety raceway 176 in the breech block assembly breech block side inner surface 174 of each side of the breech block assembly breech block pair of parallel, vertical, and opposing sides 164 of the breech block assembly hollow and generally rectangular-parallelepiped-shaped breech block 154 of the breech block assembly 20 until the trigger assembly trigger guard safety plate vertical safety boss 318 of the trigger assembly trigger guard substantially C-shaped horizontal safety plate 304 of the trigger assembly substantially U-shaped trigger guard 286 of the trigger assembly 22 engages the trigger assembly trigger block top horizontal trigger safety recess 276 in the trigger assembly trigger block horizontal top 274 of the trigger assembly trigger rectangular-parallelepiped-shaped block 270 of the trigger assembly generally concavo-convex-shaped vertical trigger 262 of the trigger assembly 22 and the trigger assembly trigger guard trigger safety plunger 300 of the trigger assembly substantially U-shaped trigger guard 286 of the trigger assembly 22 releaseably engages the forwardmost detent of the breech block assembly breech block side inner surface pair of spaced-apart trigger safety plunger detents 178 in the breech block assembly breech block side inner surface 174 of the appropriate side of the breech block assembly breech block pair of parallel, vertical, and opposing sides 164 of the breech block assembly hollow and generally rectangular-parallelepiped-shaped breech block 154 of the breech block assembly 20, so that the trigger assembly generally concavo-convex-shaped vertical trigger 262 of the trigger assembly 22 is prevented from being pulled and the trigger assembly sear 242 of the trigger assembly 22 is prevented from dropping and the conventional single shot rifle 14 can not be fired.

STEP 6: Rotate the lower receiver assembly slender and cylindrically-shaped finger lever 116 of the lower receiver assembly 18 counterclockwise causing the lower receiver assembly movable rack rearmost end laterally-and-inwardly-oriented and cylindrically-shaped stud 106 of the lower receiver assembly horizontal movable rack 104 of the lower receiver 18 to slide forwardly in the breech block assembly breech block side outer surface movable rack stud slot horizontal rear portion 188 of the breech block assembly breech block side outer surface movable rack stud slot 182, to slide downwardly in the breech block assembly breech block side outer surface movable rack stud slot inclined intermediate portion 186 of the breech block assembly breech block side outer surface movable rack stud slot 182, and to slide forwardly in the breech block assembly breech block side outer surface movable rack stud slot horizontal front portion 184 of the breech block assembly breech block side outer surface movable rack stud slot 182 and thereby causing the breech block assembly to slide upwardly in the lower receiver assembly lower receiver top low area throughraceway 70 in the lower receiver assembly generally rectangular-shaped lower receiver 58 of the lower receiver assembly 18 and the upper receiver assembly body breech block throughraceway 38 of the upper receiver assembly generally rectangular-parallelepiped-shaped body 24 of the upper receiver assembly 16 and close the single shot falling breech block action 10.

Figure 6:
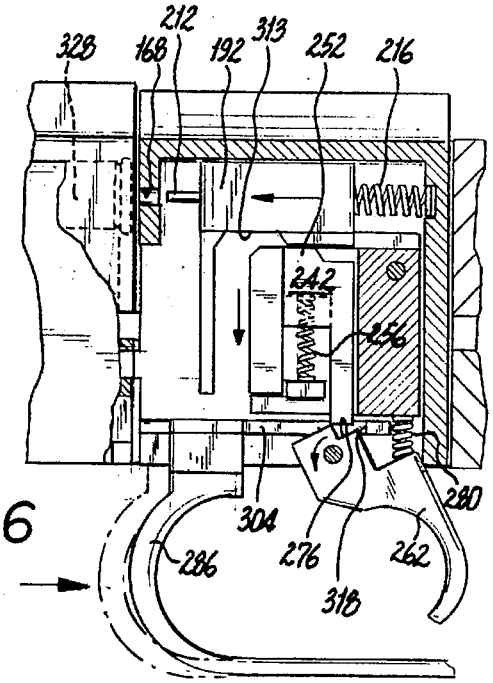
FIG. 6 is a diagrammatic side elevational view in partial cross section, with parts broken away, of the present invention in the process of being fired with the firing pin safety off, the trigger rotating rearwardly causing the sear to move downwardly and thereby causing the firing pin to advance forwardly towards the cartridge.

As shown in FIG. 6, which is a diagrammatic side elevational view in partial cross section, with parts broken away, of the present invention with the firing pin safety off, and being in the process of being fired, the firing step is as follows:

STEP 7: Slide the trigger assembly substantially U-shaped trigger guard 286 of the trigger assembly 22 rearwardly with the trigger assembly trigger guard safety plate pair of spaced-apart longitudinal sides 313 of the trigger assembly trigger guard substantially C-shaped horizontal safety plate 304 of the trigger assembly substantially U-shaped trigger guard 286 of the trigger assembly 22 sliding rearwardly in the breech block assembly breech block side inner surface trigger safety raceway 176 in the breech block assembly breech block side inner surface 174 of each side of the breech block assembly breech block pair of parallel, vertical, and opposing sides 164 of the breech block assembly hollow and generally rectangular-parallelepiped-shaped breech block 154 of the breech block assembly 20, until the trigger assembly trigger guard safety plate vertical safety boss 318 of the trigger assembly trigger guard substantially C-shaped horizontal safety plate 304 of the trigger assembly substantially U-shaped trigger guard 286 of the trigger assembly 22 is released from the trigger assembly trigger block top horizontal trigger safety recess 276 in the trigger assembly trigger block horizontal top 274 of the trigger assembly trigger rectangular-parallelepiped-shaped block 270 of the trigger assembly generally concavo-convex-shaped vertical trigger 262 of the trigger assembly 22 and the trigger assembly trigger guard trigger safety plunger 300 of the trigger assembly substantially U-shaped trigger guard 286 of the trigger assembly 22 releaseably engages the rearmost detent of the breech block assembly breech block side inner surface pair of spaced-apart trigger safety plunger detents 178 in the breech block assembly breech block side inner surface 174 of the appropriate side of the breech block assembly breech block pair of parallel, vertical, and opposing sides 164 of the breech block assembly hollow and generally rectangular-parallelepiped-shaped breech block 154 of the breech block assembly 20, so that the trigger assembly generally concavo-convex-shaped vertical trigger 262 of the trigger assembly 22 can be pulled and the trigger assembly sear 242 of the trigger assembly 22 can drop and thereby allow the conventional single shot rifle 14 to be fired.

STEP 8: Pull the trigger assembly generally concavo-convex-shaped vertical trigger 262 of the trigger assembly 22 against the biasing of the trigger assembly trigger spring 280 of the trigger assembly 22 releasing its hold on the trigger assembly sear 242 of the trigger assembly 22. Since the breech block assembly firing pin spring 216 of the breech block assembly firing pin 192 of the breech block assembly 20 is stronger than the trigger assembly sear spring 256 of the trigger assembly sear 242 of the trigger assembly 22, the breech block assembly firing pin 192 of the breech block assembly 20 moves rapidly forwardly and the breech block assembly firing pin tip 212 of the breech block assembly firing pin 192 of the breech block assembly 20 extends through the breech block assembly breech block front firing pin tip throughbore 168 in the breech block assembly breech block vertical and substantially open front 162 of the breech block assembly hollow and generally rectangular-parallelepiped-shaped breech block 154 of the breech block assembly 20 and engages the primer in a new cartridge 328, while the trigger assembly sear horizontal top inwardly-and-upwardly-tapering projection 252 of the trigger assembly sear horizontal top 244 of the trigger assembly sear 242 of the trigger assembly 22 is simultaneously released and forced downwardly from the breech block assembly firing pin main portion bottom inwardly-and-upwardly-tapering sear recess 213 of the breech block assembly firing pin main portion horizontal bottom 206 of the breech block assembly firing pin generally rectangular-parallelepiped-shaped main portion 194 of the breech block assembly firing pin 192 of the breech block assembly 20, by virtue of its inclined surfaces, and the complete trigger assembly sear 242 of the trigger assembly 22 drops.

Figure 7:
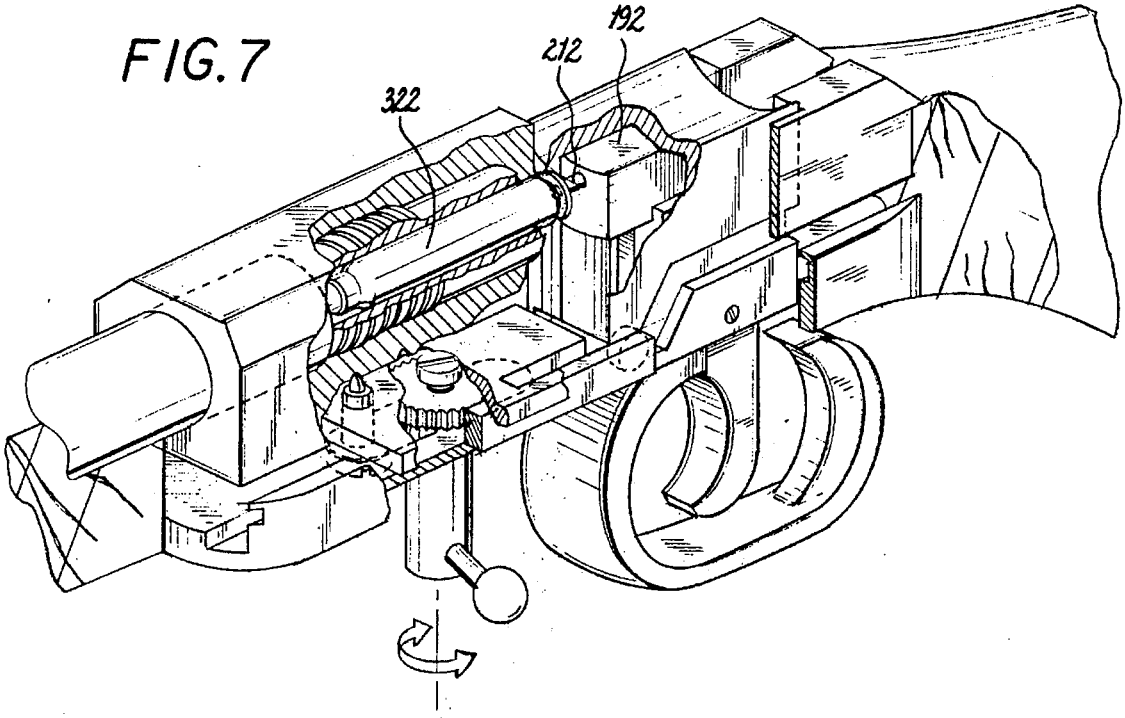
FIG. 7 is a diagrammatic perspective view in partial cross section, with parts broken away, of the present invention subsequent to being fired with the spent shell and ready to be re-cocked.

As shown in FIG. 7, which is a diagrammatic perspective view in partial cross section, with parts broken away, of the present invention subsequent to being fired with the spent shell and ready to be re-cocked, the breech block assembly firing pin tip 212 of the breech block assembly firing pin 192 of the breech block assembly 20 has ignited the primer in the new cartridge 328 which now becomes the spent cartridge 322. STEP 1 to STEP 8 can now be repeated for the re-cocking scenario.

Figure 8:
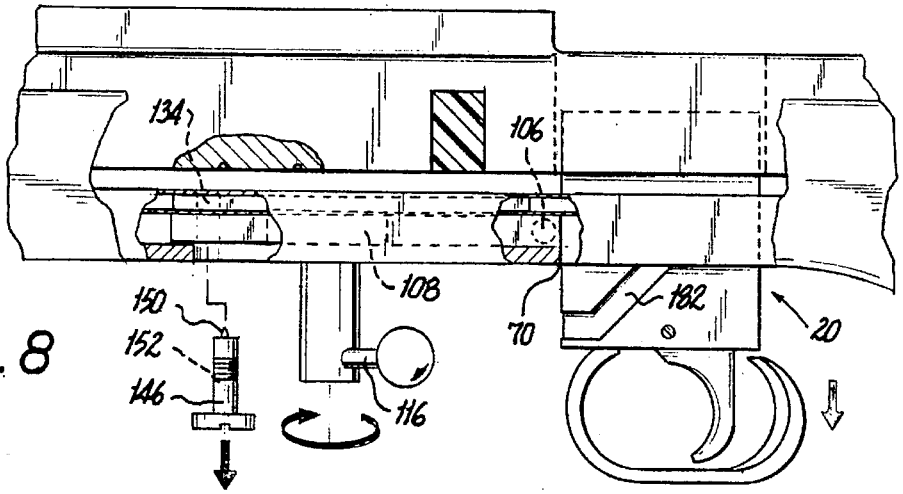
FIG. 8 is a diagrammatic side elevational view in partial cross section, with parts broken away, of the present invention in the process of being quickly and readily taken down.

As shown in FIG. 8, which is a diagrammatic side elevational view in partial cross section, with parts broken away, of the present invention in the process of being quickly and readily torn down, the take down step is as follows:

STEP 9: Unscrew and remove the lower receiver assembly take down screw sub-assembly screw 146 of the lower receiver assembly take down screw sub-assembly 144 of the lower receiver assembly 18, along with the integrated lower receiver assembly take down screw sub-assembly plunger 150 of the lower receiver assembly take down screw sub-assembly 144 and the lower receiver assembly take down screw sub-assembly spring 152 of the lower receiver assembly take down screw sub-assembly 144, from the lower receiver assembly action plate threaded action plate take down throughbore 134 in the lower receiver assembly generally rectangular-shaped action plate 122 of the lower receiver assembly 18, through the lower receiver assembly lower receiver top low area pinion guide throughslot 72 in the lower receiver assembly generally rectangular-shaped lower receiver 58 of the lower receiver assembly 18.

STEP 10: Rotate the lower receiver assembly slender and cylindrically-shaped finger lever 116 of the lower receiver assembly 18 slightly counterclockwise causing the attached lower receiver assembly horizontal pinion 108 of the lower receiver assembly 18 to also rotate slightly counterclockwise and walk forwardly until the lower receiver assembly movable rack rearmost end laterally-and-inwardly-oriented and cylindrically-shaped stud 106 of the lower receiver assembly horizontal movable rack 104 of the lower receiver 18 slides forwardly and completely leaves the breech block assembly breech block side outer surface movable rack stud slot 182.

STEP 11: Press down the breech block assembly 20 and remove through the lower receiver assembly lower receiver top low area throughraceway 70 in the lower receiver assembly generally rectangular-shaped lower receiver 58 of the lower receiver assembly 18, for cleaning and storage.

It is to be understood that the configurations of the various components of the present invention are not merely a matter of design choice but are of significant and critical importance for, inter alia, the functions that they accomplish as discussed, supra, and any not explicitly expressed but inherent thereto. They therefore must be considered in determining patentability. Support for this assertion can be found in In re Dailey et al., 149 U.S.P.Q. 47 (CCPA 1976), where the Court held that the shape of a device must be considered in determining patentability, if the shape is significant:

> "... the configuration of the container is a mere matter of choice not significantly novel ..., [since]... Appellants have provided no argument which convinces us that the particular configuration of their container is significant ... " [Emphasis added]

It will be understood that each of the elements described above, or two or more together, may also find a useful application in other types of constructions differing from the types described above.

While the invention has been illustrated and described as embodied in a single shot falling breech block action, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A single shot falling breech block action, comprising:

a) an upper receiver assembly; said upper receiver assembly having a generally rectangular-parallelepiped-shaped body with a vertical front and a vertical rear being disposed behind said vertical front of said generally rectangular-parallelepiped-shaped body of said upper receiver assembly; said generally rectangular-parallelepiped-shaped body of said upper receiver assembly further having a horizontal top extending from said vertical front of said generally rectangular-parallelepiped-shaped body of said upper receiver assembly to said vertical rear of said generally rectangular-parallelepiped-shaped body of said upper receiver assembly; said generally rectangular-parallelepiped-shaped body of said upper receiver assembly further having a horizontal bottom being disposed below said horizontal top of said assembly generally rectangular-parallelepiped-shaped body of said upper receiver assembly and extending from said vertical front of said generally rectangular-parallelepiped-shaped body of said upper receiver assembly to said vertical rear of said generally rectangular-parallelepiped-shaped body of said upper receiver assembly; said generally rectangular-parallelepiped-shaped body of said upper receiver assembly further having a pair of opposing and vertical sides; each side of said pair of opposing and vertical sides of said generally rectangular-parallelepiped-shaped body of said upper receiver assembly extending from a side of said vertical front of said generally rectangular-parallelepiped-shaped body of said upper receiver assembly to a respective side of said vertical rear of said generally rectangular-parallelepiped-shaped body of said upper receiver assembly and from a side of said horizontal top of said generally rectangular-parallelepiped-shaped body of said upper receiver assembly to a respective side of said horizontal bottom of said generally rectangular-parallelepiped-shaped body of said upper receiver assembly; said generally rectangular-parallelepiped-shaped body of said upper receiver assembly further having an imaginary intermediate vertical plane being disposed at a substantial midpoint between said vertical front of said generally rectangular-parallelepiped-shaped body of said upper receiver assembly and said vertical rear of said generally rectangular-parallelepiped-shaped body of said upper receiver assembly;

b) a lower receiver assembly being replaceably attached to said upper receiver assembly;

c) a breech block assembly being replaceably and vertically slidably mounted in said lower receiver assembly and said upper receiver assembly;

d) a trigger assembly being replaceably mounted in said breech block assembly;

e) a stationary rack being replaceably and fixedly attached in said lower receiver assembly;

f) a movable rack being replaceably and forwardly and rearwardly slidably mounted in said lower receiver assembly and being engagable with said breech block assembly;

g) a pinion being clockwise and counterclockwise rotatively, and forwardly and rearwardly movably, positioned in said lower receiver and being rotatively engaged with said stationary rack and said movable rack;

h) an action plate being forwardly and rearwardly slidably mounted in said lower receiver assembly and being rotatively attached to said pinion, so that said pinion can rotate relative thereto; said action plate being abutable against said breech block assembly; and i) pinion rotating means for rotating said pinion, so that when said pinion rotating means is rotated clockwise said pinion is rotated clockwise and walks rearwardly along said horizontal stationary rack while said action plate slides rearwardly and begins to cock said single shot falling breech block action and said movable rack slides rearwardly and causes said breech block assembly to slide downwardly to load a cartridge and when said pinion rotating means is rotated counterclockwise said pinion is rotated counterclockwise and walks forwardly along said horizontal stationary rack while said action plate slides forwardly and said movable rack slides forwardly and causes said breech block assembly to slide upwardly and fully cocking said single shot falling breech block action.

2. The action as defined in claim 1, wherein said generally rectangular-parallelepiped-shaped body of said upper receiver assembly further has a breech block throughraceway that extends continuously from said horizontal top of said generally rectangular-parallelepiped-shaped body of said upper receiver assembly to said horizontal bottom of said generally rectangular-parallelepiped-shaped body of said upper receiver assembly and continuously from slightly rearward of said imaginary intermediate vertical plane of said generally rectangular-parallelepiped-shaped body of said upper receiver assembly to slightly forward of said vertical rear of said generally rectangular-parallelepiped-shaped body of said upper receiver assembly.

3. The action as defined in claim 2, wherein said horizontal top of said generally rectangular-parallelepiped-shaped body of said upper receiver assembly has a horizontal raised portion that extends from said vertical front of said generally rectangular-parallelepiped-shaped body of said upper receiver assembly to said breech block throughraceway of said generally rectangular-parallelepiped-shaped body of said upper receiver assembly and which has a pair of upwardly-and-inwardly-tapering vertical longitudinal sides.

4. The action as defined in claim 2, wherein said generally rectangular-parallelepiped-shaped body of said upper receiver assembly further has a partially-threaded, cylindrically-shaped, and horizontally-oriented barrel mounting throughbore that extends longitudinally between, and opens into both, said vertical front of said generally rectangular-parallelepiped-shaped body of said upper receiver assembly and said breech block throughraceway of said generally rectangular-parallelepiped-shaped body of said upper receiver assembly.

5. The action as defined in claim 2, wherein said generally rectangular-parallelepiped-shaped body of said upper receiver assembly further has a pair of opposing and downwardly-and-inwardly-tapering recoil shoulders that are disposed slightly forward of said imaginary intermediate vertical plane of said generally rectangular-parallelepiped-shaped body of said upper receiver assembly; each shoulder of said upper receiver assembly body pair of opposing and downwardly-and-inwardly-tapering recoil shoulders of said generally rectangular-parallelepiped-shaped body of said upper receiver assembly opens into, and extends downwardly and inwardly from, a respective side of said pair of opposing and vertical sides of said generally rectangular-parallelepiped-shaped body of said upper receiver assembly to, and opens into, said horizontal bottom of said generally rectangular-parallelepiped-shaped body of said upper receiver assembly.

6. The action as defined in claim 5, wherein said pair of opposing and downwardly-and-inwardly-tapering recoil shoulders of said generally rectangular-parallelepiped-shaped body of said upper receiver assembly are coated with a release material.

7. The action as defined in claim 6, wherein said horizontal bottom of said generally rectangular-parallelepiped-shaped body of said upper receiver assembly has a pair of threaded, spaced-apart, and longitudinally-oriented mounting bores that extend upwardly therefrom; one bore of said pair of threaded, spaced-apart, and longitudinally-oriented mounting bores in said horizontal bottom of said generally rectangular-parallelepiped-shaped body of said upper receiver assembly is disposed slightly rearward of said vertical front of said generally rectangular-parallelepiped-shaped body of said upper receiver assembly and another bore of said pair of threaded, spaced-apart, and longitudinally-oriented mounting bores in said horizontal bottom of said generally rectangular-parallelepiped-shaped body of said upper receiver assembly is disposed slightly forward of said vertical rear of said generally rectangular-parallelepiped-shaped body of said upper receiver assembly.

8. The action as defined in claim 7, wherein said horizontal bottom of said generally rectangular-parallelepiped-shaped body of said upper receiver assembly further has a pair of spaced-apart and longitudinally-oriented take down screw plunger detents that extend upwardly therefrom; said pair of spaced-apart and longitudinally-oriented take down screw plunger detents in said horizontal bottom of said generally rectangular-parallelepiped-shaped body of said upper receiver assembly are disposed longitudinally between said pair of opposing and downwardly-and-inwardly-tapering recoil shoulders of said generally rectangular-parallelepiped-shaped body of said upper receiver assembly and a forwardmost bore of said pair of threaded, spaced-apart, and longitudinally-oriented mounting bores in said horizontal bottom of said generally rectangular-parallelepiped-shaped body of said upper receiver assembly.

9. The action as defined in claim 4, wherein said partially-threaded, cylindrically-shaped, and longitudinally-oriented barrel mounting throughbore in said generally rectangular-parallelepiped-shaped body of said upper receiver assembly is threadably engagable with a threaded rear end of a barrel of a single shot rifle.

10. The action as defined in claim 1, wherein said upper receiver assembly is a barrel of a single shot rifle; said barrel of the single shot rifle has a rear end with a breech block throughraceway that extends vertically therethrough, a pair of opposing and downwardly-and-inwardly-tapering recoil shoulders, and a pair of threaded, spaced-apart, and longitudinally-oriented mounting bores that extend upwardly.

11. The action as defined in claim 10, wherein said pair of opposing and downwardly-and-inwardly-tapering recoil shoulders of said barrel of the single shot rifle are coated with a release material.

12. The action as defined in claim 1, wherein said upper receiver assembly has a barrel of a single shot rifle integral therewith.

13. The action as defined in claim 8, wherein said lower receiver assembly has a pair of spaced-apart, longitudinally-oriented, and non-threaded mounting throughbores that are in vertical alignment with said pair of threaded, spaced-apart, and longitudinally-oriented mounting bores in said horizontal bottom of said generally rectangular-parallelepiped-shaped body of said upper receiver assembly.

14. The action as defined in claim 13, wherein said upper receiver assembly is replaceably attached to said lower receiver assembly by a pair of action mounting screws that extend freely through said pair of spaced-apart, longitudinally-oriented, and non-threaded mounting throughbores in said lower receiver assembly, through a pair of action mounting cylindrically-shaped and vertical spacers, and threadably engage said pair of threaded, spaced-apart, and longitudinally-oriented mounting bores in said horizontal bottom of said generally rectangular-parallelepiped-shaped body of said upper receiver assembly.

15. The action as defined in claim 14, wherein said vertical rear of said generally rectangular-parallelepiped-shaped body of said upper receiver assembly is positioned slightly forward from a butt portion of an appropriately modified stock of a single shot rifle so as to form a slight gap therebetween, so that percussion from the fired single shot rifle is not transferred to the butt portion of the appropriately modified stock of the single shot rifle and ultimately to a shoulder of a user.

16. The action as defined in claim 15, wherein said slight gap between said vertical rear of said generally rectangular-parallelepiped-shaped body of said upper receiver assembly and the butt portion of the appropriately modified stock of the single shot rifle is maintained by said upper receiver assembly body pair of opposing, release material coated, and downwardly-and-inwardly-tapering recoil shoulders of said upper generally rectangular-parallelepiped-shaped body of said upper receiver assembly being aligned with two apertures in corresponding positions in an intermediate portion of the appropriately modified stock of the single shot rifle and with glass bedding compound disposed in said two apertures in the corresponding positions in the intermediate portion of the appropriately modified stock of the single shot rifle and curing with said single shot falling breech block action and the appropriately modified stock of the single shot rifle being held together by said pair of action mounting screws, so that a simple and inexpensive vehicle for maintaining close tolerances is provided; said release material coating on said pair of opposing, release material coated, and downwardly-and-inwardly-tapering recoil shoulders of said generally rectangular-parallelepiped-shaped body of said upper receiver assembly prevents said glass bedding material from sticking thereto, so that said upper receiver assembly can be readily removed from the appropriately modified stock of the single shot rifle during take down thereof.

17. The action as defined in claim 13, wherein said lower receiver assembly includes a generally rectangular-shaped lower receiver that has a rounded front, and a rounded rear that is disposed behind said rounded front of said generally rectangular-shaped lower receiver of said receiver assembly; said generally rectangular-shaped lower receiver of said receiver assembly further has a horizontal top, and a horizontal bottom that is disposed below said horizontal top of said generally rectangular-shaped lower receiver of said receiver assembly; said generally rectangular-shaped lower receiver of said receiver assembly further has a pair of opposing longitudinal sides that extend from said rounded front of said generally rectangular-shaped lower receiver of said receiver assembly to said rounded rear of said generally rectangular-shaped lower receiver of said receiver assembly; said generally rectangular-shaped lower receiver of said lower receiver assembly further has a pair of parallel and opposing vertical walls that extend perpendicularly upwardly along said pair of longitudinal sides of said generally rectangular-shaped lower receiver of said lower receiver assembly from said rounded front of said generally rectangular-shaped lower receiver of said lower receiver assembly to said rounded rear of said generally rectangular-shaped lower receiver of said lower receiver assembly.

18. The action as defined in claim 17, wherein said horizontal top of said generally rectangular-shaped lower receiver of said lower receiver assembly has a pair of mounting counterbore seats that are concentric with said pair of spaced-apart, longitudinally-oriented, and non-threaded mounting throughbores in said lower receiver assembly and assist in seating said pair of action mounting cylindrically-shaped and vertical spacers.

19. The action as defined in claim 17, wherein said horizontal top of said generally rectangular-shaped lower receiver of said lower receiver assembly further has a low area that is lower than said horizontal top of said generally rectangular-shaped lower receiver of said lower receiver assembly and which extends from slightly forward of a rearmost throughbore of said pair of spaced-apart, longitudinally-oriented, and non-threaded mounting throughbores in said lower receiver assembly to between a forwardmost detent of said pair of spaced-apart and longitudinally-oriented take down screw plunger detents in said horizontal bottom of said generally rectangular-parallelepiped-shaped body of said upper receiver assembly and a forwardmost throughbore of said pair of spaced-apart, longitudinally-oriented, and non-threaded mounting throughbores in said lower receiver assembly.

20. The action as defined in claim 19, wherein said low area in said horizontal top of said generally rectangular-shaped lower receiver of said receiver assembly has a breech block throughraceway that extends therethrough from said low area in said horizontal top of said generally rectangular-shaped lower receiver of said lower receiver assembly to said horizontal bottom of said generally rectangular-shaped lower receiver of said lower receiver assembly, and which is in vertical alignment with said breech block throughraceway in said generally rectangular-parallelepiped-shaped body of said upper receiver assembly, and which forms a smooth continuous breech block chamber therewith through which said breech block assembly is replaceably and vertically slidably mounted.

21. The action as defined in claim 20, wherein said low area in said horizontal top of said generally rectangular-shaped lower receiver of said receiver assembly further has a pinion guide throughslot that extends therethrough from said lower low area in said horizontal top of said generally rectangular-shaped lower receiver of said lower receiver assembly to said horizontal bottom of said generally rectangular-shaped lower receiver of said lower receiver assembly, and which extends longitudinally from slightly forward of said throughraceway in said low area in said horizontal top of said generally rectangular-shaped lower receiver of said lower receiver assembly to slightly forward of said forwardmost detent of said pair of spaced-apart and longitudinally-oriented take down screw plunger detents in said horizontal bottom of said generally rectangular-parallelepiped-shaped body of said upper receiver assembly.

22. The action as defined in claim 21, wherein said low area in said horizontal top of said generally rectangular-shaped lower receiver of said lower receiver assembly further has an extractor throughslot that extends therethrough from said low area in said horizontal top in said generally rectangular-shaped lower receiver of said lower receiver assembly to said horizontal bottom of said generally rectangular-shaped lower receiver of said lower receiver assembly, and to one side of, and in proximity to, a rearmost border of said pinion guide throughslot in said low area in said horizontal top of said generally rectangular-shaped lower receiver of said lower receiver assembly.

23. The action as defined in claim 22, wherein each wall of said pair of parallel and opposing vertical walls of said generally rectangular-shaped lower receiver of said lower receiver assembly has an inner surface with a horizontal action plate raceway slot that extends continuously longitudinally therealong, at a top thereof, and slightly above said horizontal top of said generally rectangular-shaped lower receiver of said lower receiver assembly.

24. The action as defined in claim 23, wherein said inner surface of said pair of parallel and opposing vertical walls of said generally rectangular-shaped lower receiver of said lower receiver assembly, that is opposite to that in which said extractor throughslot in said low area in said horizontal top of said generally rectangular-shaped lower receiver of said lower receiver assembly is most closest, further has a horizontal movable rack raceway slot that extends continuously longitudinally therealong below, and parallel to, said horizontal action plate raceway slot in said appropriate wall of said pair of parallel and opposing vertical walls of said generally rectangular-shaped lower receiver of said lower receiver assembly, and in which said movable rack is replaceably and forwardly and rearwardly slidably mounted, so that during take down said movable rack of said lower receiver can be slid out of said horizontal movable rack raceway slot in said inner surface of said appropriate wall of said pair of parallel and opposing vertical walls of said generally rectangular-shaped lower receiver of said lower receiver assembly to be readily serviced, if necessary.

25. The action as defined in claim 24, wherein said inner surface of said pair of parallel and opposing vertical walls of said generally rectangular-shaped lower receiver of said lower receiver assembly, in which said extractor throughslot in said low area in said horizontal top of said generally rectangular-shaped lower receiver of said lower receiver assembly is most closest, further has a horizontal stationary rack raceway slot that extends continuously longitudinally therealong below, and parallel to, said horizontal action plate raceway slot in said appropriate wall of said pair of parallel and opposing vertical walls of said generally rectangular-shaped lower receiver of said lower receiver assembly, and into which said stationary rack is replaceably and fixedly attached; said horizontal stationary rack raceway slot in said inner surface of said appropriate wall of said pair of parallel and opposing vertical walls of Said generally rectangular-shaped lower receiver of said lower receiver assembly, opposes, and is in horizontal alignment with, said horizontal movable rack raceway slot in said inner surface of said appropriate wall of said pair of parallel and opposing vertical walls of said generally rectangular-shaped lower receiver of said lower receiver assembly.

26. The action as defined in claim 25, wherein said horizontal stationary rack raceway slot in said inner surface of said appropriate wall of said pair of parallel and opposing vertical walls Of said generally rectangular-shaped lower receiver of said lower receiver assembly has a pair of spaced-apart stationary rack mounting throughbores that extend laterally therethrough; a forwardmost throughbore of said pair of spaced-apart stationary rack mounting throughbores in said horizontal stationary rack raceway slot in said inner surface of said appropriate wall of said pair of parallel and opposing vertical walls of said generally rectangular-shaped lower receiver of said lower receiver assembly is disposed in said low area in said horizontal top of said generally rectangular-shaped lower receiver of said lower receiver assembly slightly rearward of a forwardmost border thereof while a rearmost throughbore of said pair of spaced-apart stationary rack mounting throughbores is also disposed in said low area in said horizontal top of said generally rectangular-shaped lower receiver of said lower receiver assembly, in proximity to said extractor throughslot in said low area in said receiver horizontal top of said generally rectangular-shaped lower receiver of said lower receiver assembly.

27. The action as defined in claim 26, wherein said stationary rack has a pair of stationary rack mounting throughbores that are disposed laterally at ends thereof; said stationary rack of said lower receiver is replaceably engaged against movement in said horizontal stationary rack raceway slot in said inner surface of said appropriate wall of said pair of parallel and opposing vertical walls of said generally rectangular-shaped lower receiver of said lower receiver assembly, by a pair of replaceable stationary rack mounting studs that extend through said pair of spaced-apart stationary rack mounting throughbores in said horizontal stationary rack raceway slot in said inner surface of said appropriate wall of said pair of parallel and opposing vertical walls of said generally rectangular-shaped lower receiver of said lower receiver assembly, and which extend into said pair of stationary rack mounting throughbores in said ends of said stationary rack of said lower receiver assembly, so that during take down said pair of replaceable stationary rack mounting studs of said lower receiver assembly can be removed and said stationary rack of said lower receiver assembly can be slid out of said horizontal stationary rack raceway slot in said inner surface of said appropriate wall of said pair of parallel and opposing vertical walls of said generally rectangular-shaped lower receiver of said lower receiver assembly to be readily serviced, if necessary.

28. The action as defined in claim 27, wherein said lower receiver assembly further includes a generally rectangular-parallelepiped-shaped extractor that has a lower end with a laterally-oriented throughbore that extends laterally therethrough, an upper end that is disposed above said lower end of said generally rectangular-parallelepiped-shaped extractor of said lower receiver assembly, a front that faces forwardly and extends from said lower end of said generally rectangular-parallelepiped-shaped extractor of said lower receiver assembly to said upper end of said generally rectangular-parallelepiped-shaped extractor of said lower receiver assembly, and an extractor slot that opens into both said upper end of said generally rectangular-parallelepiped-shaped extractor of said lower receiver assembly and said front of said generally rectangular-parallelepiped-shaped extractor of said lower receiver assembly so as to form a seat to engage and extract a spent cartridge; said lower end of said generally rectangular-parallelepiped-shaped extractor of said lower receiver assembly sits forwardly and rearwardly pivotally in said extractor throughslot in said low area in said horizontal top of said generally rectangular-shaped lower receiver of said lower receiver assembly and is forwardly and rearwardly pivotally mounted to said stationary rack by a rearmost stud of said pair of replaceably stationary rack mounting studs of said lower receiver assembly which also replaceably enters said laterally-oriented throughbore in said lower end of said generally rectangular-parallelepiped-shaped extractor of said lower receiver assembly.

29. The action as defined in claim 28, wherein said movable rack has a laterally-and-inwardly-facing and cylindrically-shaped stud that faces laterally perpendicularly inwardly from a rearmost end of said movable rack of said lower receiver assembly, towards said stationary rack of said lower receiver.

30. The action as defined in claim 29, wherein said pinion is horizontal and has a vertical guide shaft that extends perpendicularly downwardly from a center thereof and which has a lower end with a laterally-oriented and threaded throughbore that extends laterally therethrough; said horizontal pinion of said lower receiver assembly further has a centrally and longitudinally disposed threaded throughbore that extends centrally and longitudinally therethrough and centrally and longitudinally into said vertical guide shaft of said horizontal pinion of said lower receiver assembly; said vertical guide shaft of said horizontal pinion of said lower receiver assembly extends freely downwardly through said pinion guide throughslot in said low area in said horizontal top of said generally rectangular-shaped lower receiver of said lower receiver assembly and is freely rotatable therein while being freely movable forwardly and rearwardly therealong, and with said laterally-oriented and threaded throughbore in said lower end of said vertical guide shaft of said horizontal pinion of said lower receiver assembly positioned therebelow.

31. The action as defined in claim 30, wherein said pinion rotating means includes a slender and cylindrically-shaped finger lever that has a threaded proximal end that threadably engages said laterally-oriented and threaded throughbore in said lower end of said vertical guide shaft of said horizontal pinion, and a spherical-shaped free distal end that is spherically shaped to prevent possible injury to a user's hand; said finger lever of said pinion rotating means is rotatable, both clockwise and counterclockwise, in a generally horizontal plane that is substantially parallel to said horizontal bottom of said generally rectangular-shaped lower receiver of said lower receiver assembly.

32. The action as defined in claim 31, wherein said action plate is generally rectangular-shaped and has a horizontal top, a horizontal bottom that is disposed below said horizontal top of said generally rectangular-shaped action plate of said lower receiver assembly, a pair of parallel sides, a rear, and a front that is disposed forward of, and parallel to, said rear of said generally rectangular-shaped action plate of said lower receiver assembly; said generally rectangular-shaped action plate of said lower receiver assembly further has a generally centrally disposed and non-threaded action plate mounting throughbore that extends vertically therethrough from said horizontal top of said generally rectangular-shaped action plate of said lower receiver assembly to said horizontal bottom of said generally rectangular-shaped action plate of said lower receiver assembly, in proximity to said rear of said generally rectangular-shaped action plate of said lower receiver assembly, and which is in vertical alignment with said centrally and longitudinally disposed threaded throughbore in said horizontal pinion of said lower receiver assembly; said horizontal top of said generally rectangular-shaped action plate of said lower receiver assembly has a generally centrally disposed and non-threaded action plate mounting counter-bore that is concentric with said generally centrally disposed and non-threaded action plate mounting throughbore in said generally rectangular-shaped action plate of said lower receiver assembly; said generally rectangular-shaped action plate of said lower receiver assembly further has a threaded action plate take down throughbore that extends therethrough from said horizontal top of said generally rectangular-shaped action plate of said lower receiver assembly to said horizontal bottom of said generally rectangular-shaped action plate of said lower receiver assembly, and which is between said front of said generally rectangular-shaped action plate of said lower receiver assembly and said generally centrally disposed and non-threaded action plate mounting throughbore in said generally rectangular-shaped action plate of said lower receiver assembly.

33. The action as defined in claim 32, wherein said rear of said generally rectangular-shaped action plate of said lower receiver assembly has a generally rectangular-shaped cocking boss extension that extends rearwardly from a substantial center thereof, and which is co-planar with said generally rectangular-shaped action plate of said lower receiver assembly, and which terminates in a cocking boss; said generally rectangular-shaped cocking boss extension of said rear of said generally rectangular-shaped action plate of said lower receiver assembly has a width less than that of said rear of said generally rectangular-shaped action plate of said lower receiver assembly so as to form an extractor boss on one side thereof; said pair of parallel sides of said generally rectangular-shaped action plate of said lower receiver assembly are forwardly and rearwardly slidable, and replaceably positioned, in said horizontal action plate raceway slot in said inner surface of pair of parallel and opposing vertical walls of said generally rectangular-shaped lower receiver of said lower receiver assembly, with said extractor boss of said rear of said generally rectangular-shaped action plate of said lower receiver assembly facing rearwardly and being abutable against said front of said generally rectangular-parallelepiped-shaped extractor of said lower receiver assembly, so that said action plate is forwardly and rearwardly slidably mounted in said lower receiver assembly and said generally rectangular-parallelepiped-shaped extractor of said lower receiver assembly can be pivoted rearwardly.

34. The action as defined in claim 33, wherein said generally rectangular-shaped action plate of said lower receiver assembly is replaceably attached to said horizontal pinion of said lower receiver assembly by an action plate mounting screw that extends freely vertically through said generally centrally disposed and non-threaded action plate mounting throughbore in said generally rectangular-shaped action plate of said lower receiver assembly, and which threadably engages said centrally and longitudinally disposed threaded throughbore in said horizontal pinion of said lower receiver assembly, with a head thereof sitting unobstructingly in said generally centrally disposed and non-threaded action plate mounting counter-bore in said horizontal top of said generally rectangular-shaped action plate of said lower receiver assembly, and with said horizontal pinion of said lower receiver assembly being free to rotate both clockwise and counterclockwise relative to said generally rectangular-shaped action plate of said lower receiver assembly.

35. The action as defined in claim 34, wherein said lower receiver assembly further includes a take down screw sub-assembly that includes a screw that has a hollow and externally-threaded shaft and a head, a plunger that is slidably positioned in, and slidably extendable from, said hollow and externally-threaded shaft of said screw of said take down screw sub-assembly of said lower receiver assembly, and which is biased by a spring that is also contained in said hollow and externally-threaded shaft of said screw of said take down screw sub-assembly of said lower receiver assembly; said head of said screw of said take down screw sub-assembly of said lower receiver assembly is positioned unobstructingly in said pinion guide throughslot in said low area in said horizontal top of said generally rectangular-shaped lower receiver of said lower receiver assembly, and which is freely movable forwardly and rearwardly therealong, with said hollow and externally-threaded shaft of said screw of said take down screw sub-assembly of said lower receiver assembly vertically threadably engaging said threaded action plate take down throughbore in said generally rectangular-shaped action plate of said lower receiver assembly and thereby being forwardly and rearwardly movable therewith, and with said plunger of said take down screw sub-assembly of said lower receiver assembly being replaceably engagable with one detent of said pair of spaced-apart and longitudinally oriented take down screw plunger detents in said horizontal bottom of said generally rectangular-parallelepiped-shaped body of said upper receiver assembly, by virtue of the biasing of said spring of said take down screw sub-assembly of said lower receiver assembly.

36. The action as defined in claim 35, wherein said breech block assembly includes a hollow and generally rectangular-parallelepiped-shaped breech block that has a horizontal and concave-shaped top, an open bottom that is disposed below said horizontal and concave-shaped top of said hollow and generally rectangular-parallelepiped-shaped breech block of said breech block assembly, a vertical and closed back, a vertical and substantially open front that is disposed forward of said vertical and closed back of said generally rectangular-parallelepiped-shaped breech block of said breech block assembly, and a pair of parallel, vertical, and opposing sides; said hollow and generally rectangular-parallelepiped-shaped breech block of said breech block assembly contains a generally rectangular-parallelepiped-shaped internal trigger assembly chamber that opens into both said open bottom of said hollow and generally rectangular-parallelepiped-shaped breech block of said breech block assembly and said vertical and substantially open front of said generally rectangular-parallelepiped-shaped breech block of said breech block assembly.

37. The action as defined in claim 36, wherein said vertical and substantially open front of said hollow and generally rectangular-parallelepiped-shaped breech block of said breech block assembly has a firing pin tip throughbore that extends horizontally therethrough, and which is disposed between a lowest point of said horizontal and concave-shaped top of said hollow and generally rectangular-parallelepiped-shaped breech block of said breech block assembly and a top border of an opening in said vertical and substantially open front of said hollow and generally rectangular-parallelepiped-shaped breech block of said breech block assembly.

38. The action as defined in claim 37, wherein said vertical and closed back of said hollow and generally rectangular-parallelepiped-shaped breech block of said breech block assembly has an inner surface with a firing pin spring seat bore that is in horizontal alignment with said firing pin tip throughbore in said vertical and substantially open front of said hollow and generally rectangular-parallelepiped-shaped breech block of said breech block assembly.

39. The action as defined in claim 38, wherein each side of said pair of parallel, vertical, and opposing sides of said hollow and generally rectangular-parallelepiped-shaped breech block of said breech block assembly has an inner surface with a trigger safety raceway extending continuously and horizontally therealong; said trigger safety raceway of said inner surface of each side of said pair of parallel, vertical, and opposing sides of said hollow and generally rectangular-parallelepiped-shaped breech block of said breech block assembly are parallel to each other, and open into, and extend continuously horizontally from, said vertical and substantially open front of said hollow and generally rectangular-parallelepiped-shaped breech block of said breech block assembly to said vertical and closed back of said hollow and generally rectangular-parallelepiped-shaped breech block of said breech block assembly, in an orientation that is parallel to, and slightly above, said open bottom of said hollow and generally rectangular-parallelepiped-shaped breech block of said breech block assembly.

40. The action as defined in claim 39, wherein said inner surface of one side of said pair of parallel, vertical, and opposing sides of said hollow and generally rectangular-parallelepiped-shaped breech block of said breech block assembly has a pair of spaced-apart trigger safety plunger detents that are spaced horizontally therealong, between said open bottom of said hollow and generally rectangular-parallelepiped-shaped breech block of said breech block assembly and said trigger safety raceway in said inner surface of said one side of said pair of parallel, vertical, and opposing sides of said hollow and generally rectangular-parallelepiped-shaped breech block of said breech block assembly, in proximity to said vertical and substantially open front of said hollow and generally rectangular-parallelepiped-shaped breech block of said breech block assembly.

41. The action as defined in claim 40, wherein another side of said pair of parallel, vertical, and opposing sides of said hollow and generally rectangular-parallelepiped-shaped breech block of said breech block assembly that is opposite to said one side that has said pair of spaced-apart trigger safety plunger detents of said inner surface of said one side of said pair of parallel, vertical, and opposing sides of said hollow and generally rectangular-parallelepiped-shaped breech block of said breech block assembly disposed therein, has an outer surface with a movable rack stud slot that opens into both, and extends continuously between, said vertical and substantially open front of said hollow and generally rectangular-parallelepiped-shaped breech block of said breech block assembly and said vertical and closed back of said hollow and generally rectangular-parallelepiped-shaped breech block of said breech block assembly; said movable rack stud slot in said outer surface of said another side of said pair of parallel, vertical, and opposing sides of said hollow and generally rectangular-parallelepiped-shaped breech block of said breech block assembly has a horizontal front slot portion, that is wider than, and in horizontal alignment with, said trigger safety raceway in said inner surface of said another side of said pair of parallel, vertical, and opposing sides of said hollow and generally rectangular-parallelepiped-shaped breech block of said breech block assembly, and which opens into, and extends continuously horizontally rearwardly from, said vertical and substantially open front of said hollow and generally rectangular-parallelepiped-shaped breech block of said breech block assembly; said movable rack stud slot in said outer surface of said another side of said pair of parallel, vertical, and opposing sides of said hollow and generally rectangular-parallelepiped-shaped breech block of said breech block assembly further has an inclined intermediate slot portion that opens into, and extends continuously rearwardly and upwardly in a straight line from, a rear end of said horizontal front slot portion of said movable rack stud slot in said outer surface of said another side of said pair of parallel, vertical, and opposing sides of said hollow and generally rectangular-parallelepiped-shaped breech block of said breech block assembly; said movable rack stud slot in said outer surface of said another side of said pair of parallel, vertical, and opposing sides of said hollow and generally rectangular-parallelepiped-shaped breech block of said breech block assembly further has a horizontal rear slot portion that opens into, and extends continuously rearwardly from, an upper end of said inclined intermediate slot portion of said movable rack stud slot in said outer surface of said another side of said pair of parallel, vertical, and opposing sides of said hollow and generally rectangular-parallelepiped-shaped breech block of said breech block assembly, and which opens into said vertical and closed back of said hollow and generally rectangular-parallelepiped-shaped breech block of said breech block assembly; said horizontal rear slot portion of said movable rack stud slot in said outer surface of said another side of said pair of parallel, vertical, and opposing sides of said hollow and generally rectangular-parallelepiped-shaped breech block of said breech block assembly is disposed above, parallel to, behind, and longer than, said horizontal front slot portion of said movable rack stud slot in said outer surface of said another side of said pair of parallel, vertical, and opposing sides of said hollow and generally rectangular-parallelepiped-shaped breech block of said breech block assembly.

42. The action as defined in claim 41, wherein said hollow and generally rectangular-parallelepiped-shaped breech block of said breech block assembly further has a pair of trigger assembly mounting throughbores that extend horizontally through both sides of said pair of parallel, vertical, and opposing sides of said hollow and generally rectangular-parallelepiped-shaped breech block of said breech block assembly, and which straddle said horizontal rear slot portion of said movable rack stud slot in said outer surface of said another side of said pair of parallel, vertical, and opposing sides of said hollow and generally rectangular-parallelepiped-shaped breech block of said breech block assembly.

43. The action as defined in claim 42, wherein said breech block assembly further includes a firing pin that has a generally rectangular-parallelepiped-shaped main portion with a breech slightly convex-shaped and vertical front, a slightly convex-shaped and vertical rear that is disposed behind said slightly convex-shaped and vertical front of said generally rectangular-parallelepiped-shaped main portion of said firing pin of said breech block assembly and which has an outer surface with a generally centrally-disposed firing pin seat bore, a horizontal bottom, and a pair of vertical and opposing sides that extend from said slightly convex-shaped and vertical front of said generally rectangular-parallelepiped-shaped main portion of said firing pin of said breech block assembly to said slightly convex-shaped and vertical rear of said generally rectangular-parallelepiped-shaped main portion of said firing pin of said breech block assembly; said generally rectangular-parallelepiped-shaped main portion of said firing pin of said breech block assembly further has a width that is slightly less than that of said generally rectangular-parallelepiped-shaped internal trigger assembly chamber in said hollow and generally rectangular-parallelepiped-shaped breech block of said breech block assembly so as to be readily forwardly and rearwardly slidable therein.

44. The action as defined in claim 43, wherein said firing pin of said breech block assembly further has a generally convexo-concave and vertical cocking portion that extends vertically downwardly from said horizontal bottom of said generally rectangular-parallelepiped-shaped main portion of said firing pin of said breech block assembly, and which has a front convex cocking surface that is in vertical alignment with said slightly convex-shaped and vertical front of said generally rectangular-parallelepiped-shaped main portion of said firing pin of said breech block assembly.

45. The action as defined in claim 44, wherein said firing pin of said breech block assembly further has a firing pin tip that extends horizontally outwardly from said slightly convex-shaped and vertical front of said generally rectangular-parallelepiped-shaped main portion of said firing pin of said breech block assembly, and which is in horizontal alignment with said generally centrally-disposed firing pin seat bore in said outer surface of said slightly convex-shaped and vertical rear of said generally rectangular-parallelepiped-shaped main portion of said firing pin of said breech block assembly.

46. The action as defined in claim 45, wherein said horizontal bottom of said generally rectangular-parallelepiped-shaped main portion of said firing pin of said breech block assembly has an inwardly-and-upwardly-tapering sear recess that extends horizontally rearwardly from a rear concave surface of said generally convexo-concave and vertical cocking portion of said firing pin of said breech block assembly to a substantial midpoint of said horizontal bottom of said generally rectangular-parallelepiped-shaped main portion of said firing pin of said breech block assembly, and which opens into both, and extends continuously horizontally between, said pair of vertical and opposing sides of said generally rectangular-parallelepiped-shaped main portion of said firing pin of said breech block assembly.

47. The action as defined in claim 46, wherein said firing pin of said breech block assembly further has a firing pin spring with a front end that sits horizontally in said generally centrally-disposed firing pin seat bore in said outer surface of said slightly convex-shaped and vertical rear of said generally rectangular-parallelepiped-shaped main portion of said firing pin of said breech block assembly, and a rear end; said firing pin of said breech block assembly is forwardly and rearwardly slidably positioned in said generally rectangular-parallelepiped-shaped internal trigger assembly chamber in said hollow and generally rectangular-parallelepiped-shaped breech block of said breech block assembly, with said firing pin tip of said firing pin of said breech block assembly in horizontal alignment with said firing pin tip throughbore in said vertical and substantially open front of said hollow and generally rectangular-parallelepiped-shaped breech block of said breech block assembly, and with said rear end of said firing pin spring of said firing pin of said breech block assembly sitting in said firing pin spring seat bore in said inner surface of said vertical and closed back of said generally rectangular-parallelepiped-shaped breech block of said breech block assembly, so that said firing pin of said breech block assembly is biased by virtue of said firing pin spring of said firing pin of said breech block assembly and said firing pin tip of said firing pin of said breech block assembly can extend through said firing pin tip throughbore in said vertical and substantially open front of said hollow and generally rectangular-parallelepiped-shaped breech block of said breech block assembly.

48. The action as defined in claim 47, wherein said hollow and generally rectangular-parallelepiped-shaped breech block of said breech block assembly is vertically slidably positioned in said breech block throughraceway in said low area in said horizontal top of said generally rectangular-shaped lower receiver of said lower receiver assembly and in said breech block throughraceway in said generally rectangular-parallelepiped-shaped body of said upper receiver assembly, with said laterally-and-inwardly-oriented and cylindrically-shaped stud of said horizontal movable rack of said lower receiver being replaceably slidably engagable in said movable rack stud slot in said outer surface of said another side of said pair of parallel, vertical, and opposing sides of said hollow and generally rectangular-parallelepiped-shaped breech block of said breech block assembly.

49. The action as defined in claim 48, wherein said trigger assembly includes a generally rectangular-parallelepiped-shaped trigger housing that has a horizontal top, an open bottom that is disposed below said horizontal top of said generally rectangular-parallelepiped-shaped trigger housing of said trigger assembly, a vertical closed rear, and a vertical front that is disposed forward of said vertical closed rear of said generally rectangular-parallelepiped-shaped trigger housing of said trigger assembly; said generally rectangular-parallelepiped-shaped trigger housing of said trigger assembly further has a pair of opposing, parallel, and vertical sides that extend from said open bottom of said generally rectangular-parallelepiped-shaped trigger housing of said trigger assembly past said horizontal top of said generally rectangular-parallelepiped-shaped trigger housing of said trigger assembly so as to form therewith a pair of horizontal firing pin guide lips; said pair of horizontal firing pin guide lips of said horizontal top of said generally rectangular-parallelepiped-shaped trigger housing of said trigger assembly extend horizontally from said vertical front of said generally rectangular-parallelepiped-shaped trigger housing of said trigger assembly to said vertical closed rear of said generally rectangular-parallelepiped-shaped trigger housing of said trigger assembly.

50. The action as defined in claim 49, wherein said generally rectangular-parallelepiped-shaped trigger housing of said trigger assembly further has a substantially T-shaped sear throughraceway that extends vertically continuously between, and open into both, said horizontal top of said generally rectangular-parallelepiped-shaped trigger housing of said trigger assembly and said open bottom of said generally rectangular-parallelepiped-shaped trigger housing of said trigger assembly, and which also opens into said vertical front of said generally rectangular-parallelepiped-shaped trigger housing of said trigger assembly.

51. The action as defined in claim 50, wherein each side of said pair of opposing, parallel, and vertical sides of said generally rectangular-parallelepiped-shaped trigger housing of said trigger assembly has a rectangular-shaped and horizontally sear spring brace throughslot that are in horizontal alignment with each other, and which open into both said vertical front of said generally rectangular-parallelepiped-shaped trigger housing of said trigger assembly and said substantially T-shaped sear throughraceway of said generally rectangular-parallelepiped-shaped trigger housing of said trigger assembly.

52. The action as defined in claim 51, wherein each side of said pair of opposing, parallel, and vertical sides of said generally rectangular-parallelepiped-shaped trigger housing of said trigger assembly further has a pair of trigger housing mounting throughbores that are in horizontal alignment with each other and with said pair of trigger assembly mounting throughbores in said hollow and generally rectangular-parallelepiped-shaped breech block of said breech block assembly.

53. The action as defined in claim 52, wherein said trigger assembly further includes a sear that has a substantially T-shaped lateral cross section which is similar to that of said substantially T-shaped sear throughraceway in said generally rectangular-parallelepiped-shaped trigger housing of said trigger assembly so as to be vertically slidable therein.

54. The action as defined in claim 53, wherein said sear of said trigger assembly has a horizontal top, a horizontal bottom that is disposed below said horizontal top of said sear of said trigger assembly, a vertical front, a pair of opposing, parallel, and vertical sides that extend vertically from said top of said sear of said trigger assembly to said horizontal bottom of said sear of said trigger assembly, and a vertical rear that is disposed behind said vertical front of said sear of said trigger assembly.

55. The action as defined in claim 54, wherein said horizontal top of said sear of said trigger assembly has an inwardly-and-upwardly-tapering projection that extends horizontally rearwardly from said vertical front of said sear of said trigger assembly to a substantial midpoint of said horizontal top of said sear of said trigger assembly, and which extends sidewardly between said pair of opposing, parallel, and vertical sides of said sear of said trigger assembly, and which is similar to said inwardly-and-upwardly-tapering sear recess of said horizontal bottom of said generally rectangular-parallelepiped-shaped main portion of said firing pin of said breech block assembly so as to be replaceably engagable therein.

56. The action as defined in claim 55, wherein said horizontal bottom of said sear of said trigger assembly has a rectangular-parallelepiped-shaped sear spring recess that extends perpendicularly upwardly therefrom, and which opens into said pair of opposing, parallel, and vertical sides of said sear of said trigger assembly, and which is disposed between, and parallel to, said vertical front of said sear of said trigger assembly and said vertical rear of said trigger assembly sear of said trigger assembly.

57. The action as defined in claim 56, wherein said sear of said trigger assembly further has a sear spring that is disposed vertically in said rectangular-parallelepiped-shaped sear spring recess in said horizontal bottom of said sear of said trigger assembly, and which has an upper end that sits in a recess in an upper horizontal border of said rectangular-parallelepiped-shaped sear spring recess in said horizontal bottom of said sear of said trigger assembly.

58. The action as defined in claim 57, wherein said sear of said trigger assembly further has a sear spring horizontal brace that has a recess therein in which a lower end of said sear spring of said sear of said trigger assembly sits; said sear of said trigger assembly is vertically slidably positioned in said substantially T-shaped sear throughraceway in said generally rectangular-parallelepiped-shaped trigger housing of said trigger assembly, with said sear spring horizontal brace of said sear of said trigger assembly replaceably engaged in said rectangular-shaped and horizontal sear spring brace throughslot in each of said pair of opposing, parallel, and vertical sides of said generally rectangular-parallelepiped-shaped trigger housing of said trigger assembly, and with said sear of said trigger assembly being biased therein by virtue of said sear spring of said sear of said trigger assembly.

59. The action as defined in claim 58, wherein said trigger assembly further includes a generally concavo-convex-shaped vertical trigger that has a horizontal top, a vertical front, a vertical rear that is disposed behind said vertical front of said generally concavo-convex-shaped vertical trigger of said trigger assembly, a pair of opposing vertical sides, and a rectangular-parallelepiped-shaped block that extends vertically upwardly from said horizontal top of said generally concavo-convex-shaped vertical trigger of said trigger assembly, horizontally rearwardly from said vertical front of said generally concavo-convex-shaped vertical trigger of said trigger assembly to a substantial midpoint of said horizontal top of said generally concavo-convex-shaped vertical trigger of said trigger assembly, and sidewardly from one side of said pair of opposing vertical sides of said generally concavo-convex-shaped vertical trigger of said trigger assembly to another side of said pair of opposing vertical sides of said generally concavo-convex-shaped vertical trigger of said trigger assembly; said rectangular-parallelepiped-shaped block of said generally concavo-convex-shaped vertical trigger of said trigger assembly has a vertical rear, a horizontal top, and a pair of opposing vertical sides.

60. The action as defined in claim 59, wherein said horizontal top of said rectangular-parallelepiped-shaped block of said generally concavo-convex-shaped vertical trigger of said trigger assembly has a horizontal trigger safety recess that extends sidewardly between, and opens into, said pair of opposing vertical sides of said rectangular-parallelepiped-shaped block of said generally concavo-convex-shaped vertical trigger of said trigger assembly, while also opening into said vertical rear of said horizontal top of said rectangular-parallelepiped-shaped block of said generally concavo-convex-shaped vertical trigger of said trigger assembly, and which is releaseably engagable with said horizontal bottom of said sear of said trigger assembly.

61. The action as defined in claim 60, wherein said rectangular-parallelepiped-shaped block of said generally concavo-convex-shaped vertical trigger of said trigger assembly further has a laterally-oriented trigger mounting throughbore that extends laterally therethrough, at a substantial midpoint thereof, between said pair of opposing vertical sides of said rectangular-parallelepiped-shaped block of said generally concavo-convex-shaped vertical trigger of said trigger assembly, and which is in horizontal alignment with a lowermost throughbore of said pair of trigger assembly mounting throughbores in said generally rectangular-parallelepiped-shaped breech block of said breech block assembly.

62. The action as defined in claim 61, wherein said trigger assembly further includes a trigger spring that has a lower end that sits vertically in a seat in said horizontal top of said generally concavo-convex-shaped vertical trigger of said trigger assembly, in proximity to said vertical rear of said generally concavo-convex-shaped vertical trigger of said trigger assembly; said generally rectangular-parallelepiped-shaped trigger housing of said trigger assembly is replaceably positioned in said generally rectangular-parallelepiped-shaped internal trigger assembly chamber in said hollow and generally rectangular-parallelepiped-shaped breech block of said breech block assembly, with said horizontal bottom of said generally rectangular-parallelepiped-shaped main portion of said firing pin of said breech block assembly being forwardly and rearwardly slidably positioned on said horizontal top of said generally rectangular-parallelepiped-shaped trigger housing of said trigger assembly, and with said pair of horizontal firing pin guide lips of said horizontal top of said generally rectangular-parallelepiped-shaped trigger housing of said trigger assembly providing a guide therefor, and with said inwardly-and-upwardly-tapering projection of said horizontal top of the sear of said trigger assembly being replaceably engagable in said inwardly-and-upwardly-tapering sear recess in said horizontal bottom of said generally rectangular-parallelepiped-shaped main portion of said firing pin of said breech block assembly; said generally rectangular-parallelepiped-shaped trigger housing of said trigger assembly is replaceably maintained in said generally rectangular-parallelepiped-shaped internal trigger assembly chamber in said hollow and generally rectangular-parallelepiped-shaped breech block of said breech block assembly by an uppermost pin of a pair of trigger housing mounting pins that replaceably extends horizontally through an uppermost throughbore of said pair of trigger assembly mounting throughbores in said hollow and generally rectangular-parallelepiped-shaped breech block of said breech block assembly and through a corresponding uppermost throughbore of said pair of trigger housing mounting throughbores in said pair of opposing, parallel, and vertical sides of said generally rectangular-parallelepiped-shaped trigger housing of said trigger assembly.

63. The action as defined in claim 62, wherein said generally concavo-convex-shaped vertical trigger of said trigger assembly is forwardly and rearwardly pivotally mounted in said generally rectangular-parallelepiped-shaped trigger housing of said trigger assembly, with said horizontal top of said rectangular-parallelepiped-shaped block of said generally concavo-convex-shaped vertical trigger of said trigger assembly abutable against, and releasable from, said horizontal bottom of said sear of said trigger assembly, and with said laterally-oriented trigger mounting throughbore of said rectangular-parallelepiped-shaped block of said generally concavo-convex-shaped vertical trigger of said trigger assembly being in horizontal alignment with a corresponding lowermost throughbore of said trigger housing mounting throughbores in said pair of opposing, parallel, and vertical sides of said generally rectangular-parallelepiped-shaped trigger housing of said trigger assembly and with a corresponding lowermost throughbore of said trigger housing mounting throughbores in said hollow and generally rectangular-parallelepiped-shaped breech block of said breech block assembly; said generally concavo-convex-shaped vertical trigger of said trigger assembly is forwardly and rearwardly pivotally maintained in said generally rectangular-parallelepiped-shaped trigger housing of said trigger assembly, by a lowermost pin of said pair of trigger housing mounting pins that replaceably extends horizontally through said lowermost throughbore of said pair of trigger assembly mounting throughbores in said hollow and generally rectangular-parallelepiped-shaped breech block of said breech block assembly, through said laterally-oriented trigger mounting throughbore of said rectangular-parallelepiped-shaped block of said generally concavo-convex-shaped vertical trigger of said trigger assembly, and through a corresponding lowermost throughbore of said pair of trigger housing mounting throughbores in said pair of opposing, parallel, and vertical sides of said generally rectangular-parallelepiped-shaped trigger housing of said trigger assembly, and which also further replaceably maintains said generally rectangular-parallelepiped-shaped trigger housing of said trigger assembly in said generally rectangular-parallelepiped-shaped internal chamber in said hollow and generally rectangular-parallelepiped-shaped breech block of said breech block assembly.

64. The action as defined in claim 63, wherein said trigger assembly further includes a substantially U-shaped trigger guard that has a forwardmost leg with a rectangular-parallelepiped-shaped top that has a horizontal top with a centrally-disposed and threaded trigger safety mounting bore that extends centrally downwardly therein, and a vertical side with a centrally-disposed horizontal trigger safety plunger bore that extends laterally therein.

65. The action as defined in claim 64, wherein said substantially U-shaped trigger guard of said trigger assembly further has a trigger safety plunger that is slidably positioned in, and slidably extendable from, said centrally-disposed horizontal trigger safety plunger bore in said vertical side of said rectangular-parallelepiped-shaped top of said forwardmost leg of said substantially U-shaped trigger guard of said trigger assembly, and which is biased by a safety plunger spring that is also contained therein and which provides a more positive engagement.

66. The action as defined in claim 65, wherein said substantially U-shaped trigger guard of said trigger assembly further has a substantially C-shaped horizontal safety plate with a horizontal top, a horizontal bottom that is disposed below said horizontal top of said substantially C-shaped horizontal safety plate of said substantially U-shaped trigger guard of said trigger assembly, a vertical front, a vertical rear that is parallel to, disposed behind, and narrower than, said vertical front of said substantially C-shaped horizontal safety plate of said substantially U-shaped trigger guard of said trigger assembly, and a pair of spaced-apart longitudinal sides; said vertical front of said substantially C-shaped horizontal safety plate of said substantially U-shaped trigger guard of said trigger assembly has a width that is greater than that of said rectangular-parallelepiped-shaped top of said forwardmost leg of said substantially U-shaped trigger guard of said trigger assembly so as to allow said substantially C-shaped horizontal safety plate of said substantially U-shaped trigger guard of said trigger assembly to laterally overlap said rectangular-parallelepiped-shaped top of said forwardmost leg of said substantially U-shaped trigger guard of said trigger assembly, an equal amount on both sides thereof; said substantially C-shaped horizontal safety plate of said substantially U-shaped trigger guard of said trigger assembly further has a vertical safety boss that is parallel to, and forward of, said vertical rear of said substantially C-shaped horizontal safety plate of said substantially U-shaped trigger guard of said trigger assembly.

67. The action as defined in claim 66, wherein said substantially C-shaped horizontal safety plate of said substantially U-shaped trigger guard of said trigger assembly further has a safety plate mounting throughbore that extends vertically therethrough from said horizontal top of said substantially C-shaped horizontal safety plate of said substantially U-shaped trigger guard of said trigger assembly to said horizontal bottom of said substantially C-shaped horizontal safety plate of said substantially U-shaped trigger guard of said trigger assembly, in proximity to said vertical front of said substantially C-shaped horizontal safety plate of said substantially U-shaped trigger guard of said trigger assembly, and in vertical alignment with said centrally-disposed and threaded trigger safety mounting bore of said horizontal top of said rectangular-parallelepiped-shaped top of said forwardmost leg of said substantially U-shaped trigger guard of said trigger assembly.

68. The action as defined in claim 67, wherein said horizontal top of said substantially C-shaped horizontal safety plate of said substantially U-shaped trigger guard of said trigger assembly has a safety plate mounting counterbore that is concentric with said safety plate mounting throughbore in said substantially C-shaped horizontal safety plate of said substantially U-shaped trigger guard of said trigger assembly.

69. The action as defined in claim 68, wherein said substantially C-shaped horizontal safety plate of said substantially U-shaped trigger guard of said trigger assembly is replaceably mounted to said substantially U-shaped trigger guard of said trigger assembly, with said horizontal bottom of said substantially C-shaped horizontal safety plate of said substantially U-shaped trigger guard of said trigger assembly in horizontal abutment with said horizontal top of said rectangular-parallelepiped-shaped top of said forwardmost leg of said substantially U-shaped trigger guard of said trigger assembly, by a safety plate mounting screw that extends vertically through said safety plate mounting throughbore in said substantially C-shaped horizontal safety plate of said substantially U-shaped trigger guard of said trigger assembly and which threadably engages said centrally-disposed and threaded trigger safety mounting bore in said horizontal top of said rectangular-parallelepiped-shaped top of said forwardmost leg of said substantially U-shaped trigger guard of said trigger assembly, and whose head sits unobstructingly in said safety plate mounting counter-bore in said horizontal top of said substantially C-shaped horizontal safety plate of said substantially U-shaped trigger guard of said trigger assembly.

70. The action as defined in claim 69, wherein said substantially U-shaped trigger guard of said trigger assembly is forwardly and rearwardly slidably positioned in said generally rectangular-parallelepiped-shaped internal trigger assembly chamber in said hollow and generally rectangular-parallelepiped-shaped breech block of said breech block assembly, with said pair of spaced-apart longitudinal sides of said substantially C-shaped horizontal safety plate of said substantially U-shaped trigger guard of said trigger assembly slidably engaging said trigger safety raceway in said inner surface of each side of said pair of parallel, vertical, and opposing sides of said hollow and generally rectangular-parallelepiped-shaped breech block of said breech block assembly, with said vertical safety boss of said substantially C-shaped horizontal safety plate of said substantially U-shaped trigger guard of said trigger assembly releaseably engagable with said horizontal trigger safety recess in said horizontal top of said rectangular-parallelepiped-shaped block of said generally concavo-convex-shaped vertical trigger of said trigger assembly, and with said trigger safety plunger of said substantially-shaped trigger guard of said trigger assembly releaseably engagable with one detent of said pair of spaced-apart trigger safety plunger detents in said inner surface of said one side of said pair of parallel, vertical, and opposing sides of said hollow and generally rectangular-parallelepiped-shaped breech block of said breech block assembly.

71. A method of using a single shot falling breech block action, comprising the steps of:

a) rotating a slender and cylindrically-shaped finger lever of a lower receiver assembly of said single shot falling breech block action clockwise;

b) rotating a horizontal pinion of said lower receiver assembly clockwise;

c) walking said horizontal pinion rearwardly along a horizontal stationary rack of said lower receiver while being guided therealong by a pinion guide throughslot in a generally rectangular-shaped lower receiver of said lower receiver assembly;

d) sliding a generally rectangular-shaped action plate of said lower receiver assembly rearwardly in a horizontal action plate raceway slot in a pair of parallel and opposing vertical walls of said generally rectangular-shaped lower receiver;

e) causing a cocking boss of a rear extension of said generally rectangular-shaped action plate to abut against and begin to move a front convex cocking surface of a generally convexo-concave and vertical cocking portion of a firing pin of a breech block assembly of said single shot falling breech block action rearwardly, against the biasing of a firing pin spring of said firing pin;

f) sliding a horizontal movable rack of said lower receiver assembly rearwardly at twice the speed of said cocking boss, by virtue of said horizontal pinion also moving rearwardly as it rotates;

g) sliding a laterally-and-inwardly-oriented and cylindrically-shaped stud of said horizontal movable rack rearwardly in a horizontal front slot portion of a movable rack stud slot of an outer surface of a hollow and generally rectangular-parallelepiped-shaped breech block of said breech block assembly until a firing pin tip of said firing pin is pushed out of a primer of a spent cartridge;

h) sliding said laterally-and-inwardly-oriented and cylindrically-shaped stud upwardly and rearwardly in a straight line in an inclined intermediate portion of said movable rack stud slot;

i) sliding said hollow and generally rectangular-parallelepiped-shaped breech block downwardly in a breech block throughraceway in a generally rectangular-parallelepiped-shaped body of an upper receiver assembly and a breech block throughraceway in said generally rectangular-shaped lower receiver;

j) rotating said slender and cylindrically-shaped finger lever clockwise;

k) causing said cocking boss to continue to move said front convex cocking surface rearwardly, against the continual biasing of said firing pin spring;

l) sliding said laterally-and-inwardly-oriented and cylindrically-shaped stud rearwardly in a horizontal rear slot portion of said movable rack stud slot until an inwardly-and-upwardly-tapering projection of a horizontal top of a sear of a trigger assembly of said single shot falling breech block action replaceably engages a mating inwardly-and-upwardly-tapering recess in a horizontal bottom of a generally rectangular-parallelepiped-shaped main portion of said firing pin;

m) maintaining said inwardly-and-upwardly-tapering projection in said mating inwardly-and-upwardly-tapering recess, by the biasing of a sear spring of said sear;

n) pivoting a generally concavo-convex-shaped vertical trigger of said trigger assembly forwardly about a lowermost pin of a pair of trigger housing mounting pins of said trigger assembly, by the biasing of a trigger spring of said trigger assembly, until a horizontal top of a rectangular-parallelepiped-shaped block of said trigger assembly generally concavo-convex-shaped vertical trigger abuts against a horizontal bottom of said sear and an extractor boss of said rear of said generally rectangular-shaped action plate abuts against a front of a generally rectangular-parallelepiped-shaped extractor of said lower receiver assembly, so that said single shot falling breech block action is now fully cocked;

o) rotating said slender and cylindrically-shaped finger lever slightly clockwise until said extractor boss pivots said generally rectangular-parallelepiped-shaped extractor rearwardly and extracts a spent cartridge;

p) rotating said slender and cylindrically-shaped finger lever slightly counterclockwise, so that said single shot falling breech block action is returned to fully cocked;

q) sliding a substantially U-shaped trigger guard of said trigger assembly forwardly with a pair of spaced-apart longitudinal sides of a substantially C-shaped horizontal safety plate of said substantially U-shaped trigger guard sliding forwardly in a trigger safety raceway in an inner surface of each side of a pair of parallel, vertical, and opposing sides of said hollow and generally rectangular-parallelepiped-shaped breech block until a vertical safety boss of said trigger assembly trigger guard substantially C-shaped horizontal safety plate engages a trigger safety recess in said horizontal top of said rectangular-parallelepiped-shaped block and a trigger safety plunger of said substantially U-shaped trigger guard releaseably engages a forwardmost detent of a pair of spaced-apart trigger safety plunger detents in said inner surface of a side of said pair of parallel, vertical, and opposing sides, so that said generally concavo-convex-shaped vertical trigger is prevented from being pulled and said sear is prevented from dropping and said single shot falling breech block action is prevented from being fired;

r) rotating said slender and cylindrically-shaped finger lever counterclockwise;

s) sliding said laterally-and-inwardly-oriented and cylindrically-shaped stud forwardly in said horizontal rear slot portion of said movable rack stud slot;

t) sliding said laterally-and-inwardly-oriented and cylindrically-shaped stud downwardly and forwardly in said inclined intermediate slot portion of said movable rack stud slot;

u) sliding said laterally-and-inwardly-oriented and cylindrically-shaped stud forwardly in said horizontal front slot portion of said movable rack stud slot;

v) sliding said breech block assembly upwardly in said breech block throughraceway in said generally rectangular-shaped lower receiver and said breech block throughraceway in said generally rectangular-parallelepiped-shaped body;

w) closing said single shot falling breech block action;

x) sliding said substantially U-shaped trigger guard rearwardly with said pair of spaced-apart longitudinal sides of said substantially C-shaped horizontal safety plate sliding rearwardly in said trigger safety raceway, until said vertical safety boss is released from said trigger safety recess and said trigger safety plunger releaseably engages a rearmost detent of said pair of spaced-apart trigger safety plunger detents, so that said generally concavo-convex-shaped vertical trigger of said trigger assembly can be pulled and said sear can drop and said single shot falling breech block action can be fired;

y) pulling said generally concavo-convex-shaped vertical trigger against the biasing of said trigger spring;

z) releasing hold of said generally concavo-convex-shaped vertical trigger on said sear;

aa) moving said firing pin rapidly forwardly, by virtue of said firing spring being stronger than said sear spring;

bb) releasing said inwardly-and-upwardly-tapering projection of said sear from said inwardly-and-upwardly-tapering rear recess of said horizontal bottom of said generally rectangular-parallelepiped-shaped main portion of said firing pin of said breech block assembly;

cc) forcing said sear downwardly;

dd) extending a firing pin tip of said firing pin through a firing pin tip throughbore in a vertical and substantially open front of said hollow and generally rectangular-parallelepiped-shaped breech block, so that said single shot falling breech block action has been fired; and ee) repeating steps a) through dd) to refire, if desired.

72. The method as defined in claim 71, further comprising the steps of:

ff) unscrewing and removing a screw of a take down screw sub-assembly of said lower receiver assembly, along with an integrated plunger of said take down screw sub-assembly, from a take down throughbore in said generally rectangular-shaped action plate, through said pinion guide throughslot;

gg) rotating said slender and cylindrically-shaped finger lever slightly counterclockwise;

hh) rotating said horizontal pinion slightly counterclockwise;

ii) walking said horizontal pinion forwardly until said laterally-and-inwardly-oriented and cylindrically-shaped stud of said horizontal movable rack receiver slides forwardly and completely leaves said movable rack stud slot;

jj) pressing said breech block assembly downwardly; and kk) removing said breech block assembly through said breech block throughraceway in said generally rectangular-shaped lower receiver, so that said breech block assembly can serviced.

73. A method preparing a single shot rifle for firing, comprising the step of activating a single shot falling breech block action which comprises:

a) an upper receiver assembly; said upper receiver assembly having generally rectangular-parallelepiped-shaped body with a vertical front and a vertical rear being disposed behind said vertical front of said generally rectangular-parallelepiped-shaped body of said upper receiver assembly; said generally rectangular-parallelepiped-shaped body of said upper receiver assembly further having a horizontal top extending from said vertical front of said generally rectangular-parallelepiped-shaped body of said upper receiver assembly to said vertical rear of said generally rectangular-parallelepiped-shaped body of said upper receiver assembly; said generally rectangular-parallelepiped-shaped body of said upper receiver assembly further having a horizontal bottom being disposed below said horizontal top of said assembly generally rectangular-parallelepiped-shaped body of said upper receiver assembly and extending from said vertical front of said generally rectangular-parallelepiped-shaped body of said upper receiver assembly to said vertical rear of said generally rectangular-parallelepiped-shaped body of said upper receiver assembly; said generally rectangular-parallelepiped-shaped body of said upper receiver assembly further having a pair of opposing and vertical sides; each side of said pair of opposing and vertical sides of said generally rectangular-parallelepiped, shaped body of said upper receiver assembly extending from a side of said vertical front of said generally rectangular-parallelepiped-shaped body of said upper receiver assembly to a respective side of said vertical rear of said generally rectangular-parallelepiped-shaped body of said upper receiver assembly and from a side of said horizontal top of said generally rectangular-parallelepiped-shaped body of said upper receiver assembly to a respective side of said horizontal bottom of said generally rectangular-parallelepiped-shaped body of said upper receiver assembly; said generally rectangular-parallelepiped-shaped body of said upper receiver assembly further having an imaginary intermediate vertical plane being disposed at a substantial midpoint between said vertical front of said generally rectangular-parallelepiped-shaped body of said upper receiver assembly and said vertical rear of said generally rectangular-parallelepiped-shaped body of said upper receiver assembly;

b) a lower receiver assembly being replaceably attached to said upper receiver assembly;

c) a breech block assembly being replaceably and vertically slidably mounted in said lower receiver assembly and said upper receiver assembly;

d) a trigger assembly being replaceably mounted in said breech block assembly;

e) a stationary rack being replaceably and fixedly attached in said lower receiver assembly;

f) a movable rack being replaceably and forwardly and rearwardly slidably mounted in said lower receiver assembly and being engagable with said breech block assembly;

g) a pinion being clockwise and counterclockwise rotatively, and forwardly and rearwardly movably, positioned in said lower receiver and being rotatively engaged with said stationary rack and said movable rack;

h) an action plate being forwardly and rearwardly slidably mounted in said lower receiver assembly and being rotatively attached to said pinion, so that said pinion can rotate relative thereto; said action plate being abutable against said breech block assembly; and i) pinion rotating means for rotating said pinion, so that when said pinion rotating means is rotated clockwise said pinion is rotated clockwise and walks rearwardly along said horizontal stationary rack while said action plate slides rearwardly and begins to cock said single shot falling breech block action and said movable rack slides rearwardly and causes said breech block assembly to slide downwardly to load a cartridge and when said pinion rotating means is rotated counterclockwise said pinion is rotated counterclockwise and walks forwardly along said horizontal stationary rack while said action plate slides forwardly and said movable rack slides forwardly and causes said breech block assembly to slide upwardly and fully cocking said single shot falling breech block action.

* * * * *